US009433332B2

(12) United States Patent
Conrad

(10) Patent No.: US 9,433,332 B2
(45) **Date of Patent: *Sep. 6, 2016**

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 532 days.

This patent is subject to a terminal disclaimer.

(21) Appl. No.: 13/779,405

(22) Filed: Feb. 27, 2013

(65) Prior Publication Data

US 2014/0237759 A1 Aug. 28, 2014

(51) Int. Cl.

| | |
|---|---|
| ***A47L 9/16*** | (2006.01) |
| ***A47L 9/12*** | (2006.01) |
| ***A47L 9/19*** | (2006.01) |
| ***A47L 9/32*** | (2006.01) |
| ***A47L 5/24*** | (2006.01) |
| ***A47L 5/32*** | (2006.01) |
| ***A47L 5/36*** | (2006.01) |

(52) U.S. Cl.

CPC .. *A47L 9/16* (2013.01); *A47L 5/24* (2013.01); *A47L 5/32* (2013.01); *A47L 5/362* (2013.01); *A47L 9/165* (2013.01); *A47L 9/1608* (2013.01); *A47L 9/1666* (2013.01); *A47L 9/322* (2013.01); *A47L 9/325* (2013.01); *A47L 9/19* (2013.01)

(58) Field of Classification Search

CPC ..... A47L 9/16

USPC ..... 15/344, 351, 353

See application file for complete search history.

(56) References Cited

U.S. PATENT DOCUMENTS

| | | | |
|---|---|---|---|
| 911,258 | A | 2/1909 | Richard |
| 1,600,762 | A | 9/1926 | Hawley |
| 1,797,812 | A | 3/1931 | Waring |
| 1,898,608 | A | 2/1933 | William |
| 1,937,765 | A | 12/1933 | Ward |
| 2,015,464 | A | 9/1935 | Saint |
| 2,152,114 | A | 3/1939 | Tongeren |
| 2,542,634 | A | 2/1951 | Davis et al. |
| 2,678,110 | A | 5/1954 | Madsen |
| 2,731,102 | A | 1/1956 | James |

(Continued)

FOREIGN PATENT DOCUMENTS

| | | |
|---|---|---|
| AU | 112778 | 4/1940 |
| CA | 1077412 A1 | 5/1980 |

(Continued)

OTHER PUBLICATIONS

International Preliminary Report on Patentability, dated Sep. 16, 2008 for International application No. PCT/CA2007/000380.

(Continued)

*Primary Examiner* — Joseph J Hail
*Assistant Examiner* — J Stephen Taylor
(74) *Attorney, Agent, or Firm* — Philip C. Mendes da Costa; Bereskin & Parr LLP/S.E.N.C.R.L.,s.r.l.

(57) ABSTRACT

A hand carriable surface cleaning apparatus, such as a cyclonic hand vacuum cleaner, is provided wherein a conduit is in communication with the cyclone air outlet. The conduit extends through the pre-motor filter and is in communication with the upstream side of the pre-motor filter.

21 Claims, 34 Drawing Sheets

(56) References Cited

U.S. PATENT DOCUMENTS 2,811,219 A 10/1957 Wenzl
2,846,024 A 8/1958 Bremi
2,913,111 A 11/1959 Rogers
2,917,131 A 12/1959 Evans
2,937,713 A 5/1960 Stephenson et al.
2,942,691 A 6/1960 Dillon
2,946,451 A 7/1960 Culleton
2,952,330 A 9/1960 Winslow
2,981,369 A 4/1961 Yellott et al.
3,002,215 A 10/1961 MacFarland
3,032,954 A 5/1962 Racklyeft
3,085,221 A 4/1963 Kelly
3,130,157 A 4/1964 Kelsall et al.
3,200,568 A 8/1965 McNeil
3,204,772 A 9/1965 Ruxton
3,217,469 A 11/1965 Eckert
3,269,097 A 8/1966 German
3,320,727 A 5/1967 Farley et al.
3,372,532 A 3/1968 Campbell
3,426,513 A 2/1969 Bauer
3,518,815 A 7/1970 Peterson et al.
3,530,649 A 9/1970 Porsch et al.
3,561,824 A 2/1971 Homan
3,582,616 A 6/1971 Wrob
3,675,401 A 7/1972 Cordes
3,684,093 A 8/1972 Kono
3,822,533 A 7/1974 Oranje
3,870,486 A 3/1975 Eriksson et al.
3,877,902 A 4/1975 Eriksson
3,898,068 A 8/1975 McNeil et al.
3,933,450 A 1/1976 Percevaut
3,988,132 A 10/1976 Oranje
3,988,133 A 10/1976 Schady
4,097,381 A 6/1978 Ritzler
4,187,088 A 2/1980 Hodgson
4,218,805 A 8/1980 Brazier
4,236,903 A 12/1980 Malmsten
4,307,485 A 12/1981 Dessig
4,373,228 A 2/1983 Dyson
4,382,804 A 5/1983 Mellor
4,409,008 A 10/1983 Solymes
4,486,207 A 12/1984 Baillie
4,678,588 A 7/1987 Shortt
4,744,958 A 5/1988 Pircon
4,778,494 A 10/1988 Patterson
4,826,515 A 5/1989 Dyson
D303,173 S 8/1989 Masakata et al.
4,853,008 A 8/1989 Dyson
4,853,011 A 8/1989 Dyson
4,853,111 A 8/1989 MacArthur et al.
4,905,342 A 3/1990 Ataka
4,944,780 A 7/1990 Usmani
5,078,761 A 1/1992 Dyson
5,080,697 A 1/1992 Finke
5,090,976 A 2/1992 Dyson
5,129,125 A 7/1992 Gamou et al.
5,224,238 A 7/1993 Bartlett
5,230,722 A 7/1993 Yonkers
5,254,019 A 10/1993 Noschese
5,267,371 A 12/1993 Soler et al.
5,309,601 A 5/1994 Hampton et al.
5,347,679 A 9/1994 Saunders et al.
5,481,780 A 1/1996 Daneshvar
5,599,365 A 2/1997 Alday et al.
D380,033 S 6/1997 Theiss et al.
5,755,096 A 5/1998 Holleyman
5,815,878 A 10/1998 Murakami et al.
5,858,038 A 1/1999 Dyson et al.
5,858,043 A 1/1999 Geise
5,893,938 A 4/1999 Dyson et al.
5,935,279 A 8/1999 Kilstrom
5,950,274 A 9/1999 Kilstrom
6,071,095 A 6/2000 Verkaart
6,071,321 A 6/2000 Trapp et al.
6,080,022 A 6/2000 Shaberman et al.
6,122,796 A 9/2000 Downham et al.
6,171,356 B1 * 1/2001 Twerdun ..... 55/337
6,221,134 B1 4/2001 Conrad et al.
6,228,260 B1 5/2001 Conrad et al.
6,231,645 B1 5/2001 Conrad et al.
6,251,296 B1 6/2001 Conrad et al.
6,260,234 B1 7/2001 Wright et al.
6,345,408 B1 2/2002 Nagai et al.
6,406,505 B1 * 6/2002 Oh et al. ..... 55/337
6,434,785 B1 8/2002 Vandenbelt et al.
6,440,197 B1 8/2002 Conrad et al.
6,531,066 B1 3/2003 Saunders et al.
6,553,612 B1 4/2003 Dyson et al.
6,553,613 B2 4/2003 Onishi et al.
6,560,818 B1 5/2003 Hasko
6,581,239 B1 6/2003 Dyson et al.
6,599,338 B2 7/2003 Oh et al.
6,599,350 B1 7/2003 Rockwell et al.
6,613,316 B2 9/2003 Sun et al.
6,623,539 B2 9/2003 Lee et al.
6,625,845 B2 9/2003 Hayashi et al.
6,648,934 B2 11/2003 Choi et al.
6,712,868 B2 3/2004 Murphy et al.
6,746,500 B1 6/2004 Park et al.
6,782,583 B2 8/2004 Oh
6,782,585 B1 8/2004 Conrad et al.
6,818,036 B1 11/2004 Seaman
6,833,015 B2 12/2004 Oh et al.
6,868,578 B1 3/2005 Kasper
6,874,197 B1 * 4/2005 Conrad et al. ..... 15/353
6,896,719 B2 5/2005 Coates et al.
6,929,516 B2 8/2005 Brochu et al.
6,968,596 B2 11/2005 Oh et al.
6,976,885 B2 12/2005 Lord
7,105,035 B2 * 9/2006 Oh et al. ..... 55/337
7,160,346 B2 1/2007 Park
7,162,770 B2 1/2007 Davidshofer
7,175,682 B2 2/2007 Nakai et al.
7,198,656 B2 4/2007 Takemoto et al.
7,210,195 B2 5/2007 Howie et al.
7,222,393 B2 5/2007 Kaffenberger et al.
7,272,872 B2 9/2007 Choi
7,278,181 B2 10/2007 Harris et al.
7,341,611 B2 3/2008 Greene et al.
7,354,468 B2 4/2008 Arnold et al.
7,370,387 B2 5/2008 Walker et al.
7,377,007 B2 5/2008 Best
7,377,953 B2 5/2008 Oh
7,386,915 B2 6/2008 Blocker et al.
7,395,579 B2 7/2008 Oh
7,449,040 B2 11/2008 Conrad et al.
7,488,362 B2 2/2009 Jeong et al.
7,488,363 B2 2/2009 Jeong et al.
7,547,337 B2 6/2009 Oh
7,547,338 B2 6/2009 Kim et al.
7,588,616 B2 9/2009 Conrad et al.
7,597,730 B2 10/2009 Yoo et al.
7,601,188 B2 10/2009 Hwang et al.
7,628,831 B2 12/2009 Gomiciaga-Pereda et al.
7,632,324 B2 * 12/2009 Makarov et al. ..... 55/337
7,740,676 B2 6/2010 Burnham et al.
7,770,256 B1 8/2010 Fester
7,774,898 B2 8/2010 Hong et al.
7,776,120 B2 8/2010 Conrad
7,779,506 B2 8/2010 Kang et al.
7,803,207 B2 9/2010 Conrad
7,805,804 B2 10/2010 Loebig
7,811,349 B2 10/2010 Nguyen
7,867,308 B2 * 1/2011 Conrad ..... 55/345
7,922,794 B2 4/2011 Morphey
7,931,716 B2 4/2011 Oakham
7,938,871 B2 5/2011 Lloyd
7,979,959 B2 7/2011 Courtney
8,021,453 B2 9/2011 Howes
8,062,398 B2 11/2011 Luo et al.
8,117,712 B2 2/2012 Dyson et al.
8,146,201 B2 4/2012 Conrad
8,152,877 B2 4/2012 Greene
8,156,609 B2 4/2012 Milne et al.

(56) References Cited

U.S. PATENT DOCUMENTS 8,161,599 B2 4/2012 Griffith et al.
8,225,456 B2 7/2012 Håkan et al.
8,296,900 B2 * 10/2012 Conrad ..... 15/351
8,484,799 B2 7/2013 Conrad
8,578,555 B2 11/2013 Conrad
8,601,641 B2 * 12/2013 Conrad ..... 15/347
8,646,149 B2 2/2014 Conrad
8,677,558 B2 3/2014 Conrad
8,813,305 B2 8/2014 Conrad
8,978,198 B2 * 3/2015 Conrad ..... 15/347
9,027,198 B2 * 5/2015 Conrad ..... 15/344
2001/0015132 A1 8/2001 Rohn et al.
2002/0011050 A1 1/2002 Hansen et al.
2002/0011053 A1 1/2002 Oh
2002/0062531 A1 5/2002 Oh
2002/0088208 A1 7/2002 Lukac et al.
2002/0112315 A1 8/2002 Conrad
2002/0134059 A1 9/2002 Oh
2002/0178535 A1 12/2002 Oh et al.
2002/0178698 A1 12/2002 Oh et al.
2002/0178699 A1 12/2002 Oh
2003/0046910 A1 3/2003 Lee et al.
2003/0066273 A1 4/2003 Choi et al.
2003/0106180 A1 6/2003 Tsen
2003/0159238 A1 8/2003 Oh
2003/0159411 A1 8/2003 Hansen et al.
2003/0200736 A1 10/2003 Ni
2004/0010885 A1 1/2004 Hitzelberger et al.
2004/0025285 A1 2/2004 McCormick et al.
2004/0088816 A1 5/2004 Shimizu et al.
2004/0211025 A1 * 10/2004 Jung et al. ..... 15/353
2004/0216264 A1 11/2004 Shaver et al.
2005/0081321 A1 4/2005 Milligan et al.
2005/0115409 A1 6/2005 Conrad
2005/0132528 A1 6/2005 Yau
2005/0198769 A1 9/2005 Lee et al.
2005/0198770 A1 9/2005 Jung et al.
2005/0252179 A1 11/2005 Oh et al.
2006/0037172 A1 2/2006 Choi
2006/0042206 A1 3/2006 Arnold et al.
2006/0090290 A1 5/2006 Lau
2006/0123590 A1 6/2006 Fester et al.
2006/0137304 A1 6/2006 Jeong et al.
2006/0137306 A1 6/2006 Jeong et al.
2006/0137309 A1 6/2006 Jeong et al.
2006/0137314 A1 6/2006 Conrad et al.
2006/0156508 A1 7/2006 Khalil
2006/0162298 A1 7/2006 Oh et al.
2006/0162299 A1 7/2006 North
2006/0168922 A1 8/2006 Oh
2006/0168923 A1 8/2006 Lee et al.
2006/0207055 A1 9/2006 Ivarsson et al.
2006/0207231 A1 9/2006 Arnold
2006/0230715 A1 10/2006 Oh et al.
2006/0230723 A1 10/2006 Kim et al.
2006/0230724 A1 10/2006 Han et al.
2006/0236663 A1 10/2006 Oh
2006/0254226 A1 * 11/2006 Jeon ..... A47L 9/1625 55/345
2006/0278081 A1 12/2006 Han et al.
2007/0067944 A1 3/2007 Kitamura
2007/0077810 A1 4/2007 Gogel
2007/0079473 A1 4/2007 Min
2007/0079585 A1 4/2007 Oh et al.
2007/0095028 A1 5/2007 Kim
2007/0095029 A1 5/2007 Min
2007/0209334 A1 9/2007 Conrad
2007/0209335 A1 9/2007 Conrad
2007/0271724 A1 11/2007 Hakan et al.
2007/0289089 A1 12/2007 Yacobi
2007/0289266 A1 12/2007 Oh
2008/0040883 A1 2/2008 Beskow et al.
2008/0047091 A1 2/2008 Nguyen
2008/0134460 A1 * 6/2008 Conrad ..... 15/335
2008/0134462 A1 6/2008 Jansen et al.
2008/0172821 A1 7/2008 Kang et al.
2008/0178416 A1 7/2008 Conrad
2008/0178418 A1 7/2008 Conrad
2008/0178420 A1 7/2008 Conrad
2008/0190080 A1 8/2008 Oh et al.
2008/0196194 A1 * 8/2008 Conrad ..... 15/353
2008/0196196 A1 * 8/2008 Conrad ..... 15/353
2008/0196745 A1 8/2008 Conrad
2008/0216282 A1 9/2008 Conrad
2008/0289139 A1 * 11/2008 Makarov et al. ..... 15/350
2008/0301903 A1 12/2008 Cunningham et al.
2009/0056060 A1 3/2009 Han et al.
2009/0100633 A1 4/2009 Bates et al.
2009/0113659 A1 5/2009 Jeon
2009/0144932 A1 6/2009 Yoo
2009/0165431 A1 * 7/2009 Oh ..... 55/337
2009/0205160 A1 8/2009 Conrad
2009/0205161 A1 8/2009 Conrad
2009/0205298 A1 8/2009 Hyun et al.
2009/0265877 A1 * 10/2009 Dyson et al. ..... 15/344
2009/0282639 A1 * 11/2009 Dyson et al. ..... 15/344
2009/0300874 A1 12/2009 Tran et al.
2009/0300875 A1 12/2009 Inge et al.
2009/0305862 A1 * 12/2009 Yoo ..... 494/36
2009/0307863 A1 * 12/2009 Milne et al. ..... 15/344
2009/0307864 A1 12/2009 Dyson
2009/0308254 A1 12/2009 Oakham
2009/0313958 A1 12/2009 Gomiciaga-Pereda et al.
2009/0313959 A1 12/2009 Gomiciaga-Pereda et al.
2010/0154150 A1 6/2010 McLeod
2010/0175217 A1 7/2010 Conrad
2010/0212104 A1 * 8/2010 Conrad ..... 15/347
2010/0224073 A1 9/2010 Oh et al.
2010/0229321 A1 9/2010 Dyson et al.
2010/0242210 A1 9/2010 Conrad
2010/0243158 A1 9/2010 Conrad
2010/0293745 A1 11/2010 Coburn
2010/0299865 A1 12/2010 Conrad
2010/0299866 A1 12/2010 Conrad
2011/0146024 A1 6/2011 Conrad
2011/0168332 A1 7/2011 Bowe et al.
2011/0219572 A1 * 9/2011 Conrad ..... 15/347
2012/0060322 A1 3/2012 Simonelli et al.
2012/0216361 A1 8/2012 Millington et al.
2012/0222245 A1 9/2012 Conrad
2012/0222262 A1 9/2012 Conrad
2013/0091662 A1 * 4/2013 Smith ..... 15/353
2014/0237758 A1 8/2014 Conrad
2014/0237759 A1 8/2014 Conrad

FOREIGN PATENT DOCUMENTS

CA 1218962 A 3/1987
CA 2593950 6/2008
CA 2438079 C 8/2009
CA 2659212 A1 9/2010
CN 1493244 A 5/2004
CN 2657570 Y 11/2004
CN 1887437 A 1/2007
CN 201223346 Y 4/2009
DE 875134 C 4/1953
DE 9017798 U1 2/1992
DE 8216071.9 U1 2/1993
DE 4232382 C1 3/1994
EP 493950 B1 7/1992
EP 1031310 A2 8/2000
EP 1200196 B1 6/2005
EP 1535560 A2 6/2005
EP 1674017 A2 6/2006
EP 1779761 A2 5/2007
EP 1676516 B1 1/2010
EP 1629758 A3 10/2013
FR 2812531 B1 11/2004
GB 700791 A 12/1953
GB 1029943 A 5/1966
GB 1111074 A 4/1968
GB 2268875 A 1/1994
GB 2282979 B 10/1997
GB 2365324 B 7/2002

(56) References Cited

FOREIGN PATENT DOCUMENTS

| | | | |
|---|---|---|---|
| GB | 2372431 | A | 8/2002 |
| GB | 2441962 | B | 3/2011 |
| GB | 2466290 | B | 10/2012 |
| JP | 61131720 | A | 6/1986 |
| JP | 2000140533 | A | 5/2000 |
| JP | 2003-180579 | A | 7/2003 |
| JP | 2010178773 | A | 8/2010 |
| JP | 2010220632 | A | 10/2010 |
| JP | 2011189132 | A | 9/2011 |
| JP | 2011189133 | A | 9/2011 |
| WO | 9627446 | A1 | 9/1996 |
| WO | 9809121 | A1 | 3/1998 |
| WO | 9843721 | A1 | 10/1998 |
| WO | 01/07168 | A1 | 2/2001 |
| WO | 0112050 | | 2/2001 |
| WO | 2004069021 | A1 | 8/2004 |
| WO | 2006026414 | A3 | 8/2007 |
| WO | 2008009883 | A1 | 1/2008 |
| WO | 2008009888 | A1 | 1/2008 |
| WO | 2008009890 | A1 | 1/2008 |
| WO | 2008009891 | A1 | 1/2008 |
| WO | 2008/070962 | A1 | 6/2008 |
| WO | 2009026709 | A1 | 3/2009 |
| WO | 2010102396 | A1 | 9/2010 |
| WO | 2010142968 | A1 | 12/2010 |
| WO | 2010142969 | A1 | 12/2010 |
| WO | 2010142970 | A1 | 12/2010 |
| WO | 2010142971 | A1 | 12/2010 |
| WO | 2011054106 | A1 | 5/2011 |
| WO | 2012042240 | A1 | 4/2012 |
| WO | 2012117231 | A1 | 9/2012 |

OTHER PUBLICATIONS

Supplementary European Search Report, dated Jun. 16, 2009, as received on the corresponding EP application No. 07719394.4.

The Office Action received in connection to the corresponding Chinese Patent Application No. 200880126486.6 dated Mar. 23, 2012.

The Office Action received in connection to the corresponding U.S. Appl. No. 12/720,901 dated Jun. 10, 2011.

The Office Action received in connection to the related Chinese Patent Application No. 00813438.3 issued Jul. 11, 2003.

Handbook of Air Pollution Prevention and Contriol, pp. 397-404, 2002.

Makita 4071 Handy Vac.

Makita BCL180 User Manual.

European Communication pursuant to Article 94(3) on European Patent Application No. 04078261.7, dated Apr. 24, 2012.

European Communication pursuant to Article 94(3) on European Patent Application No. 04078261.7, dated Feb. 26, 2010.

International Preliminary Examination Report on International application No. PCT/CA00/00873, dated Oct. 26, 2001.

The Protest Against Canadian Patent Application No. 2,899,653 received in connection to the related Canadian Patent Application No. 2,899,653. Dated: Sep. 10, 2015.

Euro-Pro Shark Cordless Hand Vac Owner's Manual, published in 2002.

* cited by examiner

SURFACE CLEANING APPARATUS

FIELD

The specification relates to surface cleaning apparatus. In a preferred embodiment, the surface cleaning apparatus comprises a portable surface cleaning apparatus, such as a hand vacuum cleaner or a pod.

BACKGROUND

The following is not an admission that anything discussed below is part of the prior art or part of the common general knowledge of a person skilled in the art.

Various types of surface cleaning apparatus are known. Surface cleaning apparatus include vacuum cleaners. Currently, a vacuum cleaner typically uses at least one cyclonic cleaning stage. More recently, cyclonic hand vacuum cleaners have been developed. See for example, U.S. Pat. No. 7,931,716 and US 2010/0229328. Each of these discloses a hand vacuum cleaner which includes a cyclonic cleaning stage. U.S. Pat. No. 7,931,716 discloses a cyclonic cleaning stage utilizing two cyclonic cleaning stages wherein both cyclonic stages have cyclone axis that extends vertically. US 2010/0229328 discloses a cyclonic hand vacuum cleaner wherein the cyclone axis extends horizontally and is co-axial with the suction motor. In addition, hand carriable (e.g., pod style) cyclonic vacuum cleaners are also known (see U.S. Pat. No. 8,146,201).

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

According to one broad aspect, a pod or other hand carriable surface cleaning apparatus, such as a vacuum cleaner, is provided utilizing at least one cyclone stage wherein the cyclone chamber has two dirt outlets which are preferably positioned front and rear. An advantage of this design is that the dirt carrying capacity of the vacuum cleaner may be increased. For example, if the vacuum cleaner is being used and is tilted upwardly, the dirt in the dirt collection chamber will tend to move rearwardly. The amount of dirt in the dirt collection chamber may be below the fill line. However, when the vacuum cleaner is tilted upwardly, movement of the dirt rearwardly may cause the dirt in the dirt collection chamber to extend above the fill line and could potentially block a rearwardly positioned dirt outlet. The provision of a second spaced apart (preferably forwardly positioned) dirt outlet may provide an alternate dirt outlet which may be used in such a situation. Similarly, the hand vacuum cleaner may be tilted forwardly. In such a case, the dirt in the dirt collection chamber may move forwardly blocking a forward dirt outlet. However, the provision of a second spaced apart (preferably rearwardly positioned) dirt outlet may provide an alternate dirt outlet which may be used in such a situation. Accordingly, provision of different dirt outlets may allow the vacuum cleaner to continue to function despite the vacuum cleaner being operated at an angle to the horizontal. It will be appreciated that such a design is usable in hand vacuum cleaners, pod vacuum cleaners or other vacuum cleaners or surface cleaning apparatus which are meant to be carried by a hand or shoulder strap or the like (which may be referred to as hand carriable surface cleaning apparatus).

It will be appreciated that in a preferred embodiment, the dirt outlets are positioned adjacent the forward end and the rearward end of the cyclone chamber or cyclone chambers. However, it will be appreciated that displacing the dirt outlets from being exactly forward or rearward will still increase the dirt capacity of the hand carriable surface cleaning apparatus when operated at an angle to the horizontal.

The cyclone chamber may be of any particular design. Preferably, the cyclone chamber has the dirt outlet provided at a lower end. For example, the vacuum cleaner may have an upper air inlet and an upper air outlet. The dirt outlets may be provided in the sidewall at or close to the lower end wall of the cyclone chamber. Accordingly, the dirt outlets may be defined by cutouts or slots provided in the sidewall of the cyclone chamber. However, it will be appreciated that the dual dirt outlet design may be utilized with other cyclone constructions such as an inverted cyclone (e.g., the air inlet and air outlet are provided at a lower end and the dirt outlets are provided at an upper end of the cyclone chamber).

Each of the dirt outlets may be the same size. However, in a preferred embodiment, one of the dirt outlets is larger than the other. In addition, the positioning of the dirt outlets with respect to the position of the cyclone air inlet may vary. For example, one or both of the dirt outlets may have a radial extent of 15-135°, preferably 30-105° and, still more preferably, 60-75°. One of the dirt outlets may be positioned at the same radial position on the sidewall of the cyclone chamber as the cyclone air inlet. For example, if the dirt outlet is at the lower end of a cyclone chamber and the air inlet is at the upper end, one of the dirt outlets may be positioned directly below the air inlet such that the radial displacement around the sidewall of the cyclone chamber from the air inlet may be less than 10 degrees. In such an embodiment, it is preferred that the opposed dirt outlet is larger and may be twice as large (e.g., its angular extent may be twice that of the slot which is aligned with the air inlet).

It will also be appreciated that the hand carriable surface cleaning apparatus may be mountable on a base, such as a wheeled base or an upper portion of an upright surface cleaning apparatus. In such a case, the hand carriable surface cleaning apparatus may function as the air treatment member of an upright surface cleaning apparatus or a canister style surface cleaning apparatus.

In another embodiment, an improved air flow path for a hand carriable surface cleaning apparatus and, preferably, a hand vacuum cleaner or hand surface cleaning apparatus, is provided. In accordance with this embodiment, the suction motor inlet is positioned below the upper end of the cyclone chamber and preferably at a position between the upper and lower ends of the cyclone chamber or a cyclone bin assembly (e.g., a cyclone bin assembly which includes a cyclone chamber and a dirt collection chamber, wherein the dirt collection chamber may be positioned below the cyclone chamber). According to such an embodiment, the air may enter the cyclone chamber, either at the upper end or the lower end of the cyclone chamber, and exit the cyclone chamber via an air outlet positioned in the upper end wall of the cyclone chamber. The air may then travel through a pre-motor filter. The pre-motor filter is preferably positioned above the cyclone chamber. The air exiting the cyclone chamber may either travel upwardly through the pre-motor filter and then travel downwardly via a conduit provided through the pre-motor filter or at a position that is laterally spaced (e.g., rearwardly) from the pre-motor filter. Alternately, the air exiting the cyclone chamber may pass via a conduit through the pre-motor filter and then travel downwardly through the pre-motor filter before travelling laterally (e.g., rearwardly). A conduit may then extend downwardly from the downstream side of the pre-motor filter (e.g., adjacent the cyclone chamber and/or an exterior dirt collection chamber of the cyclone chamber) to the suction motor inlet. This down flow conduit may be spaced from the cyclone chamber and dirt collection chamber or it may share a common wall with one or both thereof.

An advantage of this design is that the pre-motor filter may be accessible for cleaning or replacement by opening a panel on the upper portion of the hand carriable surface cleaning apparatus. Concurrently, the hand carriable surface cleaning apparatus may be emptiable by opening a bottom door. The bottom door may open the cyclone chamber, the dirt collection chamber, and, preferably, both simultaneously. Accordingly, the surface cleaning apparatus is provided in a hand carriable configuration wherein a bottom opening door and an upper opening pre-motor filter chamber is provided.

It will be appreciated by a person skilled in the art that any of the features of the air flow passage discussed herein may not be utilized with the dual dirt outlet design disclosed herein, but may be used by itself or in combination with any other feature disclosed herein.

In another embodiment, a hand carriable surface cleaning apparatus is provided wherein the suction motor is positioned horizontally (e.g., transverse to the vertical axis of the cyclone) and located between the upper and lower ends of the cyclone chamber or a cyclone bin assembly (preferably at or proximate a midpoint of the cyclone or cyclone bin assembly). A handle is provided which extends upwardly from the suction motor housing and is secured to an upper portion of the hand carriable surface cleaning apparatus. For example, a lower end of the handle may be provided on an upper surface of the suction motor housing. The upper end of the handle may extend to the pre-motor filter housing or a bridging portion which extends rearwardly from the pre-motor filter housing. The handle is preferably positioned so as to be rearward of the centre of gravity of the hand vacuum cleaner. Preferably, the centre of gravity is also located below the lower end of the handle. The handle may also be angled forwardly such that a vertical line extending upwardly from the center of gravity may pass through an upper portion of the handle (preferably a bridging portion extending between the pre-motor filter housing and the upper portion of the handle). An advantage of this design is that the hand carriable surface cleaning apparatus has improved ergonomics. The hand vacuum cleaner may impart a downward force of less than two pounds, preferably less than one pound, and preferably essentially no downward force on the hand of the user when the user holds the hand carriable surface cleaning apparatus horizontally disposed.

It will be appreciated by a person skilled in the art that any of the features of the ergonomic design of the hand vacuum cleaner discussed herein may not be utilized with the dual dirt outlet design disclosed herein, but may be used by itself or in combination with any other feature disclosed herein.

In accordance with another embodiment, a hand carriable surface cleaning apparatus is provided wherein the dirt collection chamber is removable with the handle of the surface cleaning apparatus for emptying. An advantage of this design is that a user need not carry the entire hand carriable surface cleaning apparatus to a garbage can or the like for emptying the dirt collection chamber. Instead, the user may be able to manipulate a lighter portion while emptying the dirt collection chamber. In addition, utilizing the handle of the hand carriable surface cleaning apparatus provides an easy way for a user to transport and hold the dirt collection chamber while it is being emptied. In addition, as the dirt collection chamber has been removed from the suction motor, the dirt collection chamber may be washed or otherwise cleaned once removed from the suction motor. It will be appreciated that the dirt collection chamber may be a lower portion of the cyclone chamber or a separate chamber in communication with a dirt outlet of the cyclone chamber. Preferably, if the dirt collection chamber is exterior to the cyclone chamber, then the cyclone chamber and dirt collection chamber may be removable with the handle as a unit (e.g., a cyclone bin assembly). It will be appreciated by a person skilled in the art that any of the features of the removable dirt collection chamber and handle assembly discussed herein may not be utilized with the dual dirt outlet design disclosed herein, but may be used by itself or in combination with any other feature disclosed herein.

In accordance with another embodiment, a bleed valve is provided downstream of the cyclone chamber. For example, the air exiting the cyclone chamber may travel upwardly via a conduit (which may be an extension of the vortex finder) through the pre-motor filters so that the upper side of the pre-motor filter is the upstream or dirty side of the pre-motor filter. In such a construction, the bleed valve may be positioned in the up flow conduit and connect with an air flow passage on the downstream side of the pre-motor filter (e.g., a downstream header of the pre-motor filter). Accordingly, the bleed valve may be positioned so as to draw bleed air in through a port on the upper side of the pre-motor filter housing and convey the bleed air through the up flow conduit from the cyclone chamber to a position downstream of the pre-motor filter. An advantage of this design is that the bleed valve is positioned at a location which will not be blocked during operation of the hand vacuum cleaner and does not require another passage through the pre-motor filter (which would reduce the cross sectional area of the upstream surface area of the pre-motor filter). In an alternate embodiment, it will be appreciated that the bleed valve could be exterior to the up flow conduit and may pass through the pre-motor filter.

In another embodiment, the bleed valve could be provided on a rearward surface of the surface cleaning apparatus. For example, the bleed valve could be position coaxial with, and above, the suction motor housing. Accordingly, bleed air could travel essentially forwardly through the bleed valve into the down flow conduit adjacent to the cyclone chamber/dirt collection chamber and then rearwardly into the suction motor. In an alternate embodiment, the bleed valve could be radially spaced around the hand vacuum cleaner but still communicate with the down flow passage.

It will be appreciated by a person skilled in the art that any of the features of the bleed valve discussed herein may not be used with the dual dirt outlet design disclosed herein, but may be used by itself or in combination with any other feature disclosed herein.

In another embodiment, the hand carriable surface cleaning apparatus has a cyclone chamber with a vertically extending axis and the pre-motor filter is positioned above the cyclone chamber and is preferably positioned so as to extend perpendicular to the axis of the cyclone. Accordingly, the air exiting the cyclone chamber may travel upwardly to the pre-motor filter. In such an embodiment, the lower side of the pre-motor filter may be the upstream side or alternately, the upper side may be the upstream side of the pre-motor filter (if a conduit such as the vortex finder extends through the pre-motor filter). An advantage of this design is that a header may be provided and the air will tend to distribute itself radially outwardly over the entire upstream surface of the pre-motor filter.

It will be appreciated by those skilled in the art that any of the features of the positioning of the pre-motor filter discussed herein may not be utilized with the dual dirt outlet design disclosed herein, but may be used by itself or in combination with any other feature disclosed herein.

In another embodiment, a pod or other hand carriable surface cleaning apparatus may be provided with a pre-motor filter that is positioned above the cyclone chamber and the vortex finder or an extension thereof may extend through the pre-motor filter to the upstream side of the pre-motor filter. The pre-motor filter may be essentially coaxial with the vortex finder (e.g., the pre-motor filter may overlie the cyclone chamber and be essentially centered above the cyclone chamber). It will be appreciated by those skilled in the art that any of the features of a pre-motor filter with a conduit therethrough disclosed herein may not be utilized with the dual dirt outlet discussed herein, but may be used by itself or in combination with any other feature disclosed herein.

In one embodiment there is provided a hand carriable surface cleaning apparatus having a front end, a rear end and comprising:

(a) a dirty fluid inlet;

(b) a cyclone bin assembly comprising a cyclone chamber downstream of the dirty fluid inlet, the cyclone chamber comprising a lower end, an upper end, a cyclone axis, an air inlet and an air outlet at the upper end;

(c) a pre-motor filter comprising an upstream side and a downstream side, (d) a conduit in communication with the cyclone air outlet, extending through the pre-motor filter and in communication with the upstream side of the pre-motor filter;

(e) a suction motor positioned downstream of the pre-motor filter and rearward of the cyclone bin assembly;

(f) an air flow path extending from the pre-motor filter to the suction motor; and, (g) a clean air outlet downstream of the suction motor.

In some embodiments, the pre-motor filter may be positioned above the cyclone chamber and the upstream side is spaced further from the cyclone chamber than the downstream side.

In some embodiments, the cyclone air outlet may comprise a vortex finder and the conduit comprises an extension of the vortex finder.

In some embodiments, the hand carriable surface cleaning apparatus may further comprise a downstream header on the downstream side of the pre-motor filter. The air flow path may extend downstream from the downstream header.

In some embodiments, the hand carriable surface cleaning apparatus may further comprise an upstream header on the upstream side of the pre-motor filter. The upstream header may be openable.

In some embodiments, at least a portion of the upstream header may be transparent.

In some embodiments, the suction motor may have a suction motor inlet that is positioned between the lower and upper ends of the cyclone bin assembly.

In some embodiments, the suction motor may have a motor axis that is generally perpendicular to the cyclone axis.

In some embodiments, the suction motor may have a motor axis that is generally perpendicular to the cyclone axis.

In some embodiments, the air inlet may be provided at the upper end and the dirt outlet is provided at the lower end and a dirt collection chamber is positioned below the cyclone chamber.

In some embodiments, the air flow path motor may have a portion that is exterior to and extends part way along an exterior wall of the cyclone chamber to a suction motor inlet.

In some embodiments, the hand carriable surface cleaning apparatus may further comprise a dirt collection chamber positioned exterior to the cyclone chamber. The air flow path may have a portion that extends part way along an exterior wall of the dirt collection chamber to a suction motor inlet.

In some embodiments, the hand carriable surface cleaning apparatus may further comprise a handle, a suction motor housing and a pre-motor filter housing positioned above the cyclone chamber. The handle may extend between the suction motor housing and the pre-motor filter housing.

In some embodiments, the pre-motor filter housing may be openable.

In some embodiments, the suction motor may have a motor axis that is generally perpendicular to the cyclone axis.

In some embodiments, the handle may have a suction motor housing end that is spaced rearward of the cyclone bin assembly and below the pre-motor filter housing and a pre-motor filter end that is spaced above and forward of the suction motor end of the handle.

In some embodiments, the hand carriable surface cleaning apparatus may further comprise an opening having a perimeter. The perimeter may comprise portions of the handle, the pre-motor filer housing and the suction motor housing.

In some embodiments, the hand carriable surface cleaning apparatus may further comprise a handle. A portion of the handle may be placed rearward of a centre of gravity of the hand carriable surface cleaning apparatus.

In some embodiments, the hand carriable surface cleaning apparatus may further comprise a bleed valve having an inlet end in the air flow path.

In some embodiments, the bleed valve may have an axis that is generally parallel to an axis of the suction motor.

DRAWINGS-BRIEF DESCRIPTION OF THE DRAWINGS

The drawings included herewith are for illustrating various examples of articles, methods, and apparatuses of the teaching of the present specification and are not intended to limit the scope of what is taught in any way.

DETAILED DESCRIPTION

Figure 1:
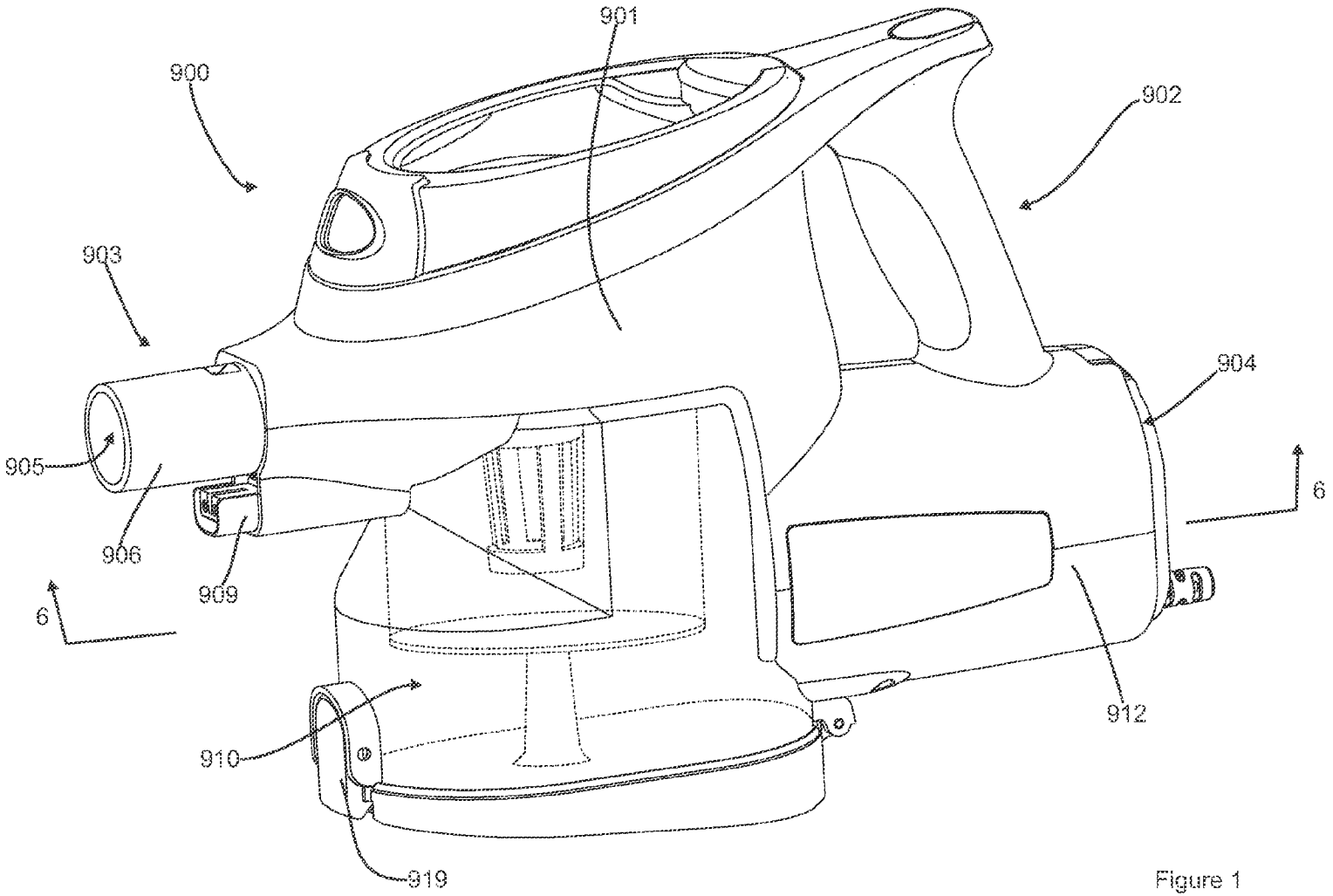
FIG. 1 is a perspective view of an example of a hand held surface cleaning apparatus.

Referring to FIG. 1, an embodiment of a surface cleaning apparatus 900 is shown. In the embodiment illustrated, the surface cleaning apparatus 900 is a hand carriable or hand-held vacuum cleaner. It will be appreciated that surface cleaning apparatus 900 could be carried by a hand of a user, a shoulder strap or the like and could be in the form of a pod or other portable surface cleaning apparatus. Surface cleaning apparatus 900 could be a vacuum cleaner, an extractor or the like. All such surface cleaning apparatus are referred to herein as a hand carriable surface cleaning apparatus. Optionally, surface cleaning apparatus 900 could be removably mounted on a base so as to form, for example, an upright vacuum cleaner, a canister vacuum cleaner, a stick vac, a wet-dry vacuum cleaner and the like. Power can be supplied to the surface cleaning apparatus 900 by an electrical cord (not shown) that can be connected to a standard wall electrical outlet. Alternatively, or in addition, the power source for the surface cleaning apparatus can be an onboard energy storage device, including, for example, one or more batteries.

Figure 2:
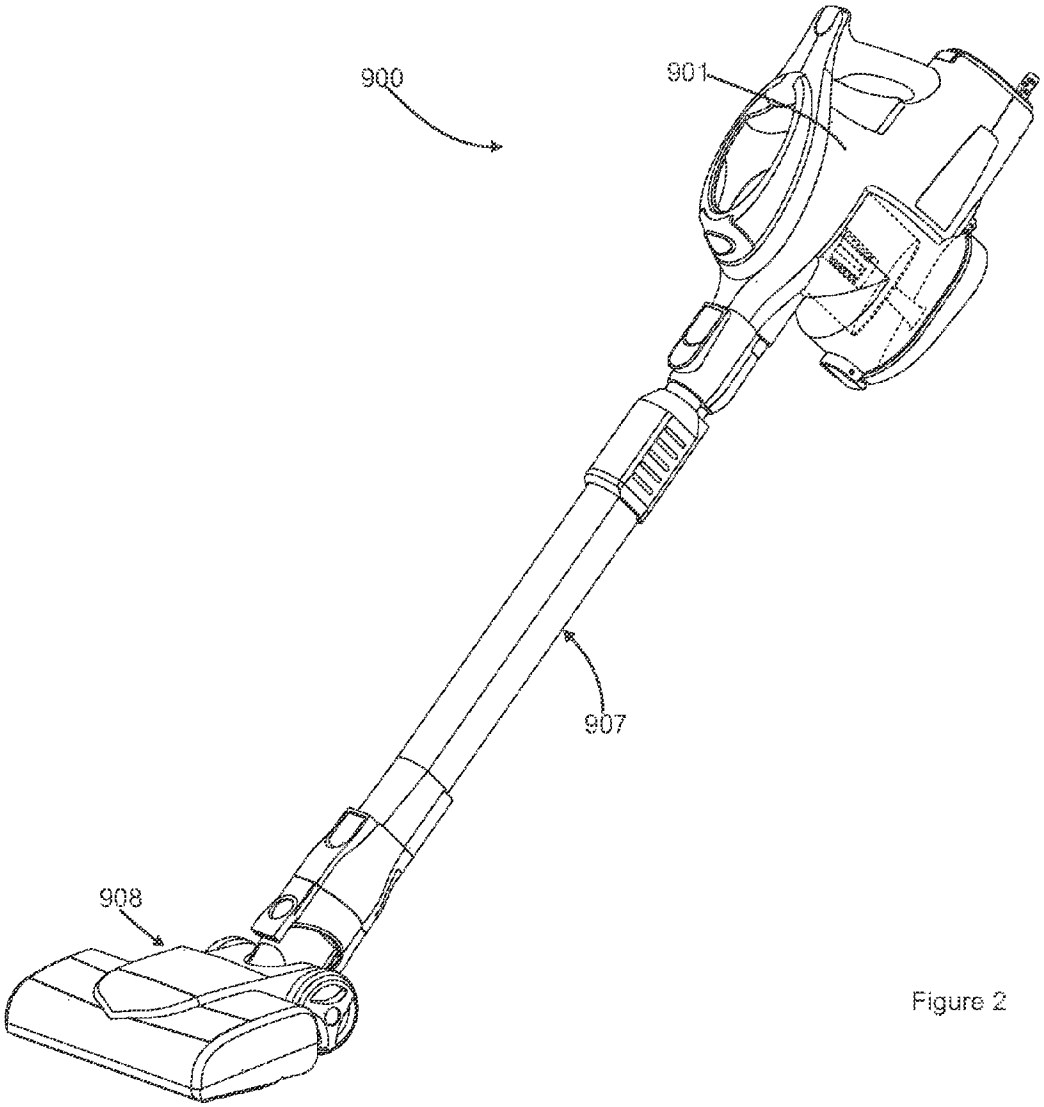
FIG. 2 is a perspective view of the surface cleaning apparatus of FIG. 1 attached to a cleaning tool.

The surface cleaning apparatus 900 comprises a main body 901 having a handle 902, a dirty air inlet 903, a clean air outlet 904 (see for example FIG. 6) and an air flow path extending therebetween. In the embodiment shown, the dirty air inlet 903 is the inlet end 905 of connector 906. Optionally, the inlet end can be used to directly clean a surface. Alternatively, the inlet end 905 can be connected to the downstream end of any suitable hose, cleaning tool or accessory, including, for example a wand 907 that is pivotally connected to a surface cleaning head 908 (FIG. 2), a nozzle and a flexible suction hose. In the configuration illustrated in FIG. 2, the surface cleaning apparatus 900 can be used to clean a floor or other surface in a manner analogous to conventional upright-style vacuum cleaners.

Referring again to FIG. 1, the connector 906 may be any suitable connector that is operable to connect to, and preferably detachably connect to, a hose, cleaning tool or other accessory. Optionally, in addition to providing an air flow connection, the connector 906 may also include an electrical connection. Providing an electrical connection may allow cleaning tools and accessories that are coupled to the connector to be powered by the surface cleaning apparatus 900. For example, the surface cleaning unit 900 can be used to provide both power and suction to a surface cleaning head, or other suitable tool. In the illustrated embodiment, the connector 906 includes an electrical coupling in the form of a female socket member 909, and a corresponding male prong member may be provided on the hose, cleaning tool and/or accessory that is connected to inlet end 905. Providing the female socket 909 on the electrified side of the electrical coupling may help prevent a user from inadvertently contacting the electrical contacts. In other embodiments, socket member 909 may include male connectors. In such a case, it is preferred that the male connectors are de-energized when exposed (i.e., they are not plugged into a female connector).

From the dirty air inlet 903, the air flow path extends through an air treatment member. The air treatment member may be any suitable member that can treat the air in a desired manner, including, for example, removing dirt particles and debris from the air. In the illustrated example, the air treatment member includes a cyclone bin assembly 910. Alternatively, the air treatment member can comprise a bag, a filter or other air treating means. In the illustrated embodiment, the cyclone bin assembly forms part of the main body 901 of the surface cleaning apparatus. A suction motor 911 (see FIG. 6) is mounted within a motor housing 912 portion of the main body 901 and is in fluid communication with the cyclone bin assembly 910. In this configuration, the suction motor 911 is downstream from the cyclone bin assembly 910 and the clean air outlet 904 is downstream from the suction motor 911.

Cyclone Bin Assembly

The following is a description of a cyclone and a cyclone bin assembly that may be used by itself in any surface cleaning apparatus or in any combination or sub-combination with any other feature or features disclosed herein.

Figure 5:
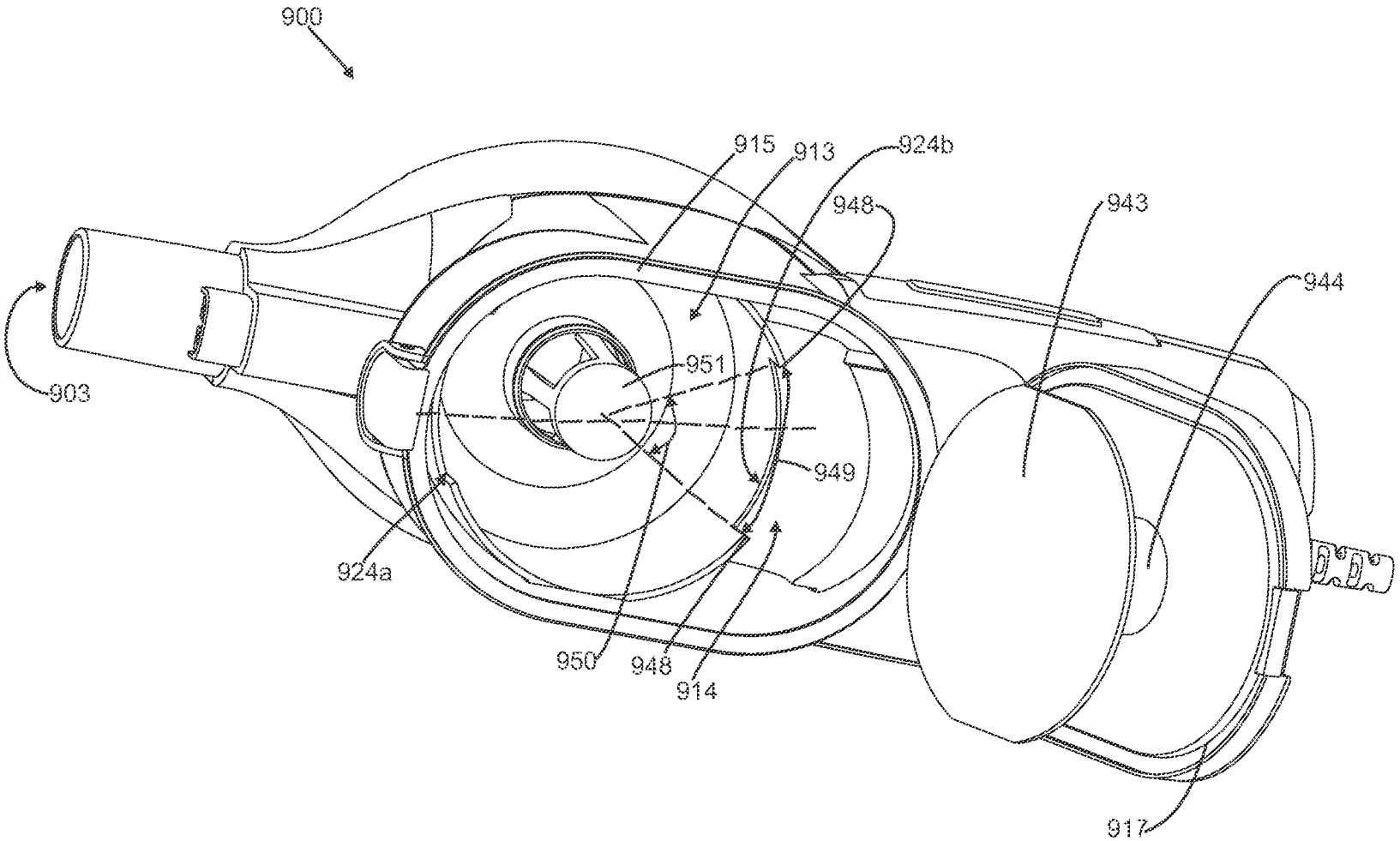
FIG. 5 is bottom perspective view of the surface cleaning apparatus of FIG. 1 with the bottom door in an open position.
Figure 6:
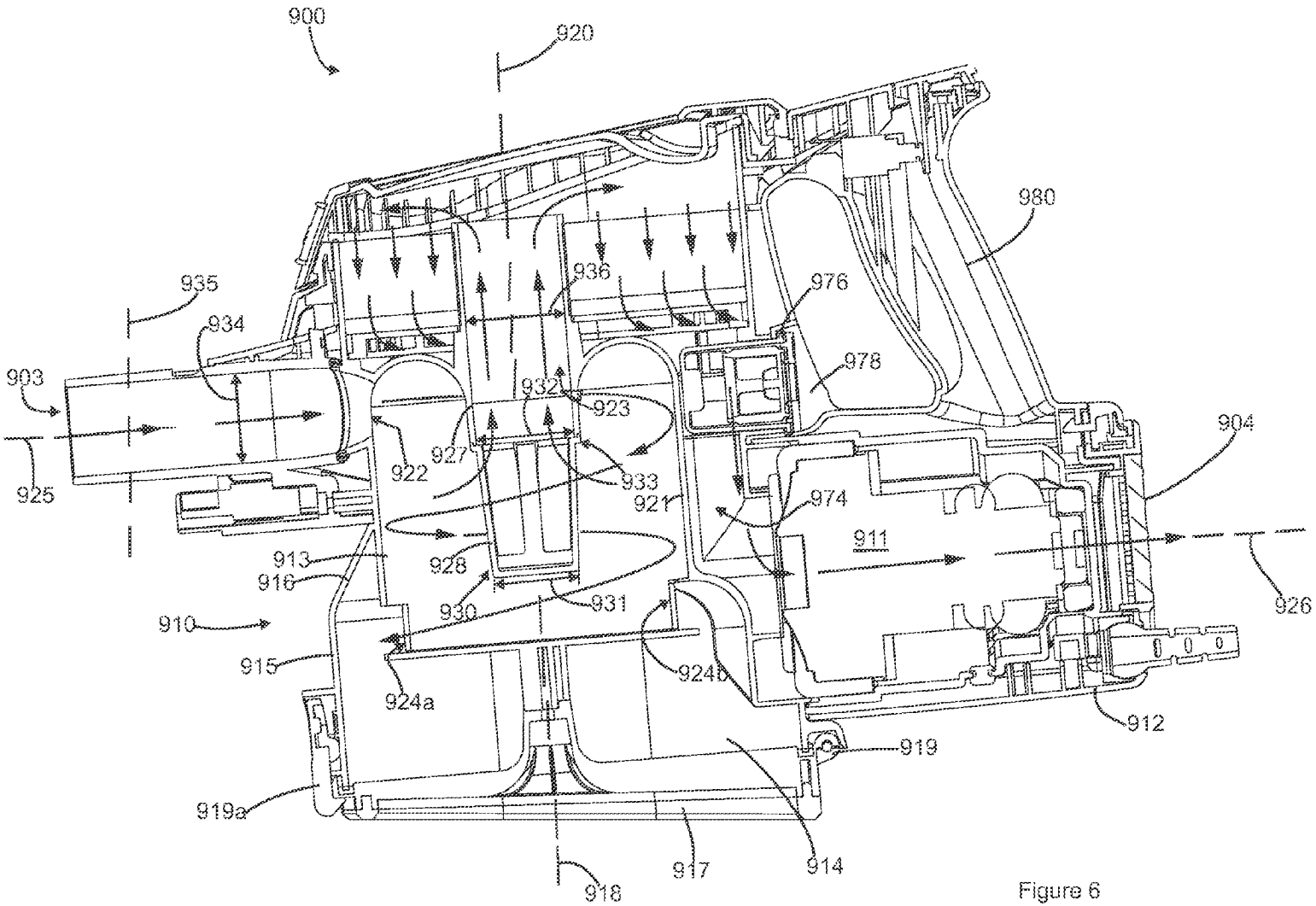
FIG. 6 is a cross sectional view of the surface cleaning apparatus of FIG. 1, taken along line 6-6 in FIG. 1.

Referring to FIGS. 5 and 6, in the illustrated embodiment, the cyclone bin assembly 910 includes a cyclone chamber 913 and a dirt collection chamber 914. The cyclone chamber 913 and the dirt collection chamber 914 may be of any suitable configuration.

In the illustrated embodiment the dirt collection chamber 914 is positioned outside or exterior to and substantially below the cyclone chamber 913. Preferably, a least a portion, if not all, of the dirt collection chamber is below the cyclone chamber. The dirt collection chamber 914 comprises a sidewall 915, a first end wall 916 and an opposed second end wall 917. The dirt collection chamber 914 extends along a dirt collection axis 918.

The dirt collection chamber 914 may be emptyable by any means known in the art and is preferably openable concurrently with the cyclone chamber 913. Preferably, the second dirt collection chamber end wall 917 is moveably (e.g., pivotally) connected to e.g., the dirt collection chamber sidewall 915, for example using hinge 919. In this configuration, the second dirt collection chamber end wall 917 functions as an openable door to empty the dirt collection chamber 914 and can be opened as shown in FIG. 5 to empty dirt and debris from the interior of the dirt collection chamber 914. The second dirt collection chamber end wall 917 can be retained in the closed position by any means known in the art, such as by a releasable latch 919*a*. In the illustrated example, the hinge 919 is provided on a back edge of the end wall 917 and the latch 919*a* is provided at the front of the end wall 917 so that the door swings backwardly when opened. Alternatively, the hinge and latch may be in different positions, and the door may open in a different direction or manner. Optionally, instead of being pivotal or openable, the end wall may be removable.

In the embodiment shown, the cyclone chamber 913 extends along a cyclone axis 920 and is bounded by a sidewall 921. The cyclone chamber 913 includes an air inlet 922 and an air outlet 923 and two dirt outlets 924*a* and 924*b* in communication with the dirt collection chamber 914. The air inlet, air outlet and dirt outlets may be of any design known in the art. Preferably, the air inlet 922 is generally tangentially oriented relative to the sidewall 921, so that air entering the cyclone chamber 913 will tend to swirl and circulate within the cyclone chamber 913, thereby disentraining dirt and debris from the air flow, before leaving the chamber via the air outlet 923. The air inlet 922 extends along an inlet axis 925 that may be generally perpendicular to the cyclone axis 920, and in the illustrated example is generally parallel to and offset above a suction motor axis 926.

In the illustrated example, the cyclone air outlet 923 comprises a conduit member or vortex finder 927. Optionally, a screen 928 can be positioned over the vortex finder 927 to help filter lint, fluff and other fine debris. Preferably, the screen 928 can be removable. Optionally, the screen 928 can be tapered such that the distal, inner or free end 930 of the screen 928 has a smaller diameter 931 than the diameter 932 at the base 933 of the screen 928 and/or the air inlet 922.

Optionally, the screen 928 can be configured so that the diameter 931 of the free end 930 of the screen is between about 60% and about 100% of the diameter 932 of the base 933 of the screen 928 and/or the air inlet 922, and may be between about 60%-90%, about 70-80% and preferably is between about 63-67% of the base diameter 932 and/or the air inlet 922.

The air inlet 922 has an inlet diameter 934, and a related inlet flow cross-sectional area (measure in a plane 935 perpendicular to the inlet axis 925). Preferably, the air outlet 923 is sized so that the diameter 936 of the air outlet 923, and therefore the corresponding flow area of the air outlet, is the same as the diameter 934 of the air inlet 922. Alternatively, the air outlet diameter 936 may be between about 50% and about 150%, and between about 85-115% of the air inlet diameter 934.

In the example illustrated the cyclone bin assembly 910 and the cyclone chamber 913 are arranged in a generally vertical, inverted cyclone configuration. In this configuration, the air inlet 922 and the air outlet 923 are provided toward the upper end of the cyclone chamber 913. Alternatively, the cyclone bin assembly 910 and cyclone chamber 913 can be provided in another orientation, including, for example, as a horizontal cyclone or in other configurations, e.g., with the dirt collection chamber beside the cyclone chamber and/or with the inlet and outlets at differing positions.

Optionally, some or all of the sidewall 921 can coincide with portions of the external sidewalls of the cyclone bin assembly 910 and the dirt collection chamber sidewall 915 (see FIGS. 5 and 6). This may help reduce the overall size of the cyclone bin assembly. Alternative, the sidewall 921 may be distinct from the sidewalls. In alternative embodiments, the cyclone chamber 915 may include only a single dirt outlet 924, or more than two dirt outlets.

Figure 7:
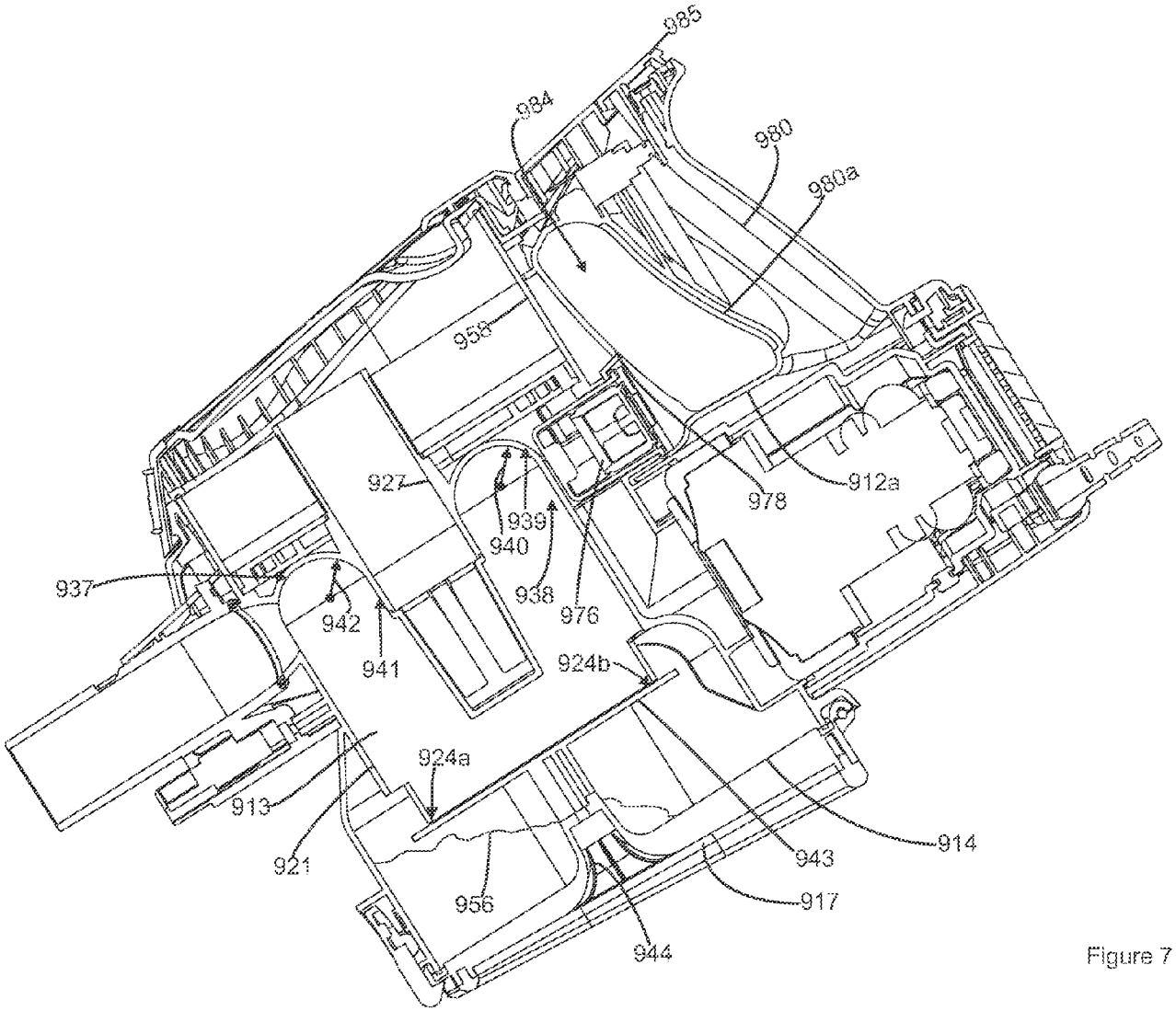
FIG. 7 is the cross sectional view of FIG. 6 with the surface cleaning apparatus tilted forward.

Referring to FIG. 7, in the illustrated embodiment, the cyclone chamber 913 includes a first or upper end wall 937. The end wall 937 is connected to the upper end of the sidewall 921 to enclose the upper end of the cyclone chamber 913. In the illustrated example, a juncture 938 between the end wall 937 and the side wall 921 includes a curved surface 939. The radius 940 of the curved surface 939 may be selected to be similar to the radius (i.e. half of the diameter 934) of the air inlet 922, and optionally may be selected so that the juncture surface 939 has the same radius as the air inlet.

Optionally, the juncture 941 between the end wall 937 and the vortex finder 927 may also be curved, and preferably is sized to have a radius 942 that is similar to or is the same as the radius 940 of the juncture between the end wall 937 and the sidewall 921. Providing curved surfaces at one or both of the junctures 938, 941 may help reduce backpressure and may help improve cyclone efficiency. Optionally, the upper end wall 937 of the cyclone chamber 913 can be openable or removable to allow access to the interior of the cyclone chamber 913 from above.

Referring also to FIG. 5, a deflector or arrestor plate 943 may be positioned at the lower end of the cyclone chamber 913, at the interface between the cyclone chamber 913 and the dirt collection chamber 917. The arrestor plate 943 is preferably sized to cover substantially all of the lower end of the cyclone chamber 913, and to abut the lower end of the cyclone sidewall 921 to form a lower end wall of the cyclone chamber. When the arrestor plate 943 abuts the lower ends of the sidewall 921 it helps define the gaps or slots that form the dirt outlets 924*a*, 924*b*. In this configuration, the dirt outlet slots 924*a*, 924*b* are bound on three sides by the cyclone chamber sidewall 921 and on a fourth side by the arrestor plate 943. Alternatively, the dirt outlet slots 924*a*, 924*b* may be entirely bounded by the sidewall 921 and may be spaced apart from the arrestor plate 943. In the illustrated example the dirt outlets 924*a*, 924*b* are vertically spaced apart from the air inlet 922 and air outlet 923 and are positioned at the opposite, lower end of the cyclone chamber 913.

In the illustrated embodiment, the arrestor plate 943 forms the bottom of the cyclone chamber and may be of any suitable configuration. Optionally the arrestor plate 943 may be fixed in its position adjacent the sidewall 921, or may be moveable or openable. Providing an openable arrestor plate 943 may help facilitate emptying of the cyclone chamber 913. Optionally, the arrestor plate 943 may be openable concurrently with another portion of the surface cleaning apparatus, including, for example, the dirt collection chamber 917.

In the illustrated embodiment, the arrestor plate 943 is mounted to and supported spaced from the openable wall 917 by a support member 944. The support member 944 may be of any suitable configuration and may be formed from any suitable material that is capable of supporting the arrestor plate 943 and resisting stresses exerted on the arrestor plate 943 by the air flow in the cyclone chamber or dirt particles exiting the cyclone chamber 913. In this configuration, the arrestor plate 943 is openable concurrently with the end wall 917, so that opening the end wall 917 simultaneously opens the dirt collection chamber 914 and the cyclone chamber 913. Alternatively, the arrestor plate 943 may be mounted to the sidewall 921 (or other portion of the surface cleaning apparatus) and need not open in unison with the end wall 917.

Figure 8:
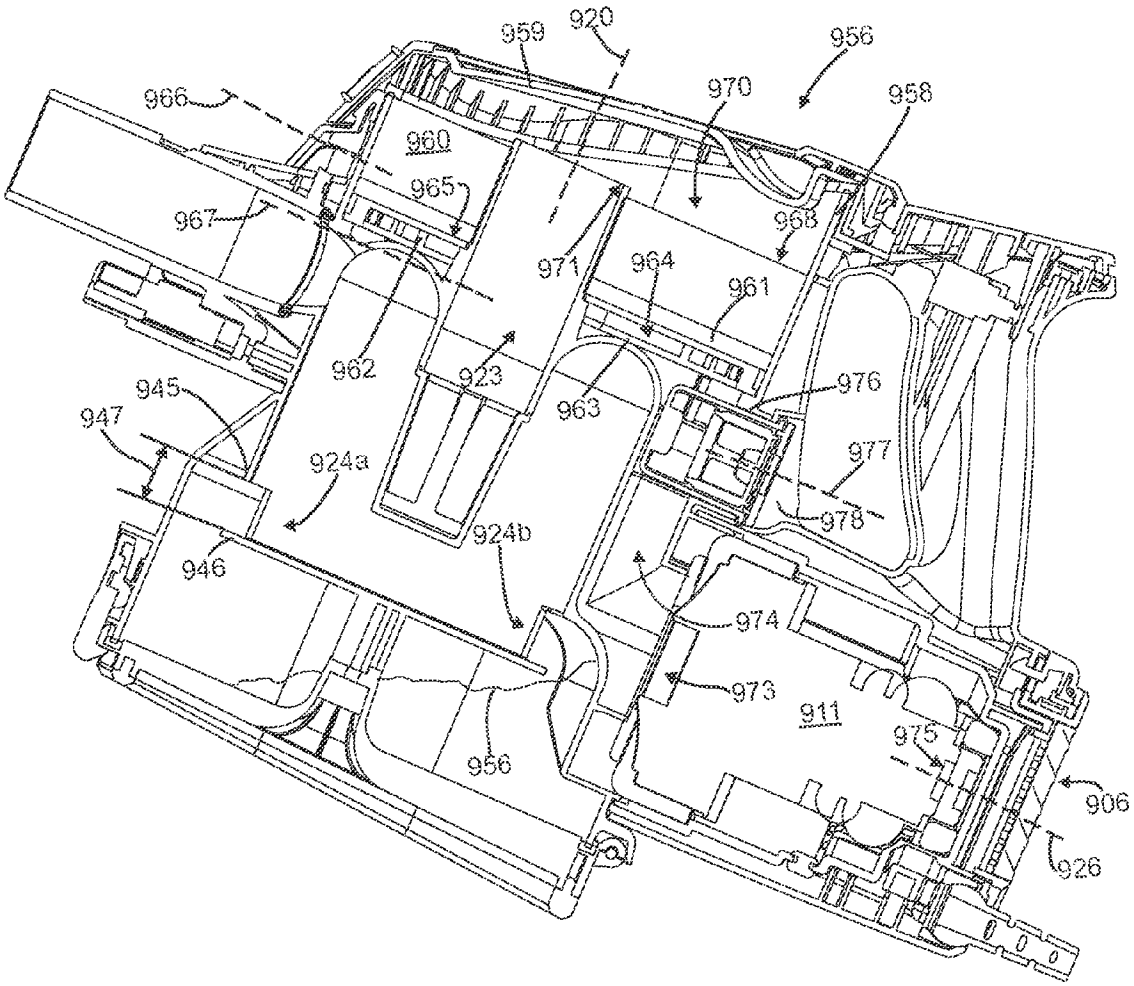
FIG. 8 is the cross sectional view of FIG. 6 with the surface cleaning apparatus tilted backward.

Referring to FIG. 8, each dirt outlet 924*a* and 924*b* is a slot that includes an upper edge 945 and a lower edge 946 spaced apart from each other by a slot height 947, measured axially. The slot height 947 may be any suitable distance, including for example, between 1 mm and 49 mm or more, and preferably is between about 3 mm and about 25 mm. Each slot 924*a*, 924*b* also includes two side edges 948 (FIG. 5) spaced apart by a slot width 949, measured along the perimeter of the cyclone chamber sidewall 921. Each slot width may be between about 5% and about 50% of the perimeter of the cyclone chamber sidewall 921, and preferably may be between about 10% and about 35% and may be about 25%. In the illustrated embodiment the cyclone chamber sidewall 921 is circular in axial cross-sectional shape, and the angle 950 (FIG. 5) subtended by the dirt outlet 924*b* may between about 20° and about 180°, and may be between about 35° and 125°, and between about 45° and 90°. In the illustrated embodiment the angle 951 between the dirt outlets 924*a* and 924*b*, measured from the centre line of the slots (FIG. 5) is 180°. Optionally, the dirt outlets 924*a*, 924*b* may be generally identical. Alternatively, the dirt outlets 924*a* and 924*b* may be of different configurations (i.e. may have different heights and/or widths). Optionally, slot 924*a*, which is at the same end as the cyclone air inlet, is smaller than the opposed dirt outlet 924*b* and may be about half the size.

Figure 12:
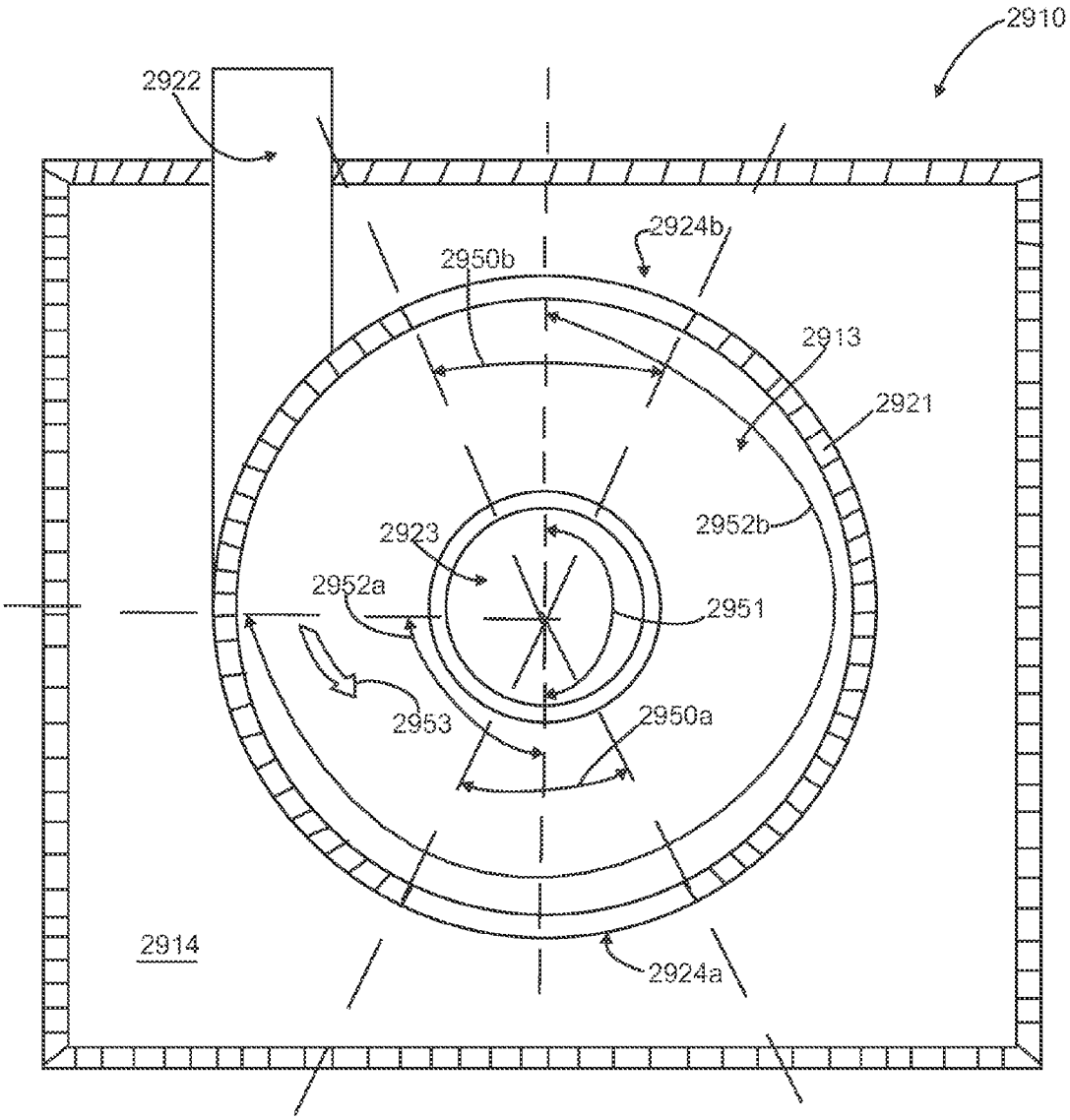
FIG. 12 is a schematic top plan representation of an example of a cyclone bin assembly.

Referring to FIG. 12, a cross-sectional schematic representation of an alternate embodiment of a cyclone bin assembly 2910 is shown. The cyclone bin assembly 2910 is generally similar to cyclone bin assembly 910 and analogous features are indicated using like reference characters indexed by 2000. This schematic illustrates a top view of an example of a circular cyclone chamber 2913 positioned within a generally square dirt collection chamber 2914. The cyclone chamber 2913 includes a tangential air inlet 2922 and an air outlet 2923. Two dirt outlets 2924*a* and 2924*b* are provided in the cyclone chamber sidewall 2921. The angle 2951 between the dirt outlets 2924*a*, 2924*b* is about 180°. In this embodiment, the angle 2952 between the air inlet 2922 (measured from the point of tangential intersection between the air inlet and the cyclone chamber sidewall 2921) and the first dirt slot 2924*a*, in the direction of air circulation (arrow 2953), is approximately 90°, and the angle 2952*b* between the air inlet 2922 and the second dirt slot 2924*b* is about 270°. Alternatively, angles 2952*a* and 2952*b* may be different.

In the illustrated configuration, each slot subtends an angle 2950*a*, 2950*b* that is about 45°, the leading edge (in the direction of air circulation) of dirt slot 2924*a* is aligned with the leading edge of dirt slot 2924*b*, and the trailing edge (in the direction of air circulation) of dirt slot 2924*a* is aligned with the trailing edge of dirt slot 2924*b*.

Figure 13:
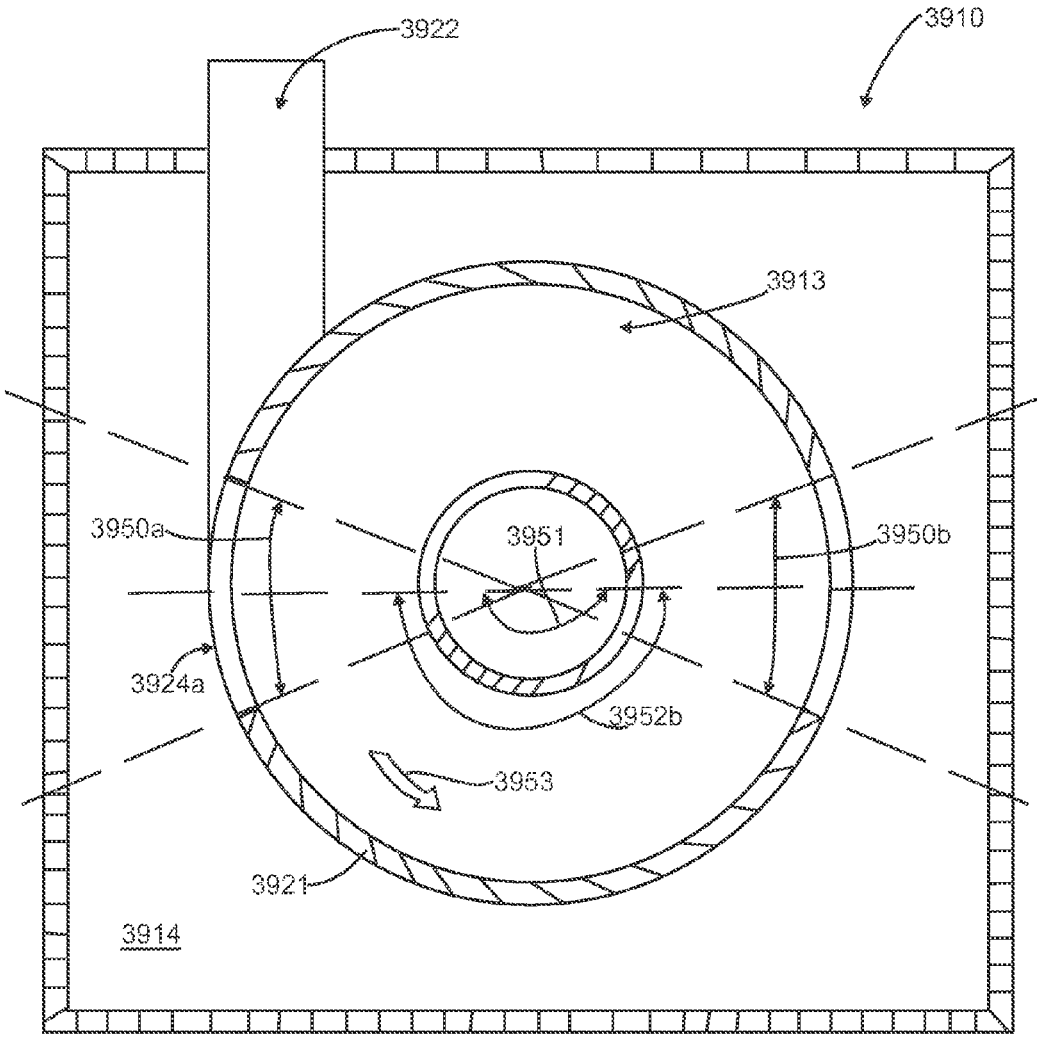
FIG. 13 is a schematic top plan representation of another example of a cyclone bin assembly.

Referring to FIG. 13, a cross-sectional schematic representation of another alternate embodiment of a cyclone bin assembly 3910 is shown. Cyclone bin assembly 3910 is generally similar to cyclone bin assembly 910, and analogous features are identified using like reference characters indexed by 3000. This embodiment is similar to the embodiment of FIG. 12, except that the position of the dirt outlets 3924*a* and 3924*b* has been shifted by 90° relative to the air inlet 3922. In this configuration, the angle 3951 between the dirt outlets 3924*a*, 3924*b* remains 180°, but the angle between the dirt outlet 3924*a* and the air inlet is 0° and the angle 3952*b* between the dirt outlet 3924*b* and the air inlet is 180°.

Figure 14:
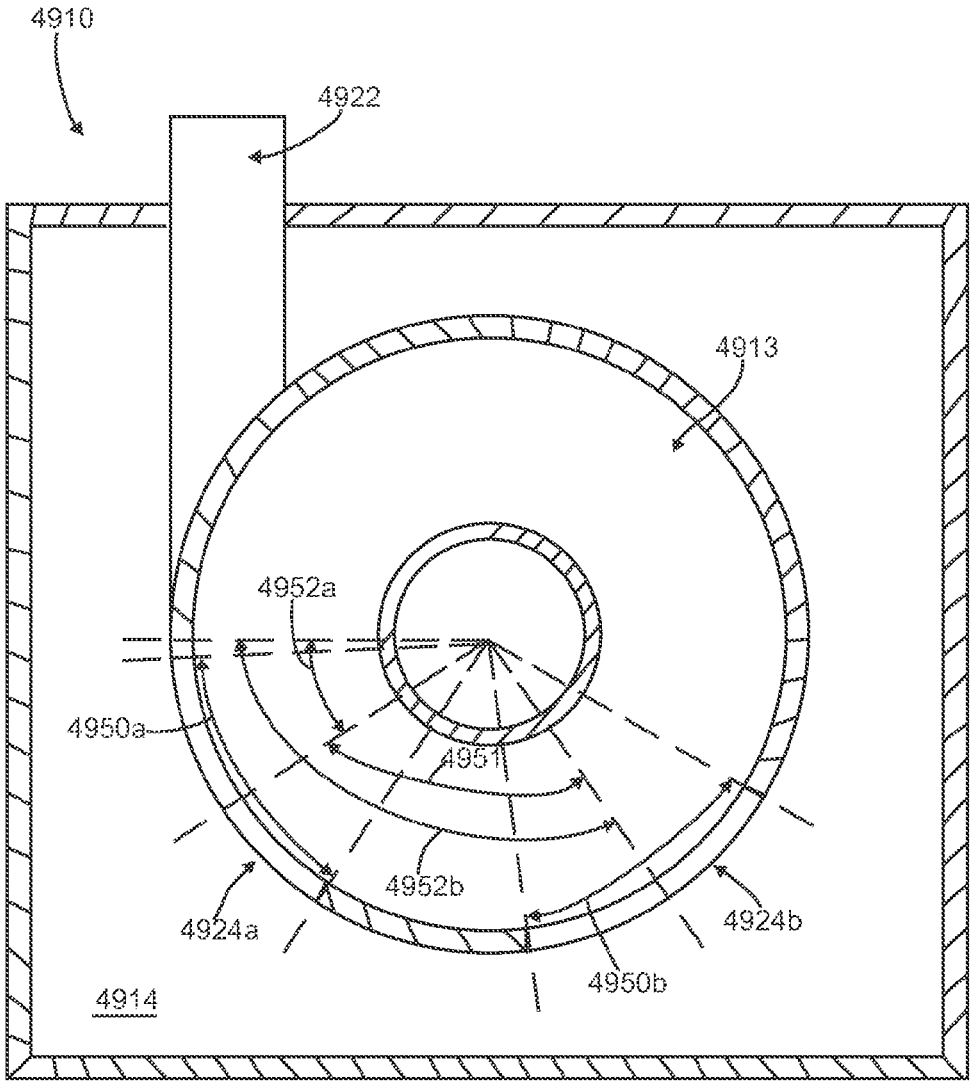
FIG. 14 is a schematic top plan representation of another example of a cyclone bin assembly.

Referring to FIG. 14, a cross-sectional schematic representation of another alternate embodiment of a cyclone bin assembly is shown. Cyclone bin assembly 4910 is generally similar to cyclone bin assembly 910, and analogous features are identified using like reference characters indexed by 4000. In this example, the individual dirt slots 4924*a* and 4924*b* have the same configuration as the slots illustrated in FIGS. 12 and 13, but are positioned differently. In this configuration, the first dirt slot 4924*a* is positioned generally adjacent the air inlet 4922, and the angle 4952*a* between the air inlet 4922 and the first dirt slot 4924*a* is about 30° downstream from the air inlet, and the angle 4952*b* between the first dirt slot and the second dirt slot 4924*b* is about 90°. In this configuration, both dirt slots 4924*a* and 4924*b* are positioned on the same side of the cyclone chamber 4913 (i.e. within 180° of each other).

Figure 15:
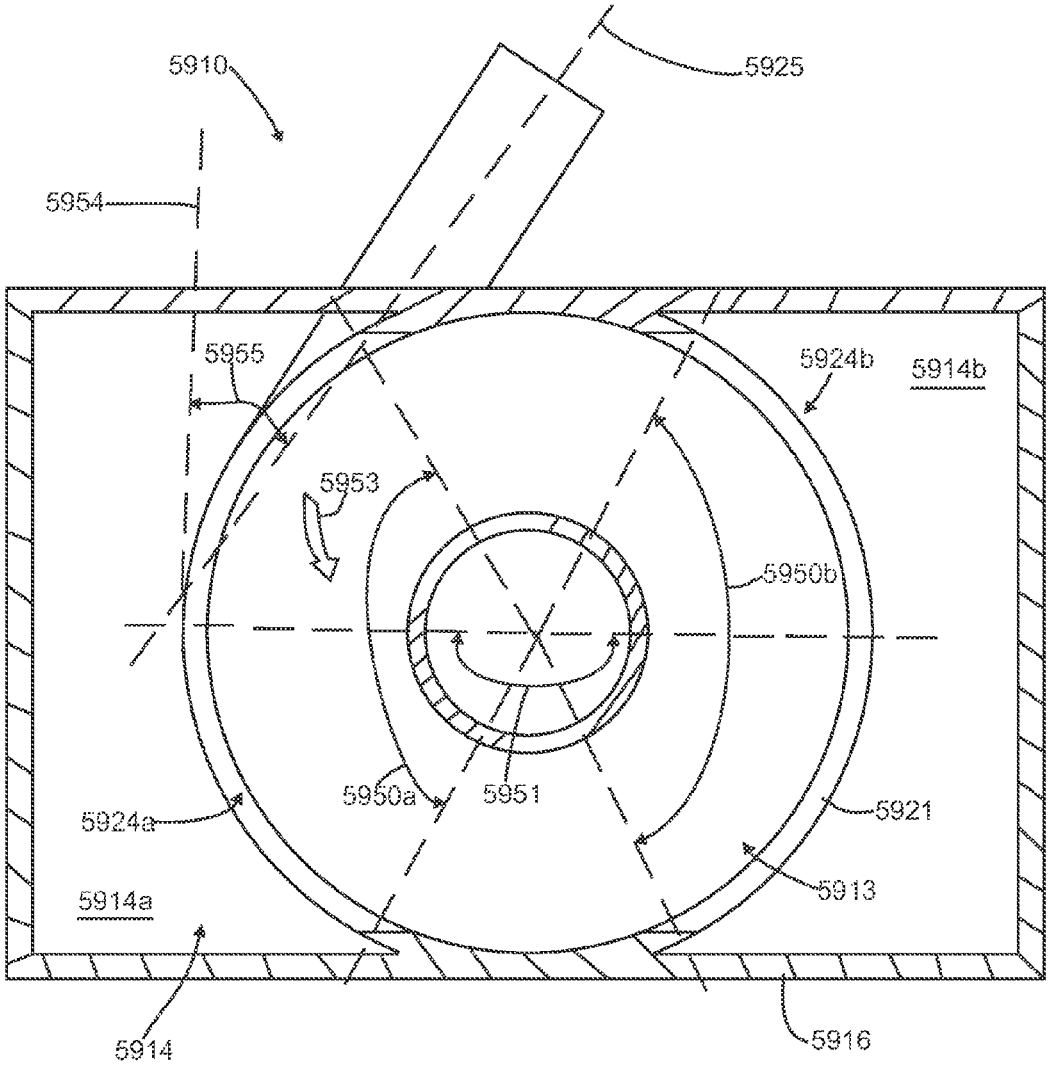
FIG. 15 is a schematic top plan representation of another example of a cyclone bin assembly.

Referring to FIG. 15, a cross-sectional schematic representation of another alternate embodiment of a cyclone bin assembly is shown. Cyclone bin assembly 5910 is generally similar to cyclone bin assembly 910, and analogous features are identified using like reference characters indexed by 5000. In this example, the dirt slots 5924*a* and 5924*b* are opposite each other (i.e. the angle 5951 is about 180°) but each dirt slot 5942*a* and 5924*b* is much wider than the other illustrated examples, such that the angles 5950*a* and 5950*b* subtended by each dirt slot is about 150°. In this configuration, the dirt slots 5942*a* and 5924*b* represent more than 50% of the total perimeter of the cyclone chamber 5913. Also in this embodiment, portions of the cyclone chamber sidewall 5921 are coincident with the dirt collection chamber sidewalls 5916. Optionally, if the cyclone chamber walls 5921 extend the entire height of the dirt collection chamber 5914, in this configuration the cyclone chamber 5913 may sub-divide the dirt collection chamber 5914 into two different portions 5914*a* and 5914*b*, separated by the cyclone chamber 5913. Each dirt collection region 5914*a* and 5914*b* is in communication with a respective one of the dirt slots 5942*a* and 5924*b*. Also, in this illustrated embodiment, the air inlet axis 5925 is not tangentially oriented (i.e. is not parallel to a tangential plane 5954). Instead, the air inlet 5922 is arranged at an angle 5955, relative to the tangential plane 5954. This may alter the characteristics of the air flow entering the cyclone chamber.

Referring again to FIG. 7, in the illustrated embodiment the dirt outlets 924*a* and 924*b* are arranged generally opposite each other, are arranged at approximately 180° from each other (measured as a centre-to-centre angle 951 in FIG. 5). In this configuration, dirt outlet 924*a* is positioned at the front of the cyclone chamber 913 (e.g. in a portion of the sidewall that is located toward the connector and air inlet) and the dirt outlet 924*b* is positioned at the back of the cyclone chamber 913. When the surface cleaning apparatus 900 is in use, dirt and debris may accumulate within the dirt collection chamber 914 and when the surface cleaning apparatus is manipulated by a user, dirt within the dirt collection 914 chamber may tend to shift and may collect toward the lowest portion of the dirt collection 914 chamber due to gravity. For example, when the surface cleaning apparatus is tipper forward, so that the connector is angled downward and the handle is lifted (FIG. 7), dirt 956 may tend to collect toward the front of the dirt collection chamber 914. If the level of the dirt 956 is sufficiently high it may partially or completely block the front dirt outlet 924*a* as illustrated. In this configuration the first dirt outlet 924*a* may be blocked, but the rear dirt outlet 924*b* remains free. Similarly, if the surface cleaning apparatus is tipped rearward, the dirt may tend to collect in a rear portion of the dirt collection chamber (FIG. 8) and may partially or completely block the rear dirt outlet 924*b*. In this configuration the rear dirt outlet 924*b* is blocked, but the front dirt outlet 924*a* is free. Providing two dirt outlets 924*a* and 924*b* on opposite sides of the cyclone chamber may help ensure that at least one outlet 924*a* and 924*b* remains free and unblocked to allow dirt to exit the cyclone chamber 913 even if the surface cleaning apparatus 900 is tilted forward or backward. Alternatively, instead of being provided toward the front and back of the cyclone chamber, the dirt slots may be positioned in other locations. For example, the cyclone chamber may be configured to have a rear dirt outlet and a side dirt outlet, or two side outlets provided toward the left and right sides of the cyclone chamber.

Pre-Motor Filter

Optionally, one or more pre-motor filters may be placed in the air flow path between the cyclone bin assembly and the suction motor. Alternatively, or in addition, one or more post-motor filters may be provided downstream from the suction motor. The following is a description of a pre-motor filter housing construction that may be used by itself in any surface cleaning apparatus or in any combination or sub-combination with any other feature or features disclosed herein.

Figure 3:
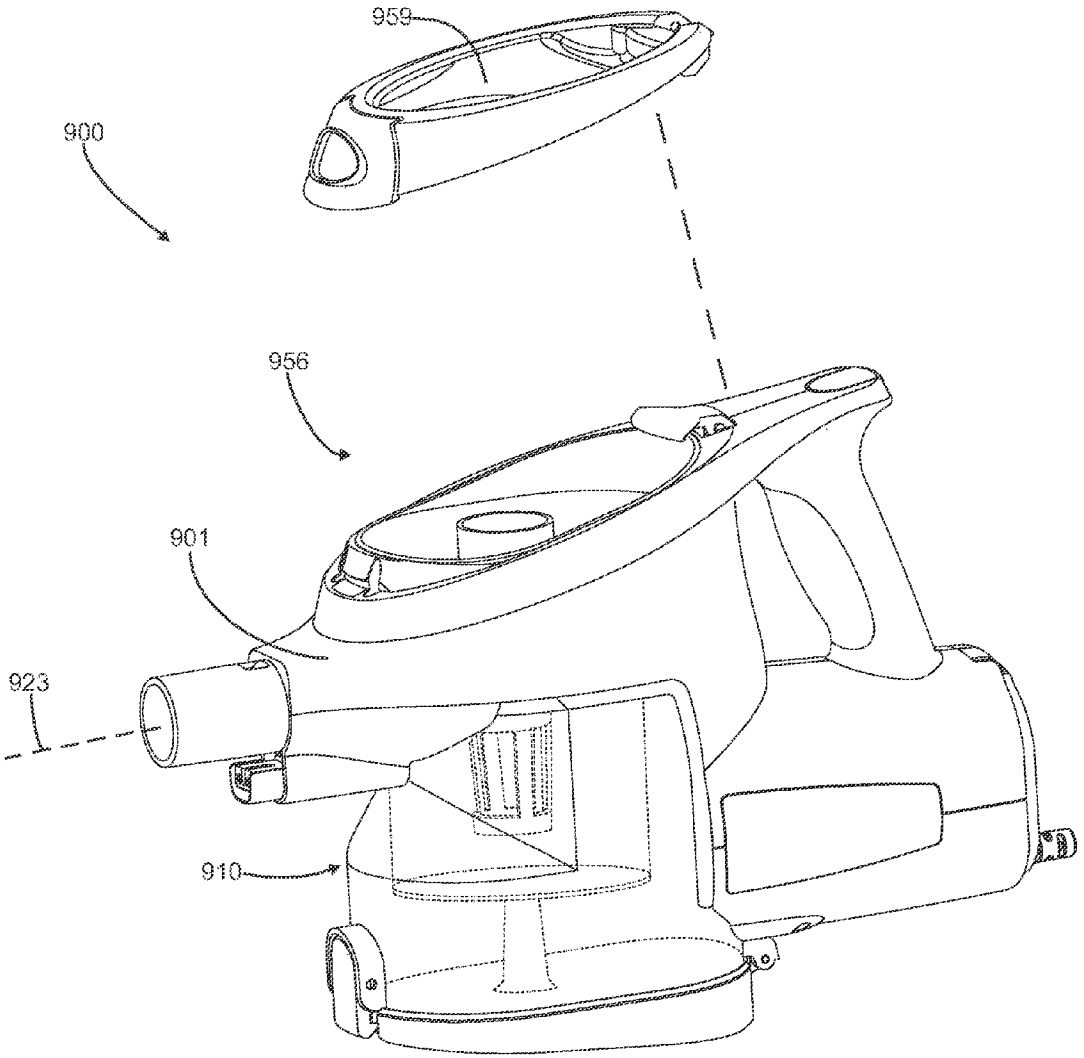
FIG. 3 is a partially exploded perspective view of the surface cleaning apparatus of FIG. 1.

Referring to FIG. 3, in the illustrated embodiment a pre-motor filter chamber or housing 956 is provided as a portion of the body 901 of the surface cleaning apparatus 900, above the cyclone bin assembly 910. Referring also to FIG. 8, the pre-motor filter chamber 956 is bounded by a bottom wall 957, a sidewall 958 and an upper wall 958*a*. In the illustrated example the upper wall 958*a* is provided by an upper cover 959. Preferably, at least one of the bottom wall, sidewall and upper cover are openable to allow access to the interior of the pre-motor filter chamber. In the illustrated embodiment, the upper cover 959 is removable (FIG. 3) to provide access to the interior of the chamber 956. Alternatively, instead of being removable the upper cover may be pivotally openable or otherwise moveably coupled to the main body.

One or more filters may be positioned within the pre-motor filter chamber 956 to filter fine particles from the air stream exiting the air outlet, before it flows into inlet of the suction motor. The filters may be of any suitable configuration and formed from any suitable materials. In the illustrated embodiment, a foam filter 960 and a downstream felt filter 961 are positioned within the pre-motor filter chamber 956.

In the illustrated example, the bottom wall 957 includes a plurality of upstanding support ribs 962 to support the filters 960, 961 positioned within the chamber 956. The support ribs 962 may hold the filters 960, 961 above the surface 963 of the bottom wall 957 to define a lower header or headspace 964, to allow for air to flow laterally between the bottom surface 965 of filter 961 and the bottom wall 957. In the illustrated embodiment, the lower or downstream headspace 964 is defined between the outer surface 965 of the felt 961 and the surface 963 of the bottom wall 957.

To help reduce the overall size of the surface cleaning apparatus, in the illustrated embodiment the pre-motor filter chamber 956, and the filters therein 960, 961, is positioned above the cyclone chamber 913 and covers the upper end of the cyclone chamber 913. In this configuration, a plane 966 containing the foam filter 960 is generally parallel and spaced above a plane 967 containing the air outlet 923 of the cyclone chamber 913, and both planes 966, 967 are generally perpendicular to the cyclone axis 920. Arranging the filters in this configuration results in the upstream side of the pre-motor filter (in this example the upper side 968 of the foam filter 960) being spaced further apart from the cyclone chamber 913 than the downstream side of the pre-motor filter (in this example the lower surface 965 of the felt filter 961). Alternatively, in other embodiments, the pre-motor filter chamber may cover only a portion of the upper end of the cyclone chamber and/or may be laterally spaced apart from the cyclone chamber and/or may be inclined with respect to plane 967.

Figure 4:
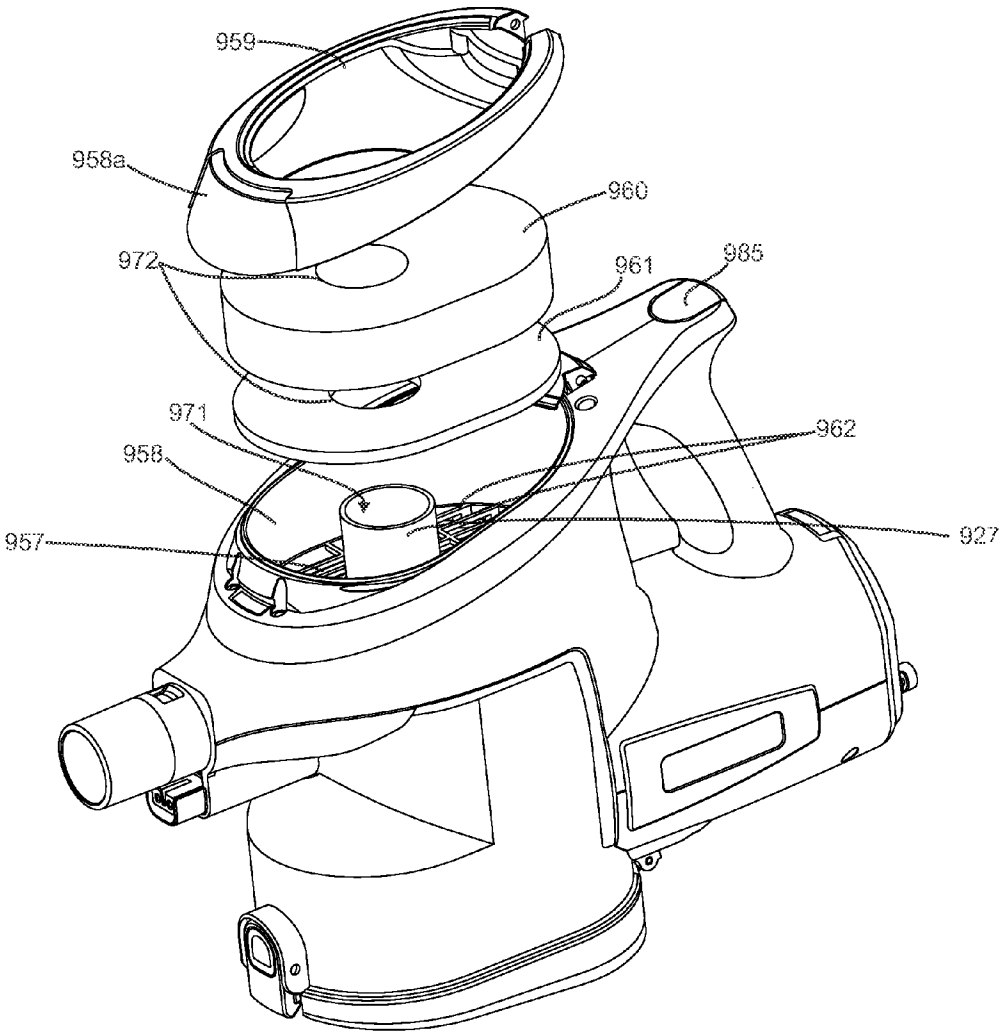
FIG. 4 is another partially exploded perspective view of the surface cleaning apparatus of FIG. 1.

In the illustrated embodiment, the pre-motor filter chamber or downstream header 956 is configured so that the upstream side 968 of the foam filter 960 is provided toward the top of the chamber, and air flows generally downwardly through the filters. In this configuration, the upper cover 959 is shaped so that when it is closed (FIG. 8) an upper or upstream headspace or header 970 is provided between the inner surface of the upper cover 959 and the upstream side 968 of the foam filter 960. To provide air flow communication between the cyclone air outlet 923 and the upstream headspace 970, it is preferred that the vortex finder 927 or an extension thereof extends through the pre-motor filters and preferably extends into the interior of the pre-motor filter chamber 956, through the filters 960, 961 therein, and has an outlet end 971 that is located within the upstream head space 970 and above filters 960, 961. To accommodate the extension of the vortex finder 927, each filter includes a correspondingly shaped conduit aperture 972 (FIG. 4). It will be appreciated that other flow paths may be used to connect vortex finder 927 in air communication with upstream headspace 970.

When the surface cleaning apparatus is in use, air exiting the cyclone chamber 913 may flow into the upstream head space 956 via the vortex finder 927. Within the upstream headspace the air can flow laterally across the upstream surface 968 of the foam filter 960, and down through the filters 960, 961 into the downstream head space 964.

In this configuration, the upper side 988 of the foam filter 960 is exposed to the dirty air exiting the cyclone air outlet 923, and may become dirty or soiled during use. Optionally, the upper cover 959 may include at least one transparent region overlying the upper side 968 of the filter 960. For example, some or all of the upper cover may be formed from a transparent material (such as plastic) or one or more windows may be provided within the upper cover member. Providing a transparent region allows a user to visually inspect the condition of the upstream side 698 of the filter 960 without having to open the upper cover 959. Alternatively, the upper cover 959 need not include any type of transparent portion or inspection region, and a user may inspect the upstream side 968 of the filter 960 when the upper cover 959 is opened or removed.

Alternatively, the pre-motor filter may be provided laterally from the vortex finder. For example, referring to FIG. 16, a cross sectional view of another embodiment of a surface cleaning apparatus 6900 is shown. Apparatus 6900 is similar to apparatus 900, and analogous features are identified using like reference numerals indexed by 6000. In this embodiment, the pre-motor filter 6960 is spaced laterally from the vortex finder 6927. An extension 6927*a* of the vortex finder extends above the top of filter 6960 to define a dirt collection area, which may be emptied when the lid is opened and the surface cleaning apparatus is inverted.

Downflow Conduit

Optionally, the inlet of the suction motor is positioned along the length of one side (preferably the rear side) of the cyclone bin assembly. The following is a description of a flow path that may be used by itself in any surface cleaning apparatus or in any combination or sub-combination with any other feature or features disclosed herein.

The suction motor preferably has an axis that is generally perpendicular to the cyclone axis and has an air inlet between the upper end and lower end of the cyclone bin assembly and preferably, between the upper end and the lower end of the cyclone chamber. Accordingly, from the downstream head space 964, the air may flow to the inlet 973 of the suction motor 911 via an internal air conduit 974 formed within the body 901. Air may be drawn through the suction motor 911 and then be exhausted from a motor outlet 975, and expelled via the clear air outlet 904 (see also FIG. 6).

In the illustrated embodiment, the internal air conduit 974 is formed within the main body 901 and is external the cyclone chamber 913 and the dirt collection chamber 914 and is partially bounded by an exterior surface of the cyclone chamber sidewall 921 and an exterior surface of the dirt collection chamber sidewall 915. The air conduit 974 extends generally vertically between the pre-motor filter chamber 956 and the suction motor 911, and is positioned laterally intermediate the suction motor 911 and the cyclone chamber 913. The suction motor 911 is positioned at an elevation where its air inlet 973 is vertically between the upper and lower ends of the cyclone chamber 913, and the motor axis 926 passes through the cyclone chamber 913 (above the dirt collection chamber—see FIG. 6). In the illustrated embodiment the inlet axis 925 intersects the air conduit 974 and is positioned below and does not intersect the pre-motor filter chamber 956.

The internal air conduit 974 may extend downwardly at an angle to the vertical. It may or may not be bounded on one side by the sidewall of the cyclone chamber and/or the dirt collection chamber.

Bleed Valve

Optionally, a bleed valve 976 may be provided to supply bleed air to the suction motor inlet 973 in case of a clog in the air flow path upstream from the suction motor 911. When the surface cleaning apparatus is in use, the air flow path may become clogged or otherwise blocked in a number of different ways, including, for example if a cleaning wand and/or suction hose becomes blocked with debris, if the cyclone chamber becomes fouled with debris and/or if the pre-motor filters are soiled to an extent that it significantly impedes airflow through the filters. Preferably the bleed valve 976 can be positioned and configured to supply bleed air into the airflow path at a location that is upstream from the suction motor inlet 973 and downstream from the likely clog or blockage locations.

The following is a description of the positioning and orientation of a bleed valve that may be used by itself in any surface cleaning apparatus or in any combination or sub-combination with any other feature or features disclosed herein.

For example, the bleed valve 976 may be positioned to supply bleed air to the air flow path 974 between the pre-motor filter chamber 956 and the suction motor inlet 973. The bleed valve 976 may be any suitable valve, including a pressure sensitive valve that is opened automatically when there is a blockage in the air flow path upstream from the suction motor 911.

In the illustrated embodiment, the bleed valve 976 extends along a valve axis 977 that is generally parallel to the suction motor axis 926, and is generally orthogonal to the cyclone axis 920. To provide outside air, a port 978 is provided in the main body 901, in air flow communication with the inlet end of the bleed valve 976. The outlet end of the bleed valve is in communication with the air conduit 974.

In the illustrated embodiment, the bleed valve 976 is located at an elevation between the pre-motor filter chamber 956 and the suction motor 911, partially laterally underlies the pre-motor filter chamber 956 (and the filters 960, 961 therein) and partially laterally overlies the suction motor 911 and its housing 912. Alternatively, the bleed valve 976 may be located at a different elevation (for example below the suction motor and/or in line with or above the pre-motor filter chamber) and need not laterally overlap the suction motor, pre-motor filter chambers or the filters therein.

Figure 16:
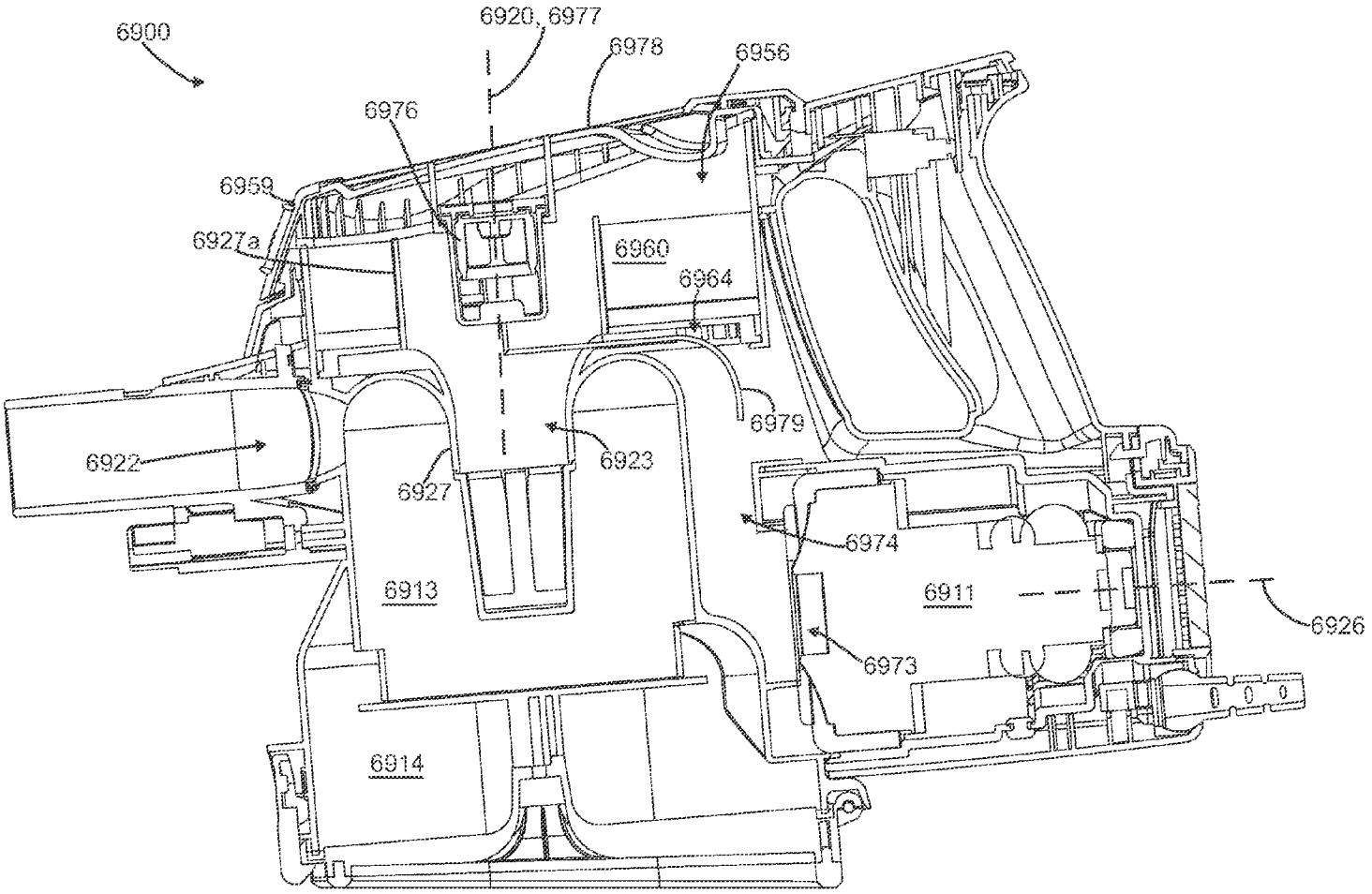
FIG. 16 is a cross sectional view of another embodiment of a surface cleaning apparatus.

Alternatively, instead of extending laterally through the main body of the surface cleaning apparatus, the bleed valve may be provided in a different location. Referring to FIG. 16, a cross sectional view of another embodiment of a surface cleaning apparatus 6900 is shown. Apparatus 6900 is similar to apparatus 900, and analogous features are identified using like reference numerals indexed by 6000. In this embodiment, the bleed valve 6976 is positioned within the pre-motor filter chamber 6956 and is generally vertically oriented, along axis 6977. In the illustrated example, the bleed valve 6976 is generally co-axial with the cyclone chamber 6913. To supply outside air to the bleed valve, a port 6978 is provided in the upper cover 6959 of the pre-motor filter housing 6956 and is in air flow communication with the inlet end of the bleed valve 6976. The outlet end of the bleed valve 6976 is in air flow communication with the air conduit 6974 via a conduit 6979 or optionally via the downstream headspace 6964, to supply the outside air to the suction motor in the event that the pre-motor filters are blocked. The conduit 6979 can be any suitable conduit and can be sized to supply a desired quantity of air to the suction motor 6911.

Handle

Optionally, the surface cleaning apparatus may be provided with one or more handles to allow a user to grasp and manipulate the surface cleaning apparatus. Each handle may have one or more grip portions and may be configured to allow the user to grasp the handle in one or more configurations and/or orientations. Providing a generally upright or pistol-grip style handle may allow a user to grasp the surface cleaning apparatus while keeping his/her wrist in a comfortable, ergonomic position.

The following is a description of the positioning and orientation of a handle that may be used by itself in any surface cleaning apparatus or in any combination or sub-combination with any other feature or features disclosed herein.

Figure 9:
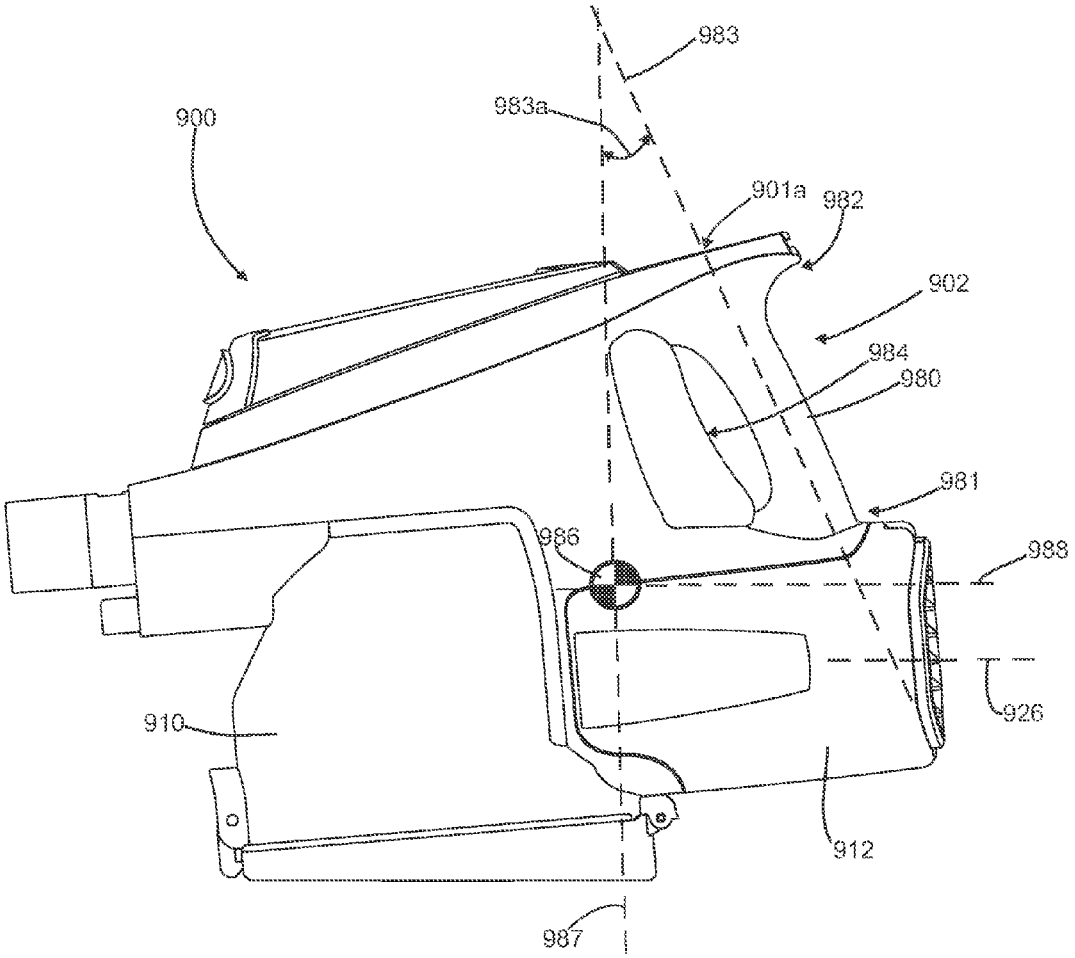
FIG. 9 is a side view of the surface cleaning apparatus of FIG. 1.

Referring to FIG. 9, in the illustrated embodiment, handle 902 is configured as a generally upright handle and includes a grip portion 980 that is configured as a pistol-grip style handle. The handle 902 has a first or bottom end 981 that is adjacent the suction motor housing 912 (e.g., the upper surface thereof) and a second or upper end 982 that is spaced above from the lower end 981. The upper end 981 of the handle may be adjacent the rear side wall of the housing of the pre-motor filter chamber 956 or may be attached to bridge portion that extends rearwardly from the pre-motor filter housing.

The hand grip portion 980 may extend along a handle axis 983. In the illustrated embodiment, the handle axis 983 is inclined slightly forwardly, and forms and angle 983*a*, relative to a vertical axis. The angle 983*a* can be any suitable angle, and preferably is between about 0-45°, and may be between about 20-35°. The handle axis 983 intersects the cyclone axis, the suction motor axis 926 and suction motor housing 912 and a bridge portion 901*a* of the main body that is an extension of the pre-motor filter housing 956.

When grasping the hand grip portion 980, a user's fingers may pass through an opening 984 in front of the hand grip portion 980. In the illustrated embodiment, the perimeter of the opening 984 is formed by an upper portion 912*a* (FIG. 7) of the suction motor housing 912, the front surface 980*a* of the hand grip portion 980, a rear portion of the pre-motor filter chamber sidewall 958 and connecting portions of the main body. Optionally, the air inlet port for the bleed valve 976 may be formed in one of the surfaces forming the perimeter of the handle opening 984.

Preferably, the primary on/off power switch for the surface cleaning apparatus is positioned proximate the handle 902, so that a user may turn the vacuum cleaner on or off while holding it by the handle 902. Referring to FIGS. 4 and 7, in the illustrated embodiment, the primary power switch 985 is provided on the upper end of the handle 902 and is configured so that it can be pressed by the thumb of a user while holding the hand grip portion 980. The hand grip portion 980 can include an internal passage for routing electrical wires or mechanical linkages to provide communication between the primary power switch and the electrical circuit powering the suction motor 911. Optionally, the primary power switch 985 can be positioned so that it is intersected by the handle axis 9083. Alternatively, the primary power switch 985 may be provided at another suitable location.

Optionally, the handle 902 can be positioned so that the hand weight of the surface cleaning apparatus when held in a horizontally disposed position (e.g., axis 988 is horizontal) is less than 2 lbs, preferably less than 1 lbs and more preferably about 0 lbs, thereby reducing the stress on a user's wrist. Accordingly, the user may experience only a slight down force even though the motor is below the handle. The handle 902 may accordingly be positioned so that it is behind the centre of gravity of the surface cleaning apparatus. Preferably, the handle may also be configured so that all or a portion of it (e.g., the portion gripped by a user) is located at a higher elevation than the centre of gravity.

Positioning the handle behind and optionally above the centre of gravity may result in the surface cleaning apparatus tending to tip forwardly when being held horizontally by a user. This may tend to rotate the front of the surface cleaning apparatus downwardly when the surface cleaning apparatus is in use and may allow at least a portion of the weight of the surface cleaning apparatus to be carried by a surface cleaning head (or other tool) that rollingly contacts the floor.

For example, referring to FIG. 9, in the embodiment illustrated, the centre of gravity 986 is located in a vertical plane 987 that is forward of the handle and horizontal plane 988 that lies below the lower end 981 of the handle 902. In the illustrated embodiment the handle axis 983 does not intersect the centre of gravity of the surface cleaning apparatus.

Detachable Motor Housing

The following is a description of detachable motor housing may be used by itself in any surface cleaning apparatus or in any combination or sub-combination with any other feature or features disclosed herein.

Figure 10:
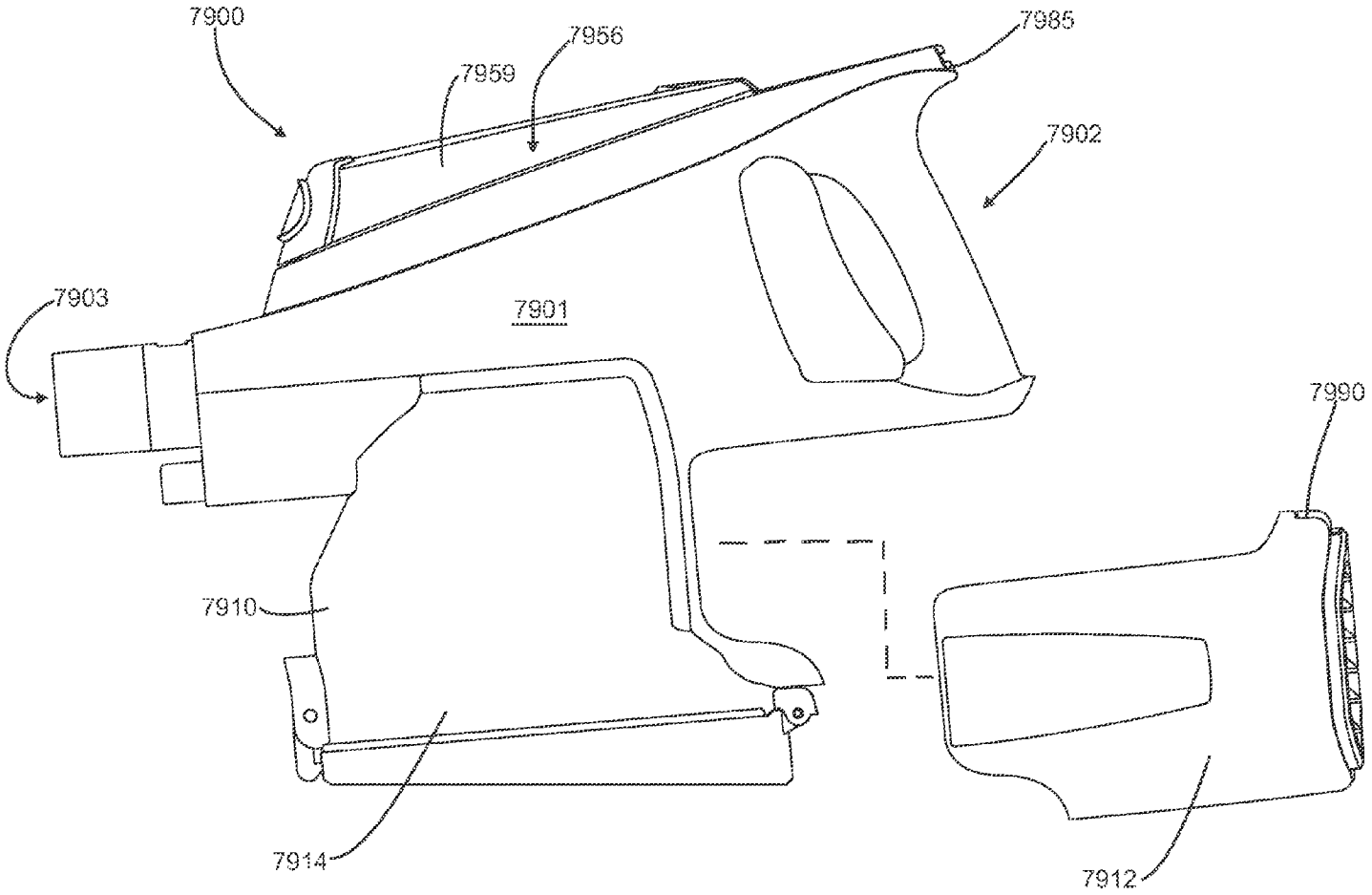
FIG. 10 is a side view of another embodiment of a surface cleaning apparatus with the cyclone bin assembly and handle removed for emptying.
Figure 11:
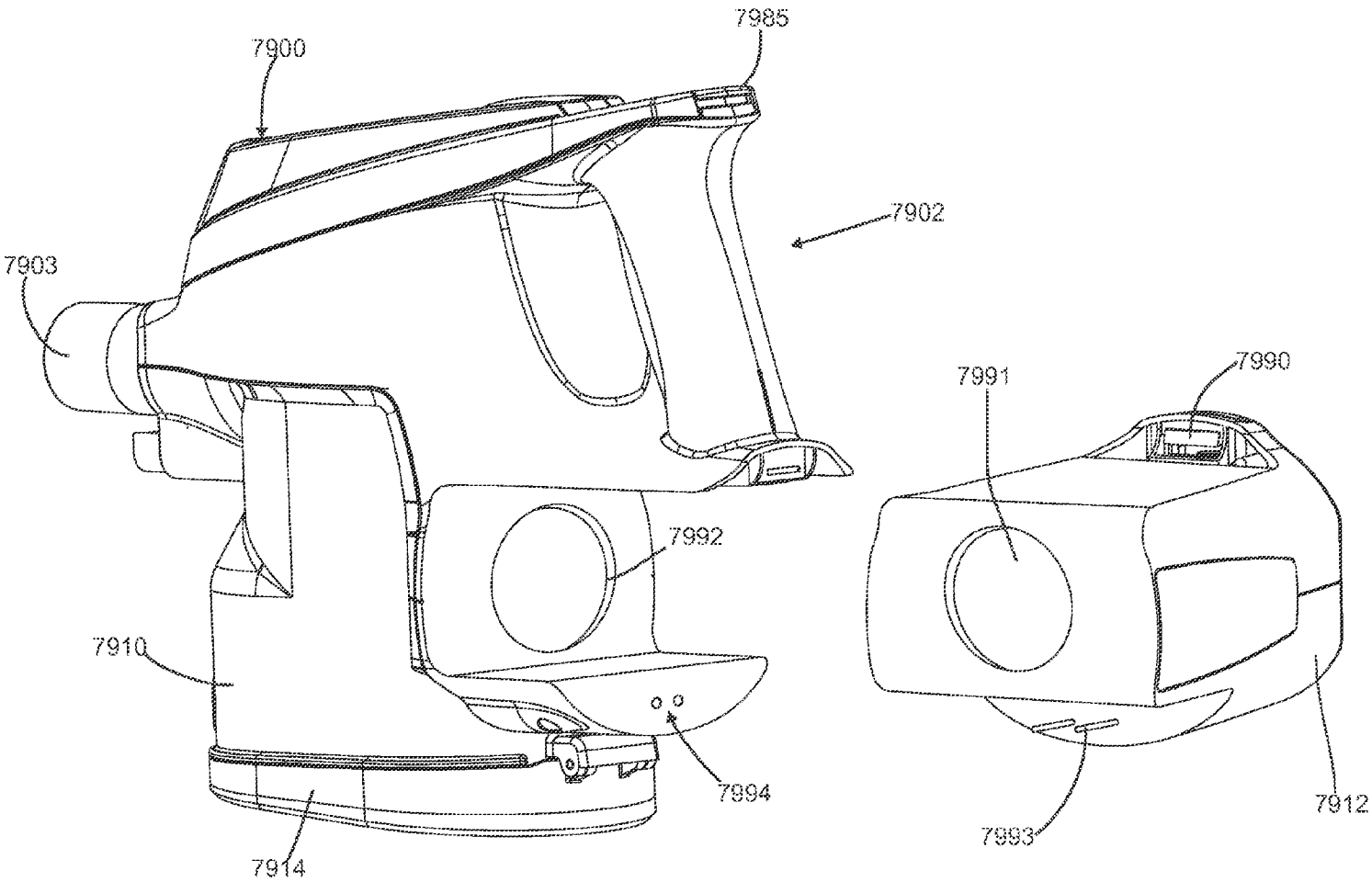
FIG. 11 is a rear perspective view of the surface cleaning apparatus of FIG. 10.

Optionally, the suction motor and at least a portion of its surrounding motor housing may be detachable from the main body of the surface cleaning apparatus. Referring to FIGS. 10 and 11, an alternate embodiment of a surface cleaning apparatus 7900 is shown. Apparatus 7900 is generally similar to apparatus 900 and analogous features are identified using like reference characters indexed by 7000. In this embodiment the suction motor housing 7912 can be detachably connected to the main body 7901, so that the suction motor housing 7912, and the suction motor therein, can be separated from the cyclone bin assembly 7910, handle 7902 and, preferably, pre-motor filter housing 7956. The suction motor and related electrical components may form a significant portion of the weight of the surface cleaning apparatus 7900. Separating the suction motor housing 7912 from the main body 7901 may allow a user to manipulate the main body 7901 and empty the dirt collection chamber 7914 and cyclone 7913 using the handle 7902 without having to carry around the extra weight of the suction motor.

The detachable suction motor housing module 7912 may removably coupled to the main body 7901 using any suitable attachment mechanisms. In the illustrated embodiment the attachment mechanism is a latch 7990 that can be triggered by a user. In this embodiment, the suction motor module 7912 includes an air inlet port 7991 that is configured to be coupled to a reciprocal air outlet port 7992 on the main body 7901. The ports 7991, 7992 may be of any compatible configurations, and one or more seals or gasket members may be provided at their interface to help provide an air-tight connection.

If the primary on/off switch 7985 is provided on the main body portion (as described above) in addition to the air flow connection, the suction motor module 7912 also includes at least one control/electrical connection that is configured to mate with a corresponding control port on the main body 7901. In the illustrated example, the on/off switch 7985 on the main body 7901 is an electrical switch, and the control connection between the suction motor module 7912 and the main body includes mating electrical connectors (e.g., male prongs 7993 and a female electrical socket 7994) to supply electricity to the switch 7985. Alternatively, primary on/off switch 7985 may be a mechanical switch that is connected to the suction motor module via a mechanical linkage. In such a configuration, the control connection can include a mechanical linkage to translate movements of the on/off switch to open and close an electrical circuit in the suction motor housing. Alternatively, control signals may be transmitted wireless (e.g. via radio signal) or in any other suitable manner between the on/off switch and the suction motor housing. In such configurations, the suction motor module and the main body need not include a physical control connection.

Optionally, the surface cleaning apparatus 7900 can be configured so that most or all of the electrical components are located within the suction motor housing 7912. In such a configuration, when the motor housing 7912 is separated from the main body 7901, substantially all of the components remaining in the main body 7901 may be washed without exposing the suction motor and other electrical components to water or other cleaning materials. This may help prevent inadvertent damage to the electrical components when washing the surface cleaning apparatus 7900.

Other Surface Cleaning Apparatus

Figure 17:
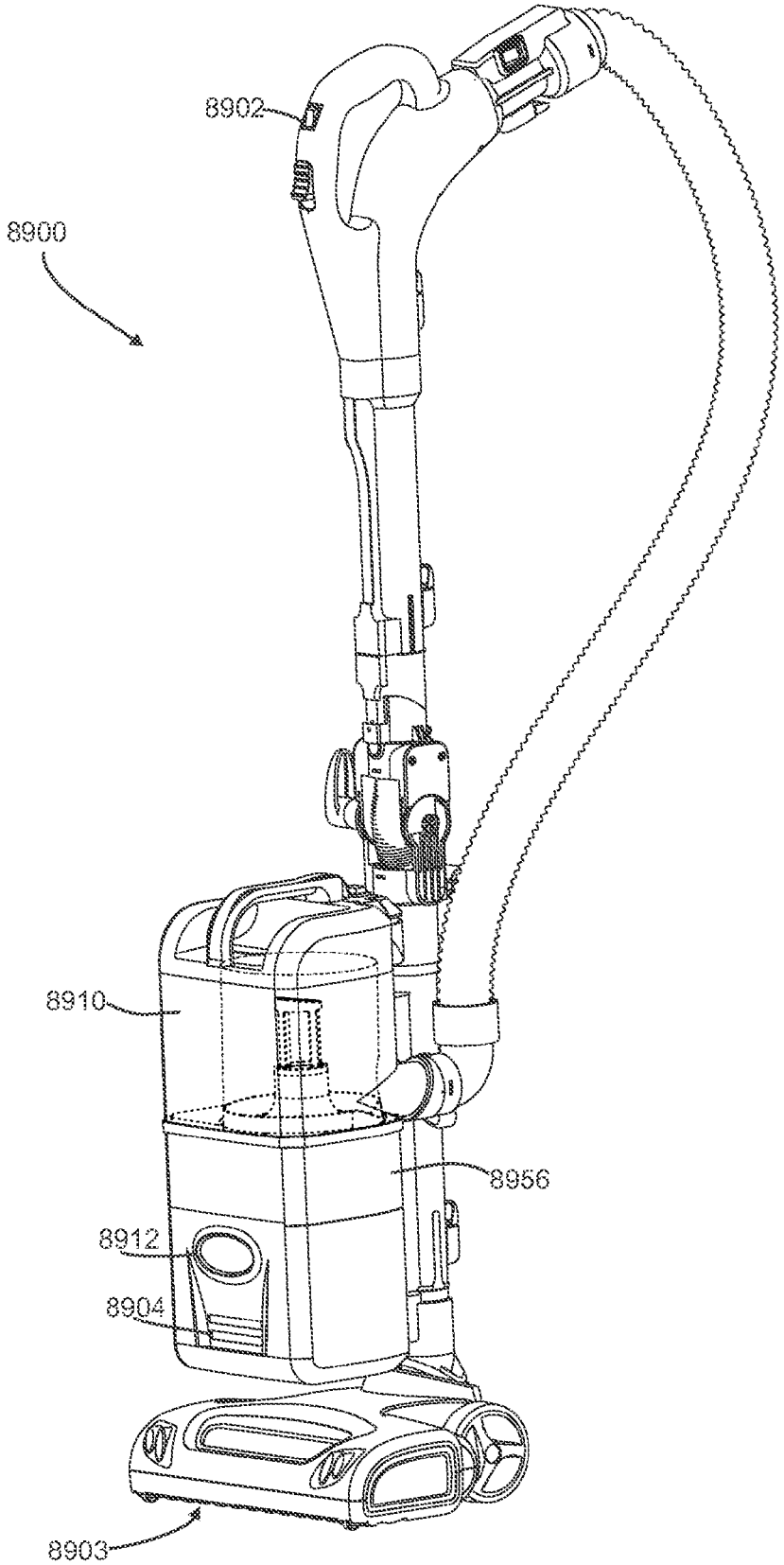
FIG. 17 is a perspective view of another embodiment of a surface cleaning apparatus.

Optionally, instead of a hand-held or carriable surface cleaning apparatus, the surface cleaning apparatus may be an upright-style surface cleaning apparatus or a canister-style cleaning apparatus that includes a cyclone bin assembly having some or all of the features described herein. Referring to FIG. 17, an alternate embodiment of a surface cleaning apparatus 8900 is shown. Apparatus 8900 includes a dirty air inlet 8903, a clean air outlet 8904 and a cyclone bin assembly 8910 mounted to a suction motor housing 8912. A pre-motor filter chamber 8956 is defined between the cyclone bin assembly 8910 and the motor housing 8912. The cyclone bin assembly 8910, suction motor housing 8912 and pre-motor filter chamber 8956 may include some or all of the features described herein, alone or in combination with each other.

Figure 18:
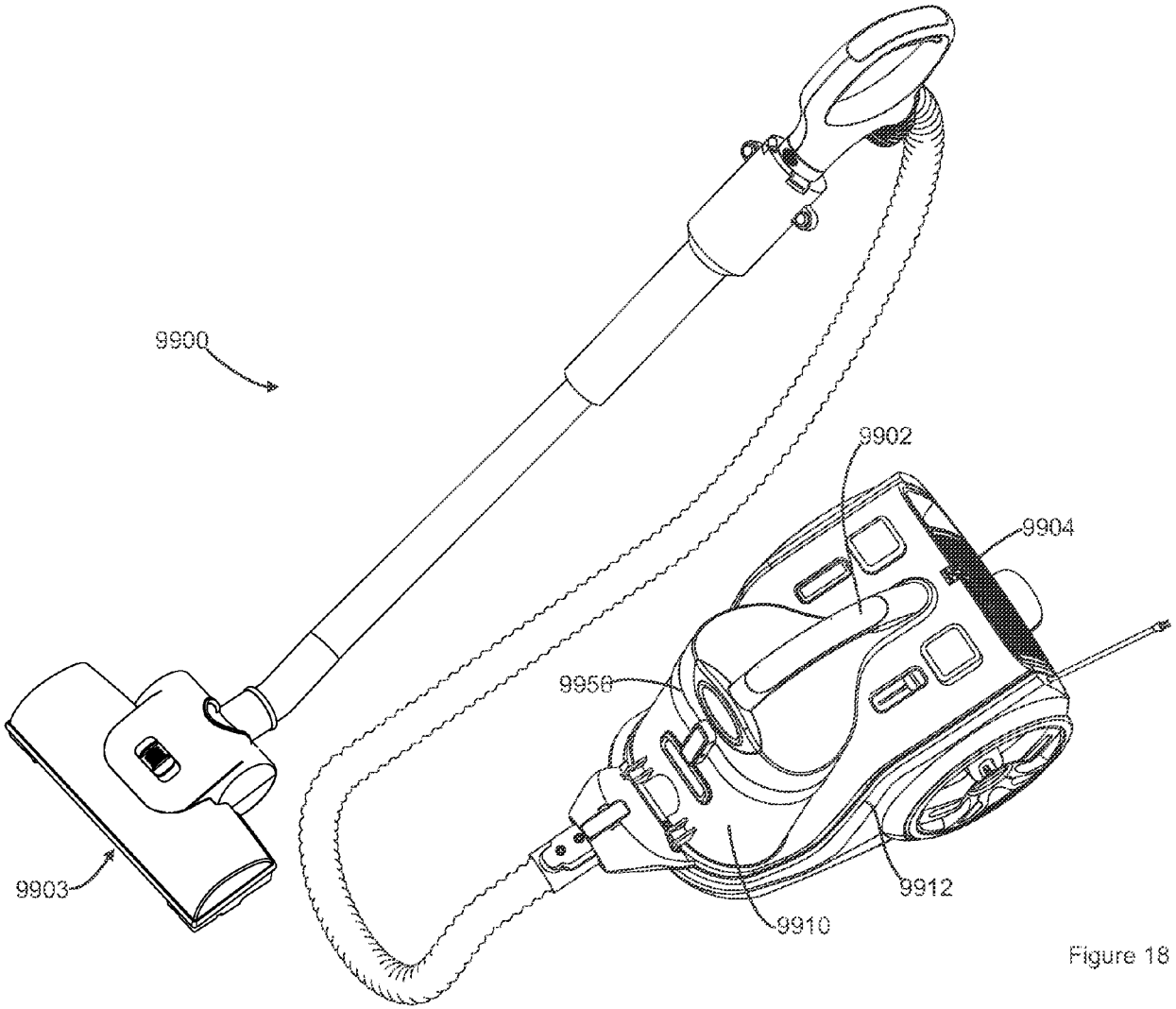
FIG. 18 is a perspective view of another embodiment of a surface cleaning apparatus.

Referring to FIG. 18, an alternate embodiment of a surface cleaning apparatus 9900 is shown. Apparatus 9900 includes a dirty air inlet 9903, a clean air outlet 9904 and a cyclone bin assembly 9910 mounted to a suction motor housing 9912. A pre-motor filter chamber 9956 is defined between the cyclone bin assembly 9910 and the motor housing 9912. The cyclone bin assembly 9910, suction motor housing 9912 and pre-motor filter chamber 9956 may include some or all of the features described herein, alone or in combination with each other.

Alternate Hand Carriable Surface Cleaning Apparatus

The following description exemplifies a number of the features disclosed herein in an alternate construction for a hand carriable surface cleaning apparatus.

Figure 19:
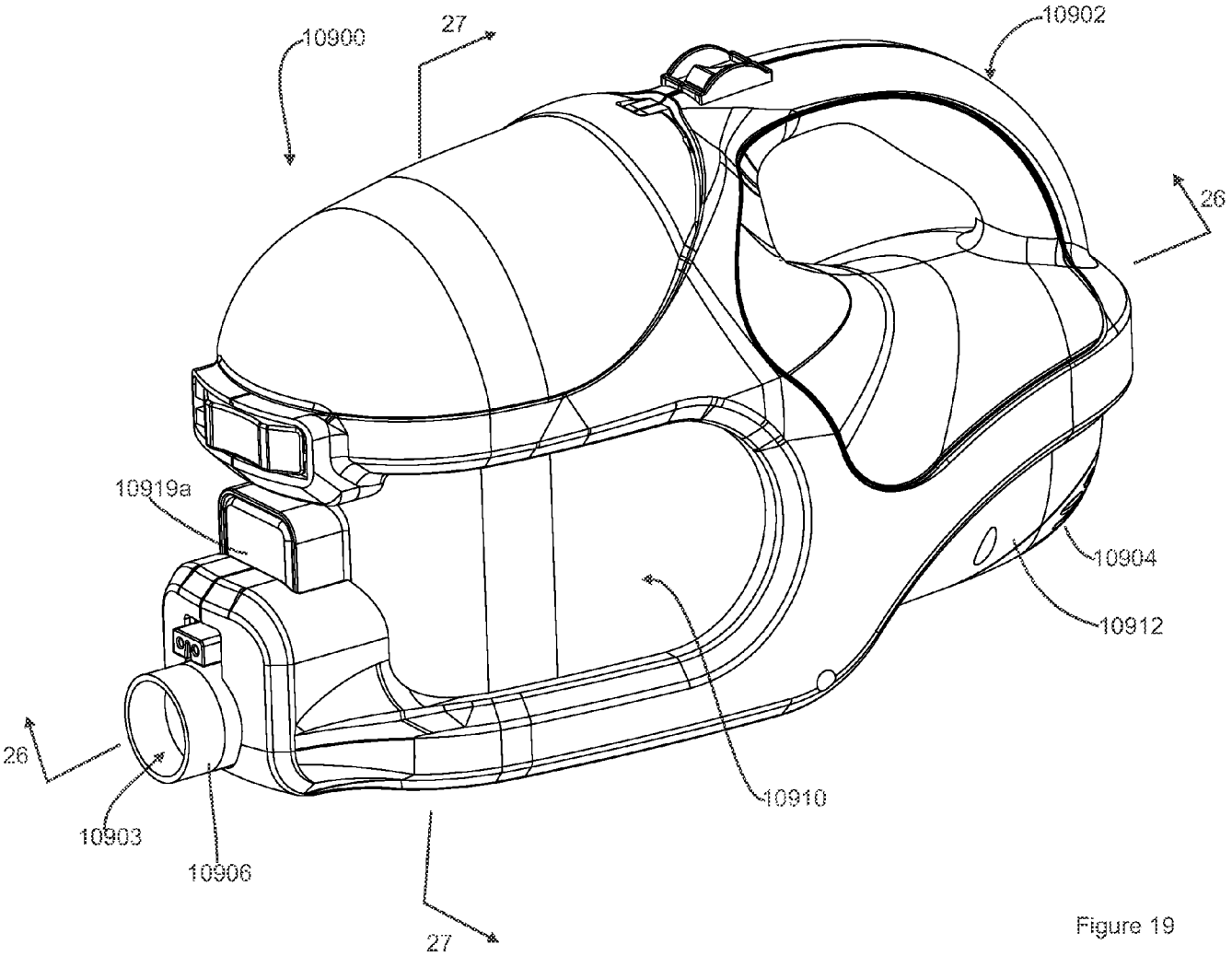
FIG. 19 is a perspective view from the front of another embodiment of a surface cleaning apparatus.

Referring to FIG. 19, another embodiment of a hand carriable surface cleaning apparatus 10900 is shown. The surface cleaning apparatus 10900 is similar to surface cleaning apparatus 900, and like features are indicated using analogous reference numbers indexed by 10,000.

The surface cleaning apparatus 900 includes a main body 10901 having a handle 10902, a dirty air inlet 10903, a clean air outlet 10904 (see for example FIG. 26) and an air flow path extending therebetween. In the embodiment shown, the dirty air inlet 10903 is the inlet end of connector 10906. Optionally, the inlet end 10905 can be used to directly clean a surface. Alternatively, the inlet end can be connected to the downstream end of any suitable cleaning tool or accessory, including, for example a wand, a nozzle and a flexible suction hose.

Figure 20:
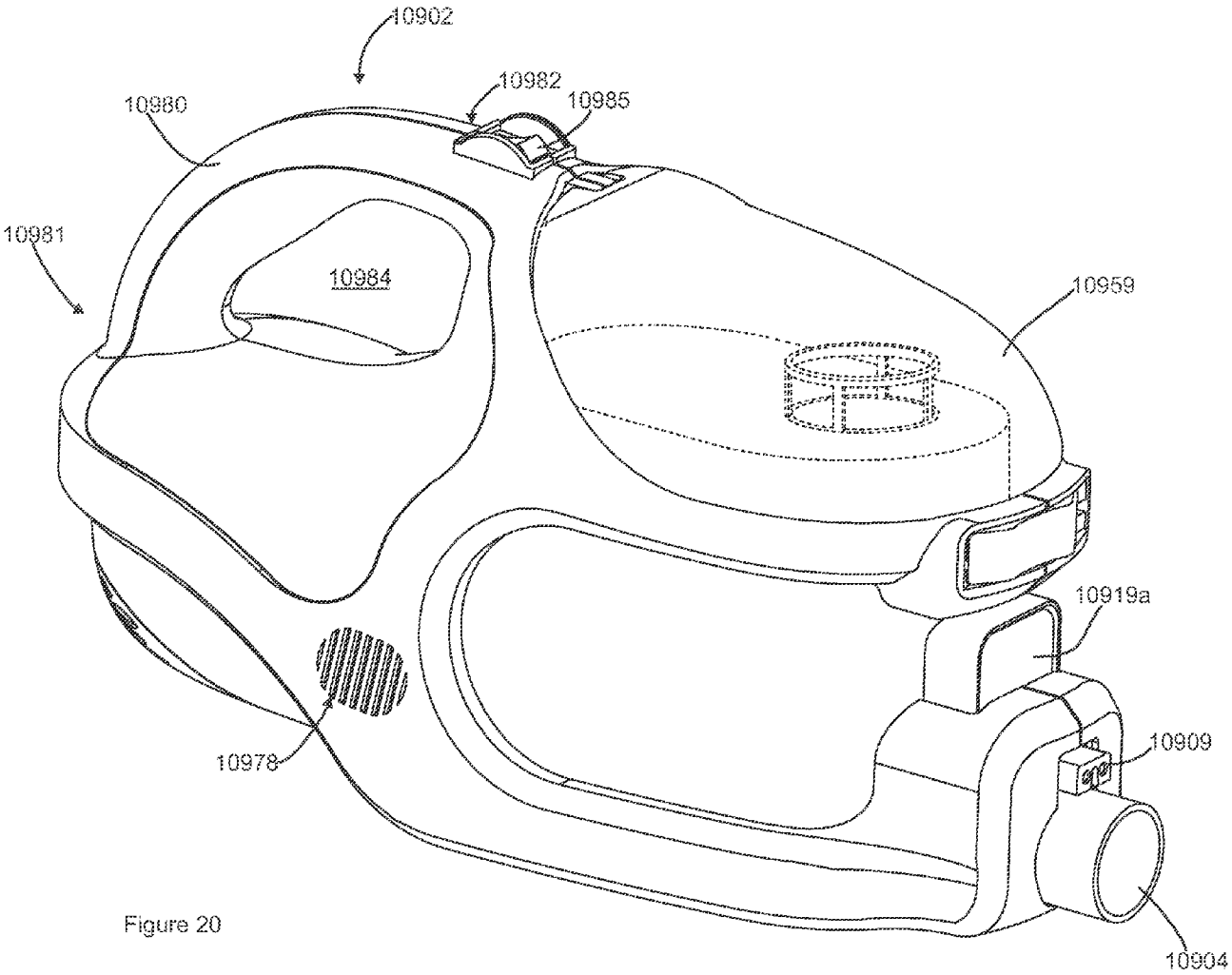
FIG. 20 is another perspective view from the rear of the surface cleaning apparatus of FIG. 19.

The connector 10906 may be any suitable connector that is operable to connect to, and preferably detachably connect to, a cleaning tool or other accessory. Optionally, in addition to provide an air flow connection, the connector may also include an electrical connection 10909 (FIG. 20). Providing an electrical connection 10909 may allow cleaning tools and accessories that are coupled to the connector 10906 to be powered by the surface cleaning apparatus 10900. For example, the surface cleaning unit 10900 can be used to provide both power and suction to a surface cleaning head, or other suitable tool. In the illustrated embodiment, the connector 10909 includes an electrical coupling in the form of a female socket member, and a corresponding male prong member may be provided on the cleaning tools and/or accessories. Providing the female socket on the electrified side of the electrical coupling may help prevent a user from inadvertently contacting the electrical contacts.

Figure 21:
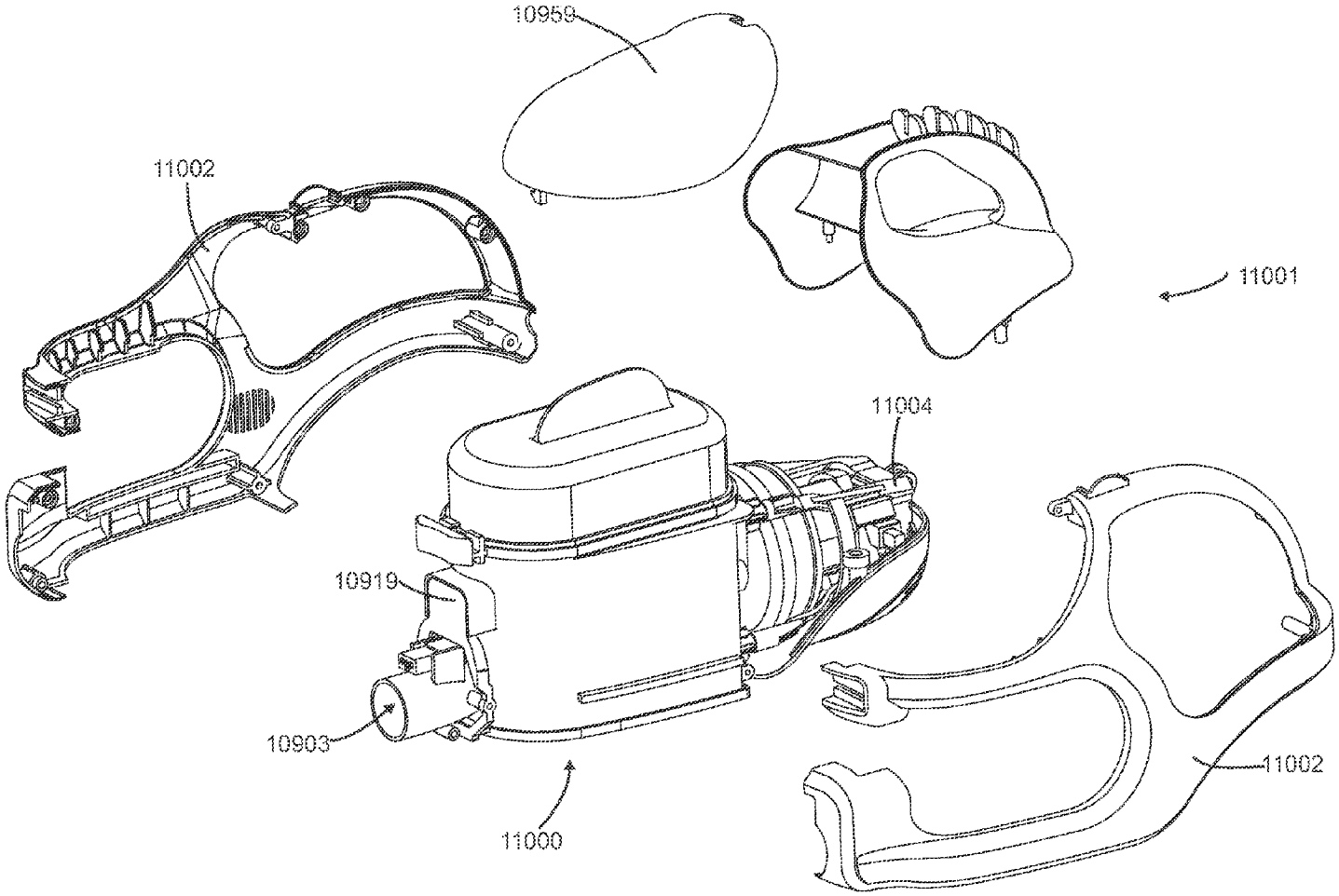
FIG. 21 is a partially exploded perspective view of the surface cleaning apparatus of FIG. 19.
Figure 22:
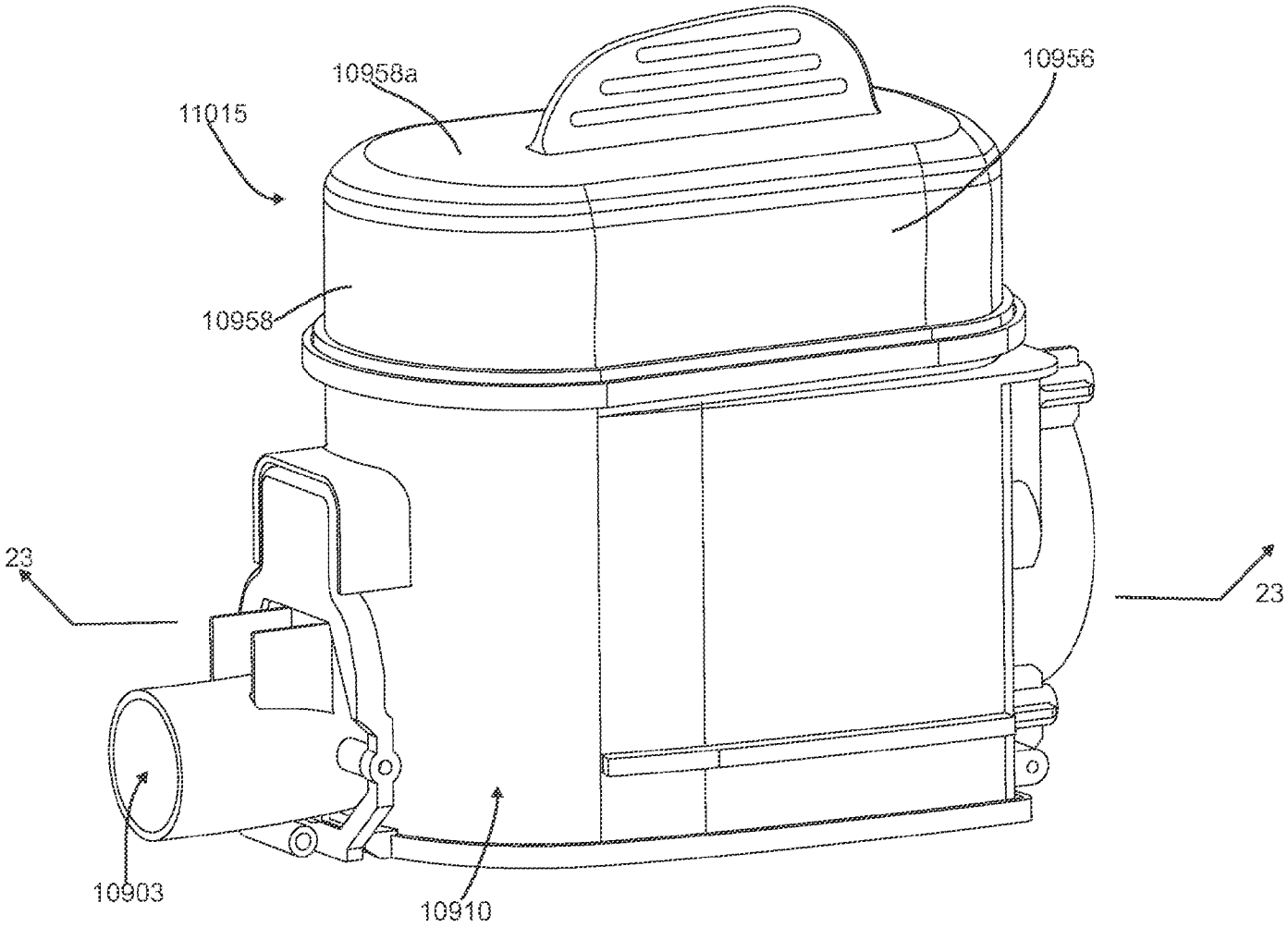
FIG. 22 is a perspective view of a portion of the surface cleaning apparatus of FIG. 19.

Referring to FIG. 21, a construction technique that may be used by itself or with any other feature disclosed herein is exemplified. In this embodiment, the main body portion 10901 of the surface cleaning apparatus includes a core cleaning unit 11000 and an outer shell 11001. In the illustrated example, the core cleaning unit 11000 is a generally, self-contained functional unit that includes the dirty air inlet 10903, air treatment member 10910, pre-motor filter chamber 10956, suction motor 10911 and clean air outlet 10904. The outer shell includes mating side panels 11002, the handle portion 11003 of the surface cleaning apparatus (including the primary power switch 10985) and an openable pre-motor filter chamber cover 10959. When the outer shell 11001 is assembled around the core cleaning unit 11000 the exposed outer surfaces of the surface cleaning apparatus 10900 are formed from a combination of portions of the core cleaning unit 11000 and the outer shell 11001. For example, the external suction motor housing 10912 and handle 10902 are provided by the outer shell 11001, whereas the shell is shaped so that portions of the cyclone bin assembly 10910 sidewalls remain visible in the assembled configuration. If these portions are at least partially transparent, they can allow a user to see into the dirt collection chamber 10914 to determine if the dirt collection chamber 10914 is getting full.

From the dirty air inlet 10903, the air flow path extends through the cyclone bin assembly 10910 which forms part of the main body of the surface cleaning apparatus. A suction motor 10911 (see FIG. 26) is mounted within a motor housing frame 11004 (FIG. 21) of the core cleaning unit 11000 and is in fluid communication with the cyclone bin assembly 10910. In this configuration, the suction motor 10911 is downstream from the cyclone bin assembly 10910 and the clean air outlet 10904 is downstream from the suction motor 10911.

Figure 23:
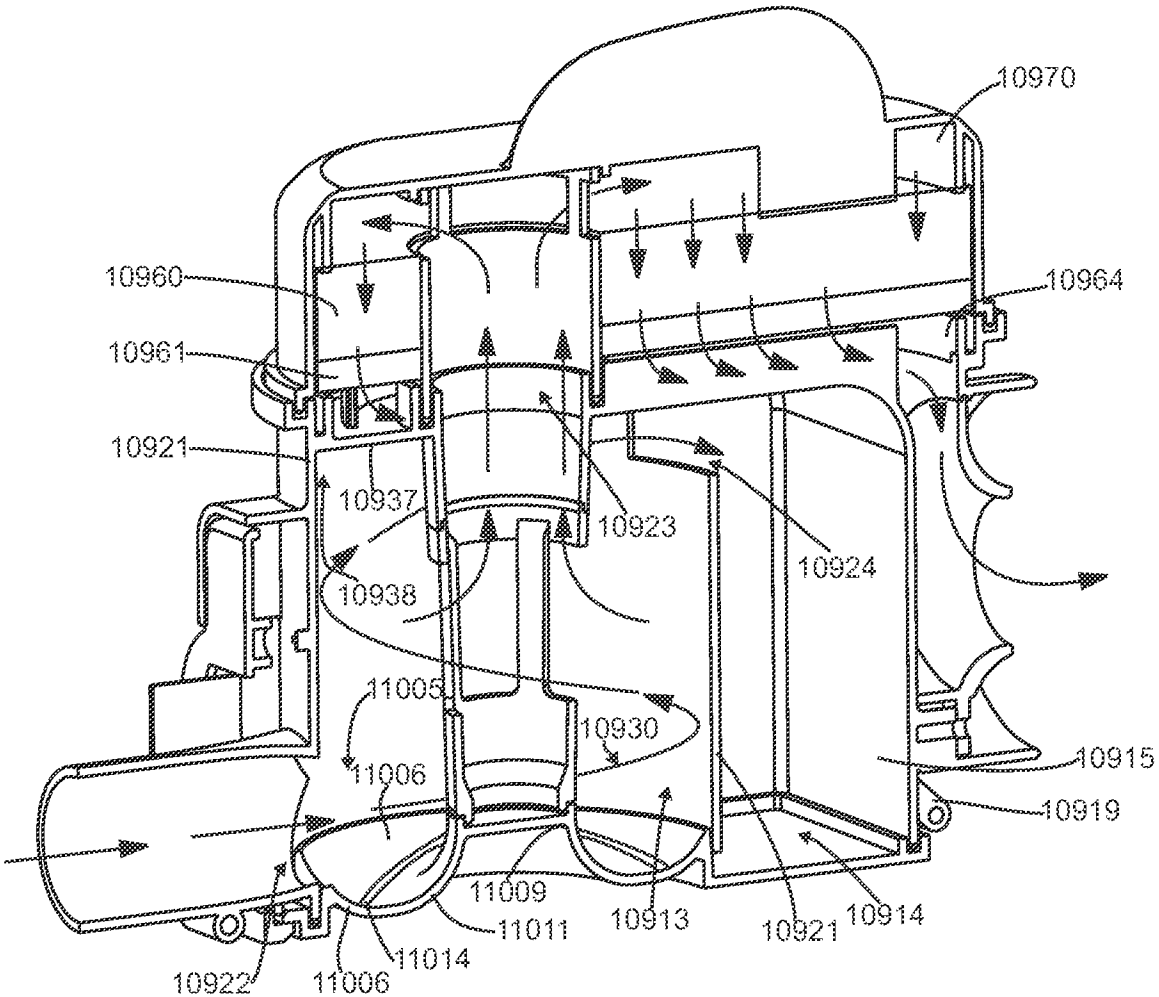
FIG. 23 is a cross sectional view of the FIG. 22, taken along line 23-23 in FIG. 22.
Figure 24:
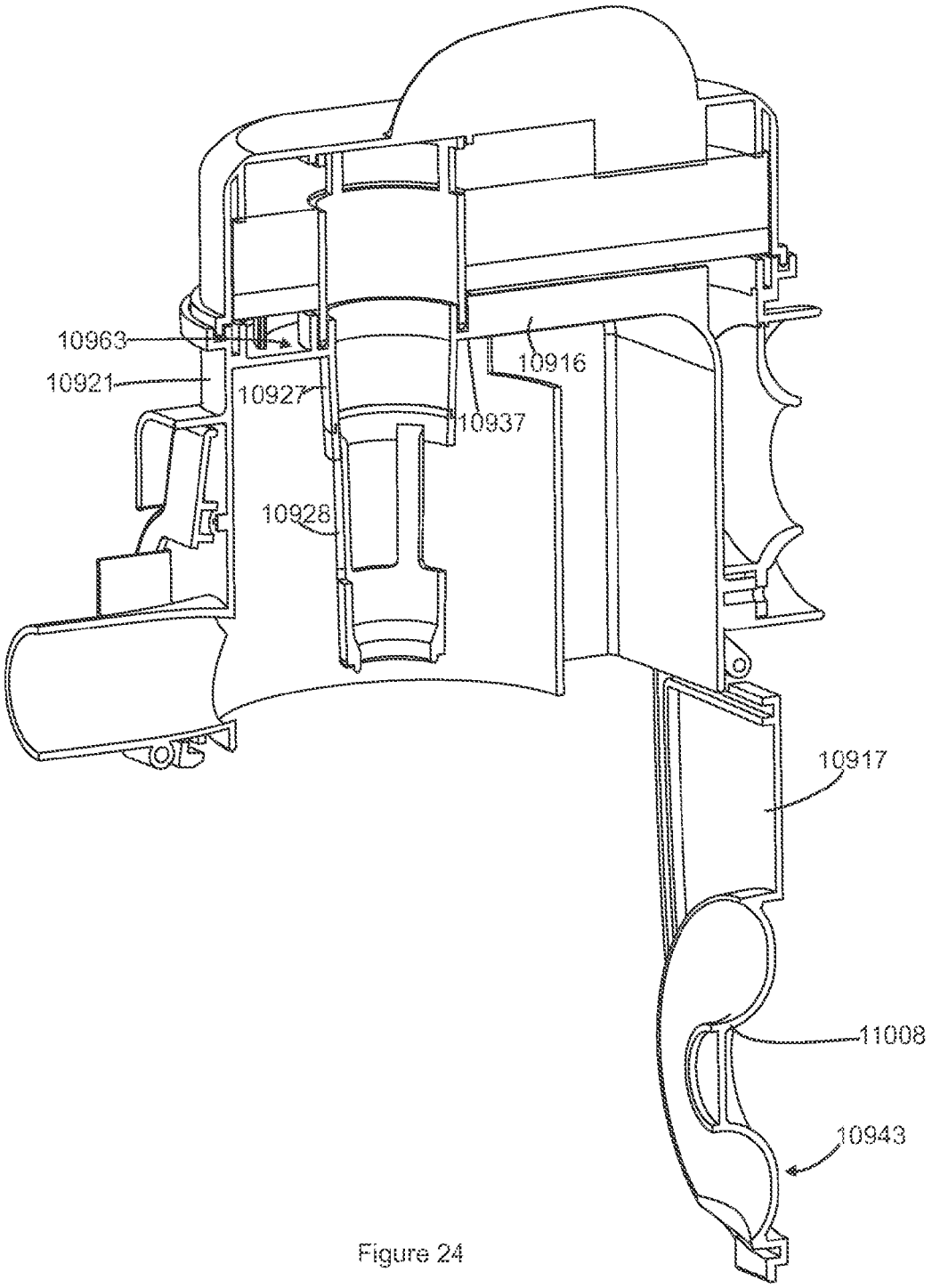
FIG. 24 is the cross sectional view of FIG. 23 with a bottom door in an open position.
Figure 25:
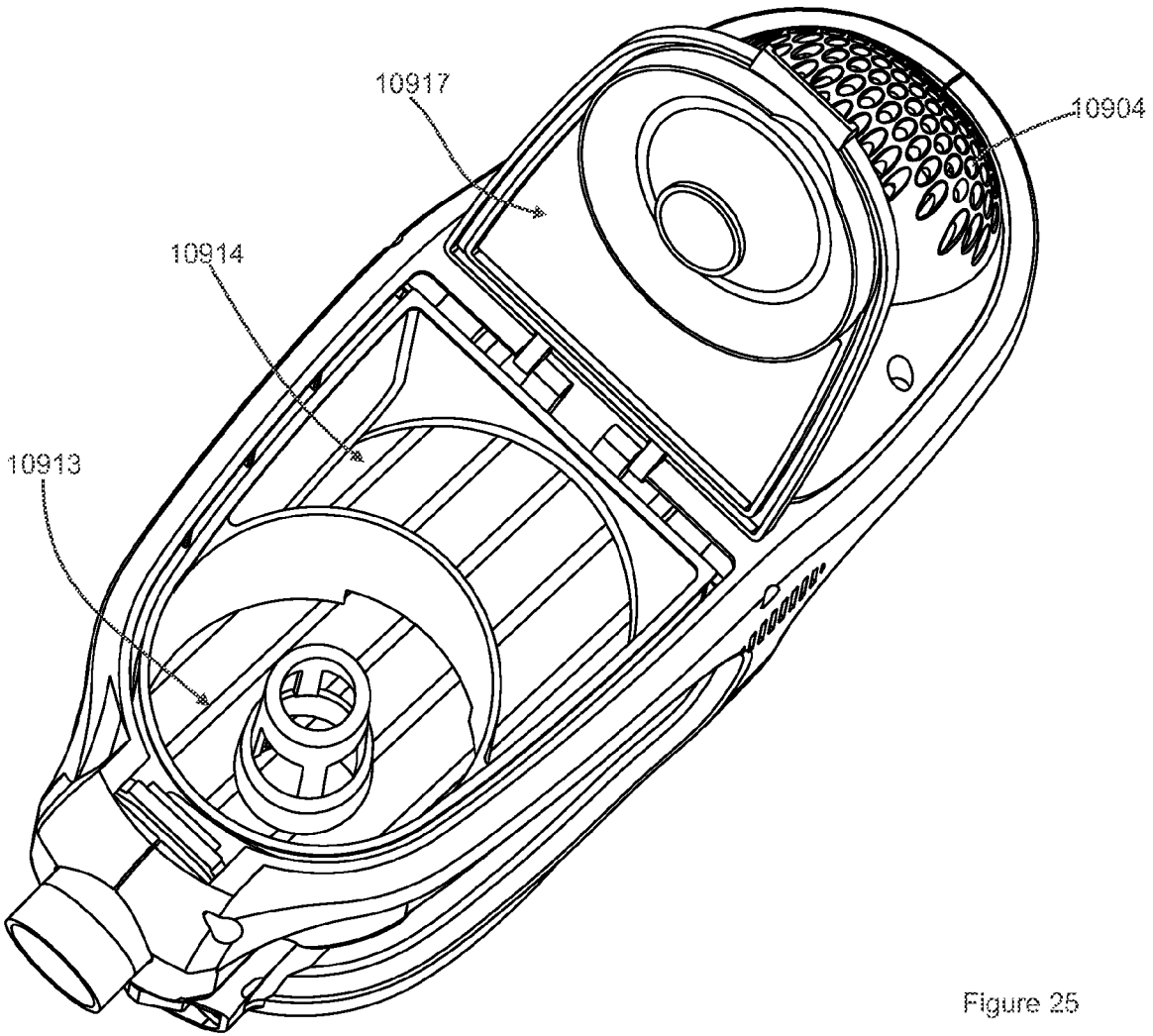
FIG. 25 is a bottom perspective view of the surface cleaning apparatus of FIG. 19.
Figure 26:
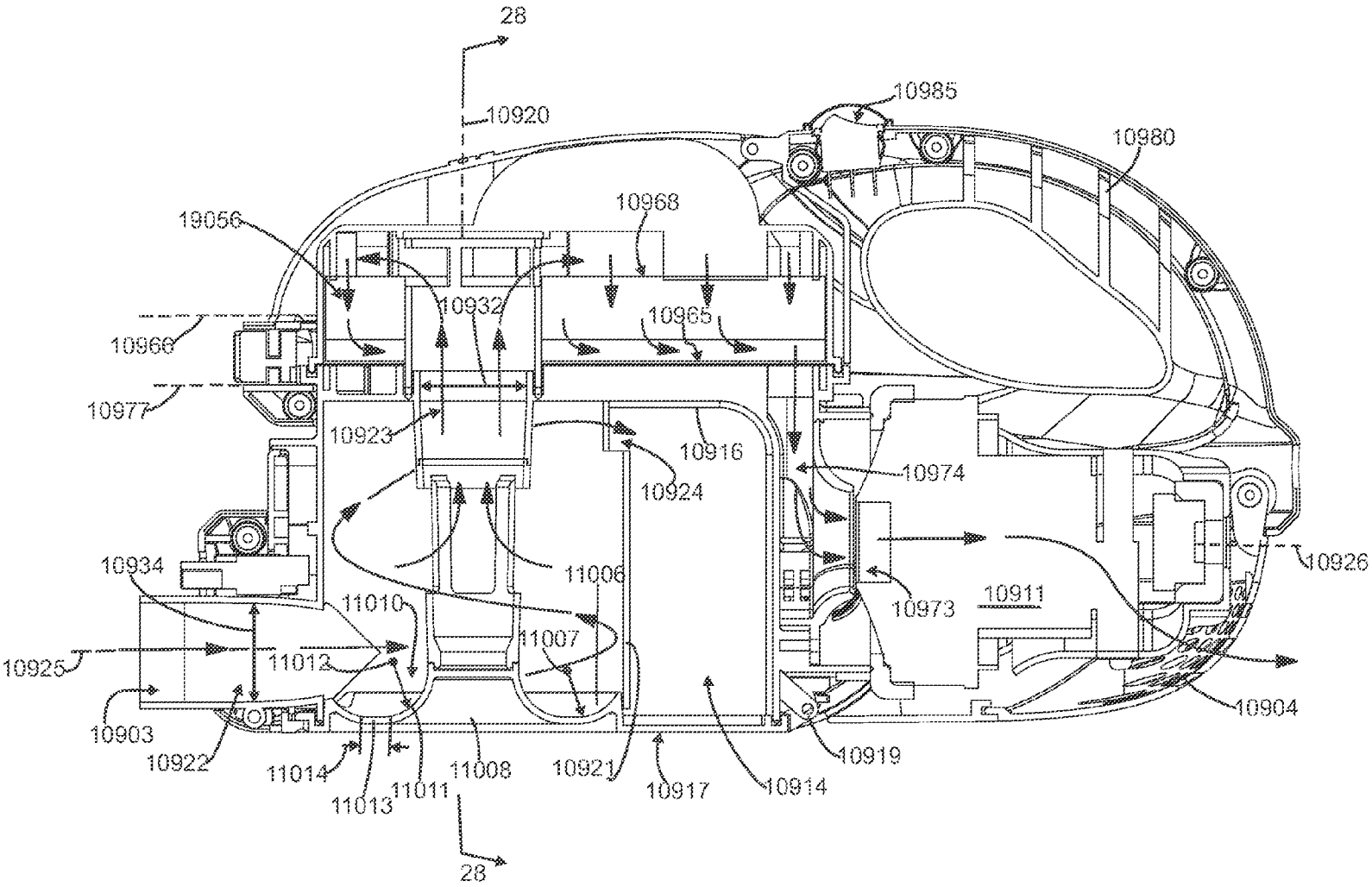
FIG. 26 is a cross sectional view of the surface cleaning apparatus of FIG. 19, taken along line 26-26 in FIG. 19.

Referring to FIGS. 23 and 26, a uniflow cyclone and/or a cyclone with rounded junctures, and/or a cyclone with an insert member any of which may be used by itself or with any other feature disclosed herein is exemplified. In the illustrated embodiment, the cyclone bin assembly 10901 includes a cyclone chamber 10913 and a dirt collection chamber 10914. The dirt collection chamber 10914 comprises a sidewall 10915, a first end wall 10916 and an opposing second end wall 10917. The dirt collection chamber 10914 may be emptyable by any means known in the art and is preferably openable concurrently with the cyclone chamber 10913. Preferably, the second dirt collection chamber end wall 10917 is pivotally connected to the dirt collection chamber sidewall by hinge 10919. The second dirt collection chamber end wall 10913 functions as an openable door to empty the dirt collection chamber 10914 and can be opened (FIGS. 24 and 25) to empty dirt and debris from the interior of the dirt collection chamber 10914. The second dirt collection chamber end wall 10917 can be retained in the closed position by any means known in the art, such as by a releasable latch 10919*a*. In the illustrated example, the hinge 10919 is provided on a back edge of the end wall 10917 and the latch 10919*a* is provided at the front of the end wall 10917 so that the door swings backwardly when opened. Alternatively, the hinge 10919 and latch 10919*a* may be in different positions, and the door 10917 may open in a different direction or manner. Optionally, instead of being openable, the end wall 10917 may be removable.

In the embodiment shown, the cyclone chamber 10913 extends along a cyclone axis 10920 and is bounded by a sidewall 10921. The cyclone chamber 10913 includes an air inlet 10922 and an air outlet 10923 that is in fluid connection downstream from the air inlet 10922 and one dirt outlet 10924 in communication with the dirt collection chamber 10914. In this embodiment, the dirt collection chamber 10914 is positioned adjacent the cyclone chamber 10913 and at least partially surrounds the cyclone chamber 10913 in a side-by-side configuration.

Preferably, the air inlet 10922 is generally tangentially oriented relative to the sidewall 10921, so that air entering the cyclone chamber will tend to swirl and circulate within the cyclone chamber 10913, thereby dis-entraining dirt and debris from the air flow, before leaving the chamber via the air outlet 10923. The air inlet 10922 extends along an inlet axis 10925 that is generally perpendicular to the cyclone axis 10920, and in the illustrated example is generally parallel to and offset above the suction motor axis 10926.

In the illustrated example, the cyclone air outlet 10923 includes a vortex finder 10927. Optionally, a screen 10928 can be positioned over the vortex finder 10927 to help filter lint, fluff and other fine debris. Preferably, the screen 10928 can be removable.

The air inlet 10922 has an inlet diameter 10934, and a related inlet flow cross-sectional area (measure in a plane perpendicular to the inlet axis). Preferably, the air outlet 10923 is sized so that the diameter 10932 of the air outlet 10923, and therefore the corresponding flow area of the air outlet 10923, is the same as the diameter of the air inlet. Alternatively, the air outlet diameter 10932 may be between about 50% and about 150%, and between about 85-115% of the air inlet diameter 10925.

In the example illustrated the cyclone bin assembly 10910, and the cyclone chamber 10913 are arranged in a generally vertical, uniflow cyclone configuration. In a uniflow cyclone, the air inlet is located toward one end of the cyclone chamber and the air outlet is provided toward the other end of the cyclone chamber. In this configuration, air enters one end of the cyclone chamber and generally exits via the other end of the cyclone chamber, as opposed to the cyclone chamber illustrated in the embodiment of FIGS. 1 to 18, in which air enters and exits the cyclone chamber via the same end. In the illustrated example, the air inlet 10922 is provided toward the lower end of the cyclone chamber 10913 and the air outlet 10923 is provided toward the upper end of the cyclone chamber 10913, such that air flows into the bottom of the cyclone chamber 10913 and exits at the top of the cyclone chamber 10913. Alternatively, the locations of the air inlet and outlet can be reversed.

Optionally, instead of a vertical configuration, the cyclone bin assembly 10910 and cyclone chamber 10913 can be provided in another orientation, including, for example, as a horizontal cyclone.

Optionally, some or all of the cyclone sidewall 10921 can coincide with portions of the external sidewalls of the cyclone bin assembly 10910 and the dirt collection chamber sidewall 10915. Referring to FIG. 23, in the illustrated embodiment the front portion of the cyclone chamber sidewall 10921 is coincident with the outer sidewall of the cyclone bin assembly 10910, and the rear portion of the cyclone sidewall 10921 helps separate the cyclone chamber 10913 from the dirt collection chamber 10914. This may help reduce the overall size of the cyclone bin assembly 10910. Alternative, the sidewall 10921 may be distinct from the sidewalls 10915. In alternative embodiments, the cyclone chamber 10913 may include only two dirt outlets 10924, or more than two dirt outlets.

In the illustrated embodiment, the cyclone chamber 10913 includes a first or upper end wall 10937 (FIG. 23) and a second or lower end wall 10943. The upper end wall 10937 is connected to the upper end of the sidewall 10921. In the illustrated example, a juncture 10938 between the end wall 10937 and the side wall 10921 is a relatively sharp corner that does not include any type of angled or radiused surface. In contrast, the lower end wall 10943 meets the lower end of the cyclone sidewall 10921 at a juncture 11005 that includes a curved juncture surface 11006 (see also FIG. 27). The radius 11007 of the curved surface 11006 may be selected based on the radius of the air inlet (e.g. half of the diameter 10934), and optionally may be the selected so that the juncture surface 11006 has the same radius as the air inlet 10922.

The curved juncture surface can be provided as a portion of the sidewall or as a portion of the endwall. In the illustrated embodiment, the curved juncture surface 11006 is provided as part of an insert member 11008 that is provided on the bottom end wall and extends upward into the interior of the cyclone chamber 10913. The insert member also includes an upwardly extending projection member 11009 that extends into the interior of the cyclone chamber and engages the distal end 10930 of the screen (FIG. 23). Together, the vortex finder 10927, screen 10928 and projection member 11009 form a generally continuous internal column member that extends between the first and second end walls 10937 and 10943 of the cyclone chamber 10910. Providing the projection member 11009 may help direct air flow within the cyclone chamber, and may help support and/or stabilize the distal end 10930 of the screen 10928.

Optionally, the juncture 11010 between the end wall 10943 and the projection member 11009 may include a curved surface 11011 (see FIGS. 23 and 26), and preferably is sized so that the surface 11011 has a radius 11012 that is the same as radius 11007. Providing curved surfaces 11006 and 11011 at the junctures between the end wall 10943 and the sidewall 10921, may help reduce backpressure and may help improve cyclone efficiency. Preferably, the two curved juncture surfaces 11006 and 11011 are separated by a generally flat, planar transition surface 11013, having a width 11014. Providing a flat transition surface 11013 may help improve air flow, and/or reduce back pressure to help improve cyclone efficiency.

In the illustrated embodiment, the second end wall 10943 of the cyclone chamber 10913, and the insert member 11008 provided thereon, is integral with the openable bottom door 10917 that provides the bottom wall of the dirt collection chamber 10914. In this configuration, opening the door simultaneously opens the cyclone chamber 10913 and the dirt collection chamber 10914 (see for example FIGS. 24 and 25) for emptying.

In the illustrated embodiment, the dirt outlet 10924 is in the form of a slot having bottom and side edges provided by the cyclone chamber sidewall 10921, and a top edge provided by the upper end wall 10937. Alternatively, all four edges of the slot 10924 may be provided by the cyclone chamber sidewall 10921. The dirt slot 10924 is positioned at the back of the cyclone chamber 10921 and is generally opposite the air inlet 10922. In the illustrated embodiment, the upper wall 10937 of the cyclone chamber is integral with the upper wall 10916 (FIGS. 23 and 26) of the dirt collection chamber 10914.

Optionally, one or more pre-motor filters may be placed in the air flow path between the cyclone bin assembly 10910 and the suction motor 10911. Alternatively, or in addition, one or more post-motor filters may be provided downstream from the suction motor.

Figure 27:
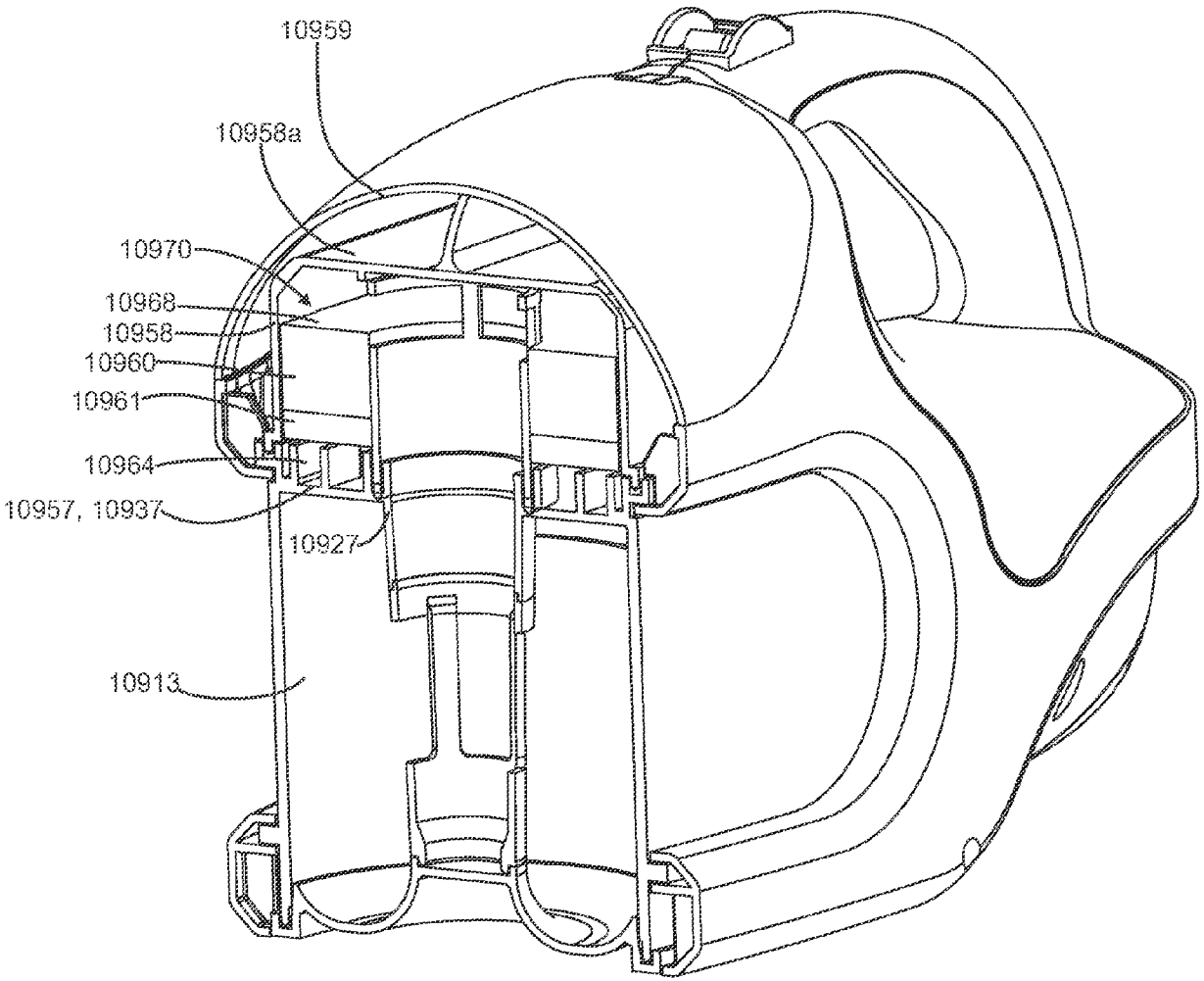
FIG. 27 is a cross sectional view taken along line 27-27 in FIG. 19.
Figure 28:
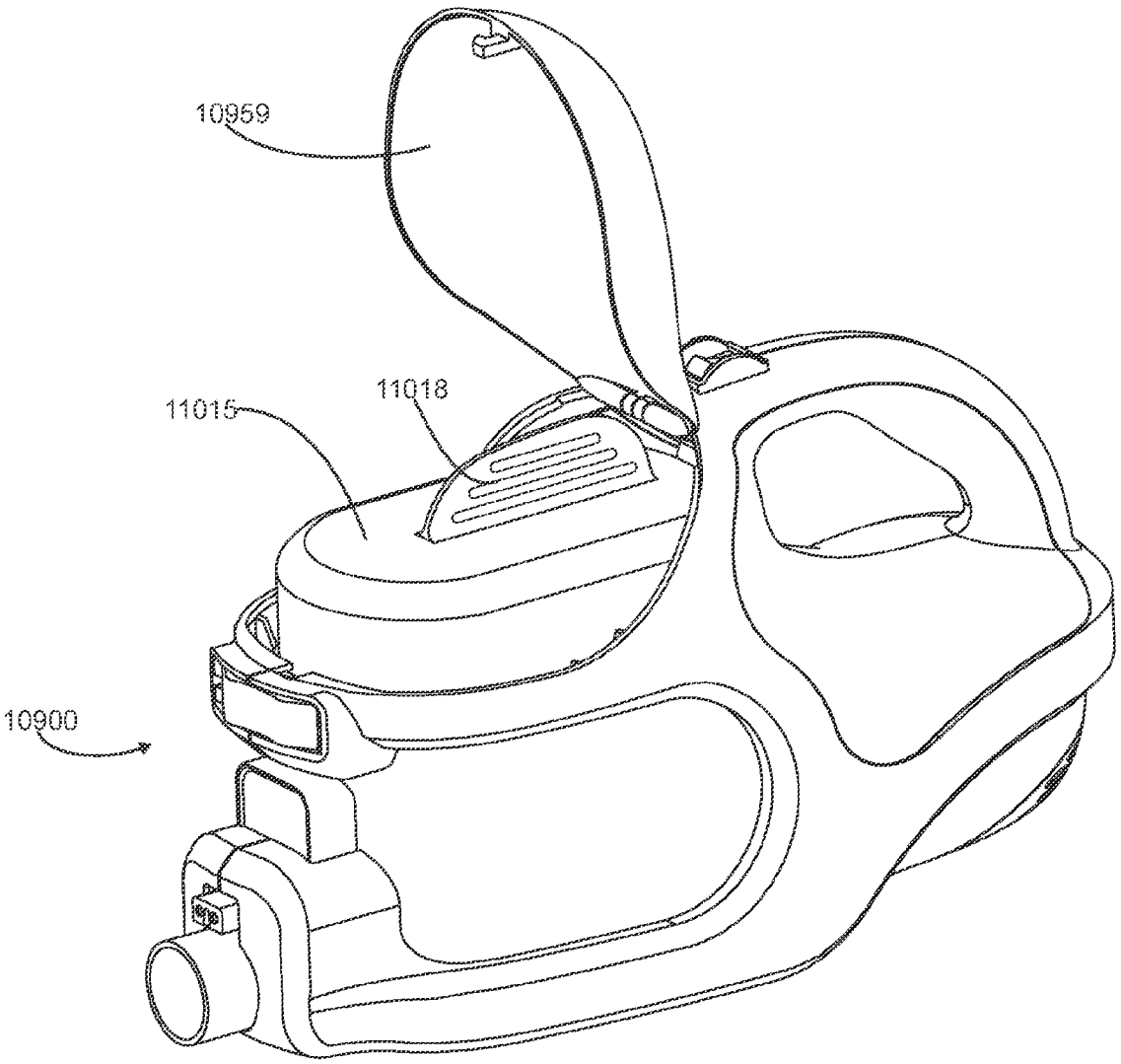
FIG. 28 is a perspective view of the surface cleaning apparatus of FIG. 19 with a cover open.
Figure 29:
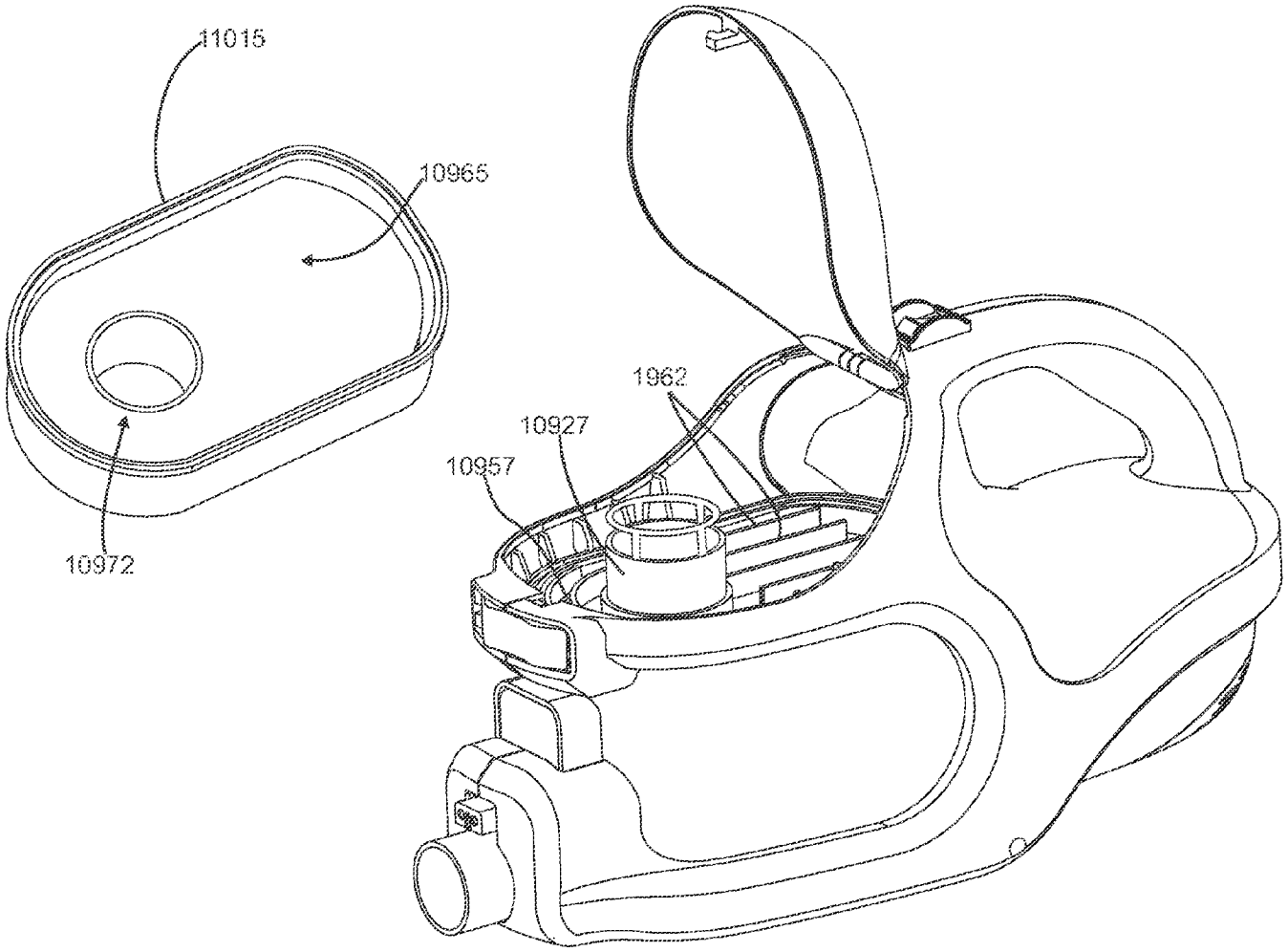
FIG. 29 is the perspective view of FIG. 28 with a filter cartridge removed.
Figure 30:
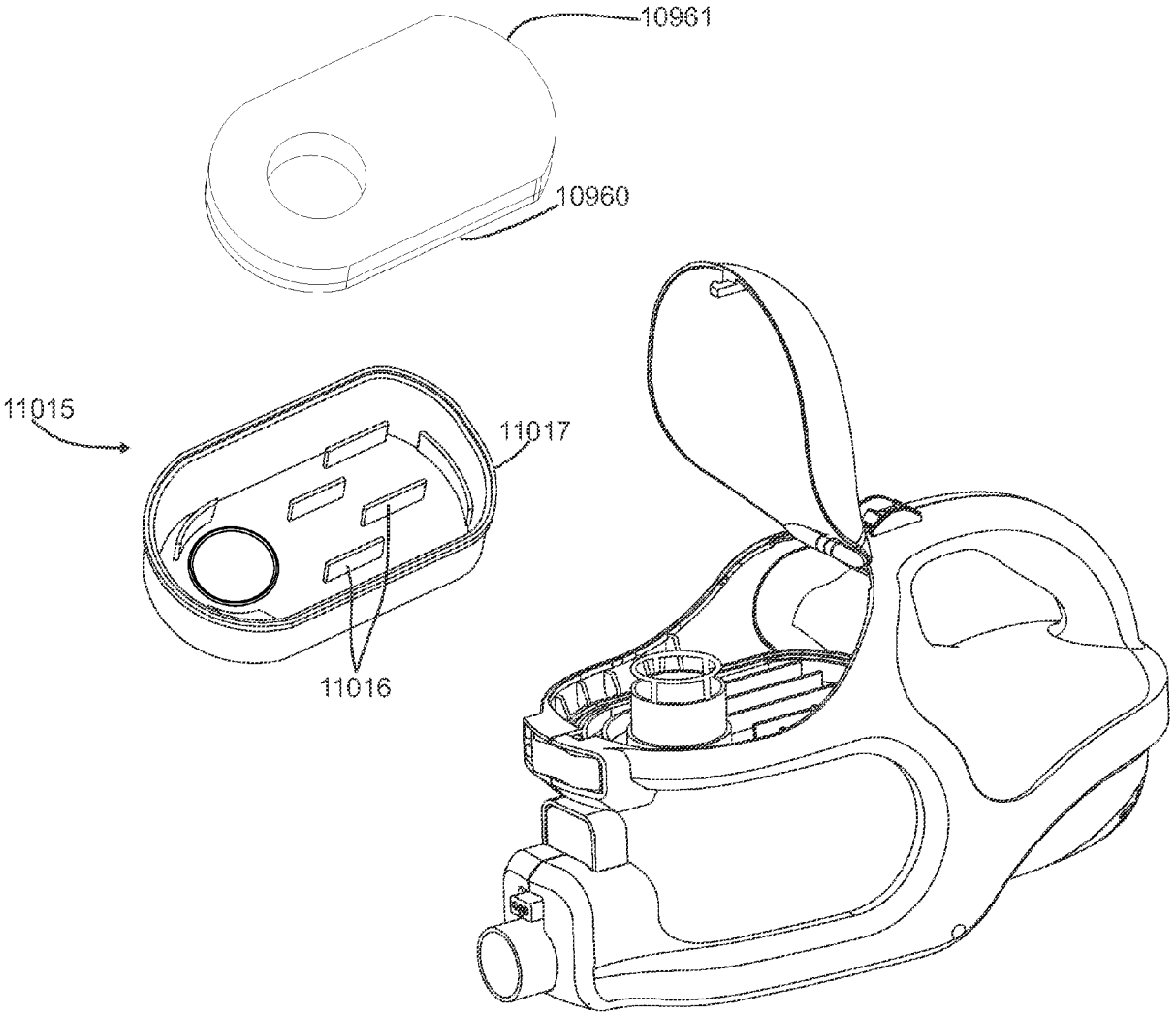
FIG. 30 is the perspective view of FIG. 29 with a filter removed from the filter cartridge.

Referring to FIG. 27, a filter housing construction that may be used by itself or with any other feature disclosed herein is exemplified. In the illustrated embodiment a pre-motor filter chamber or housing 10956 is provided between the upper walls 10937, 10916 of the cyclone 10913 and dirt collection chambers 10914 and the openable cover 10959. In this configuration, the bottom wall 10957 of the pre-motor filter chamber 10956 is integral with the upper walls 10937, 10916 of the cyclone 10913 and dirt collection chambers 10914, and the upper wall 10958*a* and sidewall 10958 of the pre-motor filter chamber 10956 are provided via a filter cartridge housing 11015 (see also FIG. 28). The filter cartridge housing 11015 is separate from the openable cover 10959. One or more filters may be positioned within the pre-motor filter chamber to filter fine particles from the air stream exiting the air outlet, before it flows into inlet of the suction motor. The filters may be of any suitable configuration and formed from any suitable materials. In the illustrated embodiment, a foam filter 10960 and a felt filter 10961 (FIG. 30) are positioned within the pre-motor filter chamber 10956.

Referring to FIGS. 27-30, the filter cartridge is a generally dome shaped member that includes a upper wall 10958*a* and a sidewall 10958 extending downwardly from the upper wall to surround the pre-motor filters 10960, 10961. The pre-motor filters 10960, 10961 are shaped to fit within the cartridge member 11015, and when inserted within the cartridge member (FIG. 29) the downstream side 10965 of the felt filter 10961 forms the bottom surface of the filter cartridge 11015. When the filter cartridge 11015 is inserted in its use position (FIG. 28) the downstream side 10965 of the pre-motor filter rests on the support ribs 10962 (see FIG. 29) on the bottom wall 10957, and the downstream headspace 10964 (FIG. 27) is defined between the downstream side 10965 of the filter 10961 and the bottom wall 10957.

In this embodiment, the upstream headspace 10970 (FIG. 27) is provided between the upstream side 10968 of the pre-motor filter 10960 and the upper wall 10958*a* of the cartridge housing 11015 (instead of being formed by the cover 10959). To provide air into the upstream headspace 1970, the vortex finder 10927 projects upwardly from the bottom wall 10957 and the filters 10960 and 10961 are provided with a corresponding aperture 10972 to receive the vortex finder 10927. Preferably, a plurality of spacing ribs 11016 (FIG. 30) are provided on the inner surface of the upper wall 10958*a* to keep the upstream surface 10968 of the filter 10960 spaced apart from the inner surface of the upper wall 10958*a* to maintain the upstream headspace 10970.

The lower rim 11017 of the filter cartridge 11015 housing is configured to seal against the bottom wall 10957 (for example via snap fit or by using any type of suitable gasket or sealing member) to provide a generally air tight pre-motor filter chamber 10956. The sealed chamber 10956 is then covered by openable chamber cover 10959. As the filter cartridge housing 11015 provides a sufficiently air tight connection to the bottom wall, the chamber cover 10959 need not be air tight. Preferably, at least a portion of both the chamber cover 10959 and the filter cartridge 11015 housing is transparent so that a user can inspect the upstream side 10968 of the pre-motor filter 10960 without having to remove it from the chamber 10956. Optionally, both the chamber cover 10959 and filter cartridge housing 11015 may be formed from transparent plastic.

When a user wishes to remove, clean, change or otherwise access the pre-motor filter 10960, 10961 he/she may open the chamber cover 10959 (FIG. 30) to expose the filter cartridge housing 11015. The user may then detach the filter cartridge housing 11015 and separate it from the bottom wall 10957. Preferably, the pre-motor filters 10960, 10961 are snugly received within the filter cartridge housing 11015 (or otherwise retained therein) so that the filters 10960, 10961 are removed with the filter cartridge housing 11015 and remain inside the filter cartridge housing 11015 until removed by a user. In this embodiment, the dirty, upstream side 10968 of the filter 10960 remains enclosed by the filter cartridge housing 11015 when separated from the core cleaning unit 11000, and only the relatively clearer downstream side 10965 of the filter 10961 is exposed. This may help prevent dirt on the upstream side 10968 of the filter 10960 from spilling or from otherwise contacting the user. When at a desired location, for example at a trash receptacle or a sink, a user can grasp the clean, downstream side 10965 of the filter and remove it from the filter cartridge housing 11015. The upstream side 10968 of the filter can then be cleaned and inspected as desired.

To assist a user, the upper side 1958*a* of the filter cartridge housing 11015 may be provided with a grip member, for example the flange 11018 in the illustrated embodiment (FIG. 28), which may allow a user to firmly grasp and manipulate the filter cartridge housing 11015. The grip member 11018 may be of any suitable configuration and optionally may be provided on other portions of the filter cartridge housing (for example as a ridge or groove in the sidewall). Alternatively, the filter cartridge housing 11015 need not include a separate grip member.

To help reduce the overall size of the surface cleaning apparatus, in the illustrated embodiment the pre-motor filter chamber 10956, and the filters therein, is positioned above the cyclone chamber 10913 and covers the upper end of the cyclone chamber 10913. In this configuration, a plane 10966 (FIG. 26) containing the foam filter 10960 is generally parallel and spaced above a plane 10977 containing the air outlet 10923 of the cyclone chamber 10913, and both planes 10966, 10967 are generally perpendicular to the cyclone axis 10920. Arranging the filters 10960, 10961 in this configuration results in the upstream side of the pre-motor filter (in this example the upper side 10968 of the foam filter 10960) being spaced further apart from the cyclone chamber 10913 than the downstream side of the pre-motor filter (in this example the lower surface 10965 of the felt filter 10961). Alternatively, in other embodiments, the pre-motor filter chamber 10956 may cover only a portion of the upper end of the cyclone chamber and/or may be laterally spaced apart from the cyclone chamber.

When the surface cleaning apparatus is in use, air exiting the cyclone chamber 10913 can flow into the upstream head space 10970 via the vortex finder 10927. Within the upstream headspace 10970 the air can flow laterally across the upstream surface 10968 of the foam filter 10960, and down through the filters into the downstream head space 10964. From the downstream head space 10964, the air can flow to the inlet 10973 of the suction motor via an internal air conduit 10974 (FIG. 26) formed within the body 10901. In the illustrated embodiment, the internal air conduit 10974 is formed within the main body 10901 and is external the cyclone chamber 10913 and the dirt collection chamber 10914 and is partially bounded by an exterior surface exterior surface of the dirt collection chamber sidewall 10915. The air conduit 10974 extends generally vertically between the pre-motor filter chamber 10956 and the suction motor 10911, and is positioned laterally intermediate the suction motor 10911 and the cyclone chamber 10913. The suction motor 10911 is positioned at an elevation where its air inlet 10973 is vertically between the upper and lower ends of the cyclone chamber 10913, and the motor axis passes 10926 through the cyclone chamber 10913 and the dirt collection chamber 10914.

Figure 33:
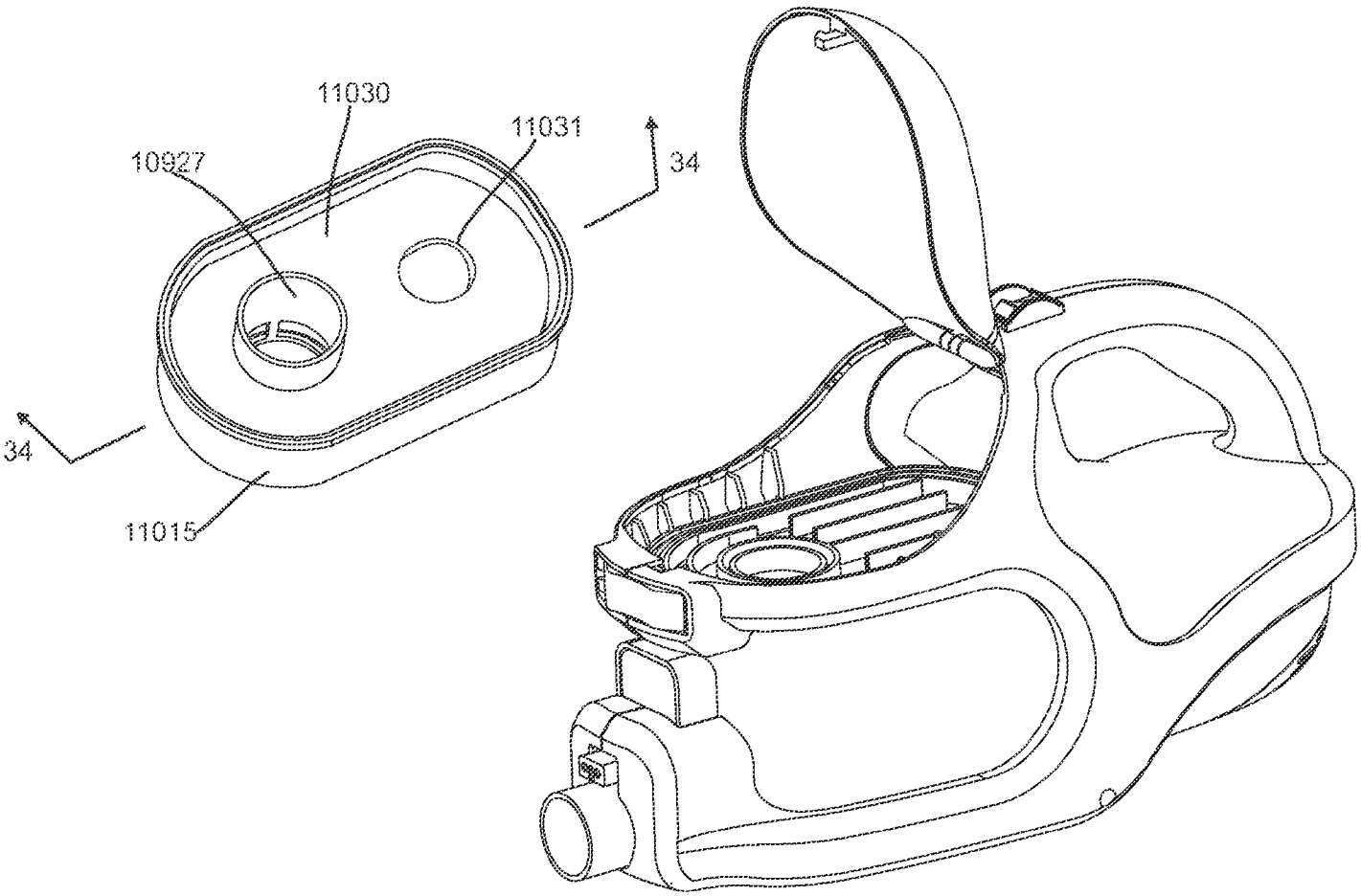
FIG. 33 is the perspective view of FIG. 29 with a different embodiment of a filter cartridge; and, FIG. 34 is a cross sectional view of the filter cartridge taken along line 34-34 in FIG. 33 with the filter cartridge in the surface cleaning apparatus.
Figure 34:
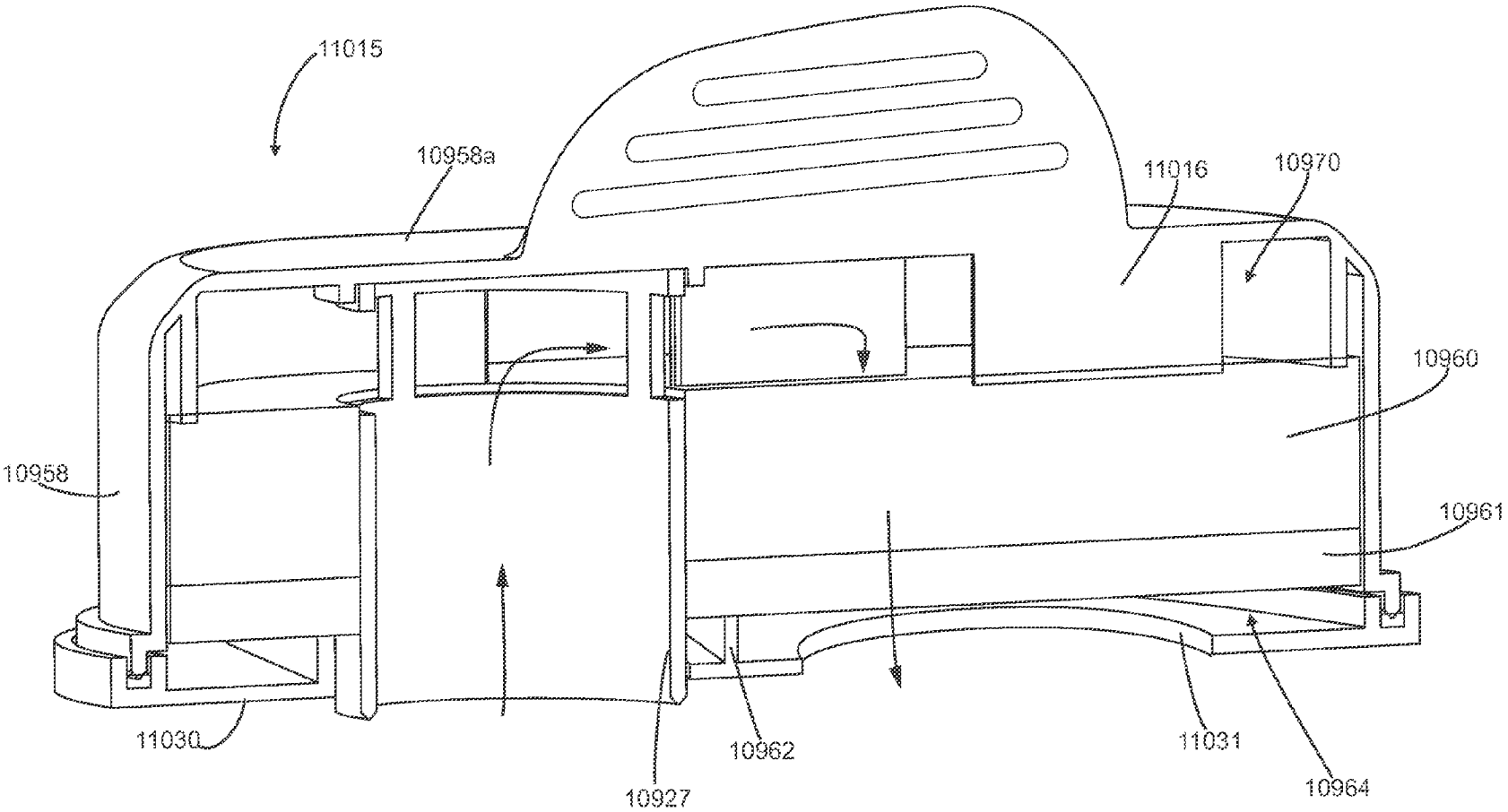

Optionally, the cartridge member 11015 can be provided with a bottom cover 11030 to encase the filters 10960 and 10961 and to provide a self-contained pre-motor filter chamber 10956. Referring to FIGS. 33 and 34, in such a configuration, the bottom cover 11030 may provide the bottom wall 10957 of the pre-motor filter chamber 10956, and may be provided with internal ribs 10962 to support the filters 10960, 10961 and to provide the downstream headspace 10964. An outlet port 11031 provided in the bottom cover 11030 allows air to exit the cartridge enclosure 11015 and flow into conduit 10974. Providing a sealed cartridge may help further contain dirt within the cartridge prior to emptying, and may help keep the filters 10960 and 10961 in position.

Referring to FIG. 20, in the illustrated embodiment, handle 10902 has a first or bottom end 10981 that is adjacent the suction motor housing 10912, a second or upper end 10982 that is spaced above from the lower end 1981 and a grip portion 10980 extending therebetween. When grasping the hand grip portion 10980, a user's fingers may pass through an opening 10984.

Figure 31:
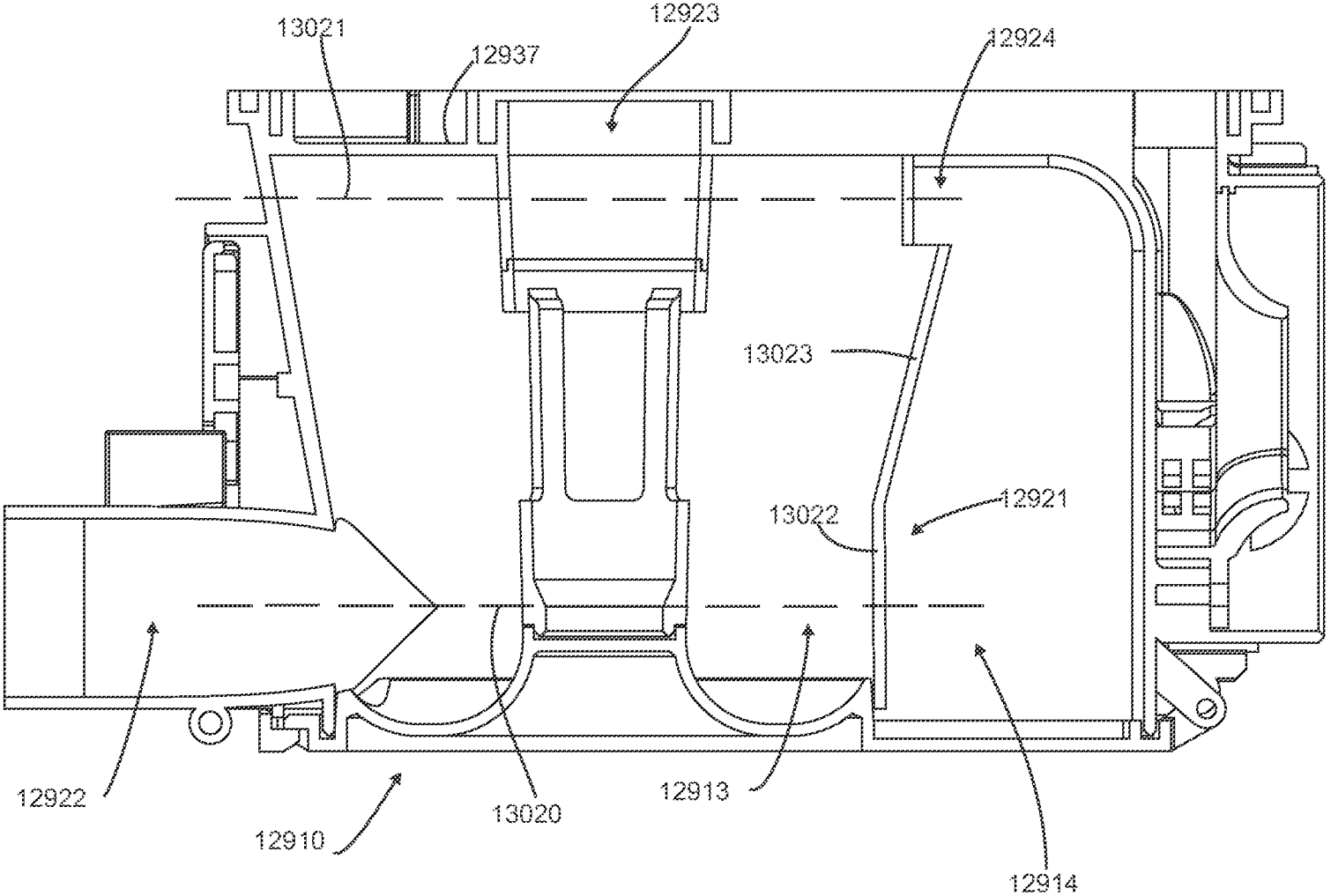
FIG. 31 is a cross sectional view of a portion of another embodiment of a surface cleaning apparatus.

Referring to FIG. 31, a sectional view of an alternate embodiment cyclone bin assembly portion 12910 of a core cleaning unit 13000 that may be used by itself or with any other feature disclosed herein is exemplified. The cyclone bin assembly 12910 is similar to bin assembly 10910, and like features are identified using like reference numerals indexed by 2000. The cyclone bin assembly 12910 is illustrated in isolation with the outer shell, filter cartridge member and the suction motor removed. In this embodiment the cyclone chamber 12913 is flared such that the cross-sectional area taken in a plane 13020 that passes through the air inlet 12922 (toward the bottom of the cyclone chamber 12913) is smaller than the cross-sectional area taken in a plane 13021 that passes through the dirt outlet 12924, and is smaller than the cross-section area of the upper end wall 12937 of the cyclone chamber 12913 (which includes the air outlet 12923). In this configuration, the cyclone chamber sidewall 12921 includes a vertical portion 13022 and a generally frusto-conical portion 13023 positioned above the vertical portion 13022. In this embodiment the volume of the cyclone chamber 12913 increases toward the top to the cyclone chamber, which may help improve cyclone efficiency and/or may help dis-entrained dirt exit via the dirt outlet.

Figure 32:
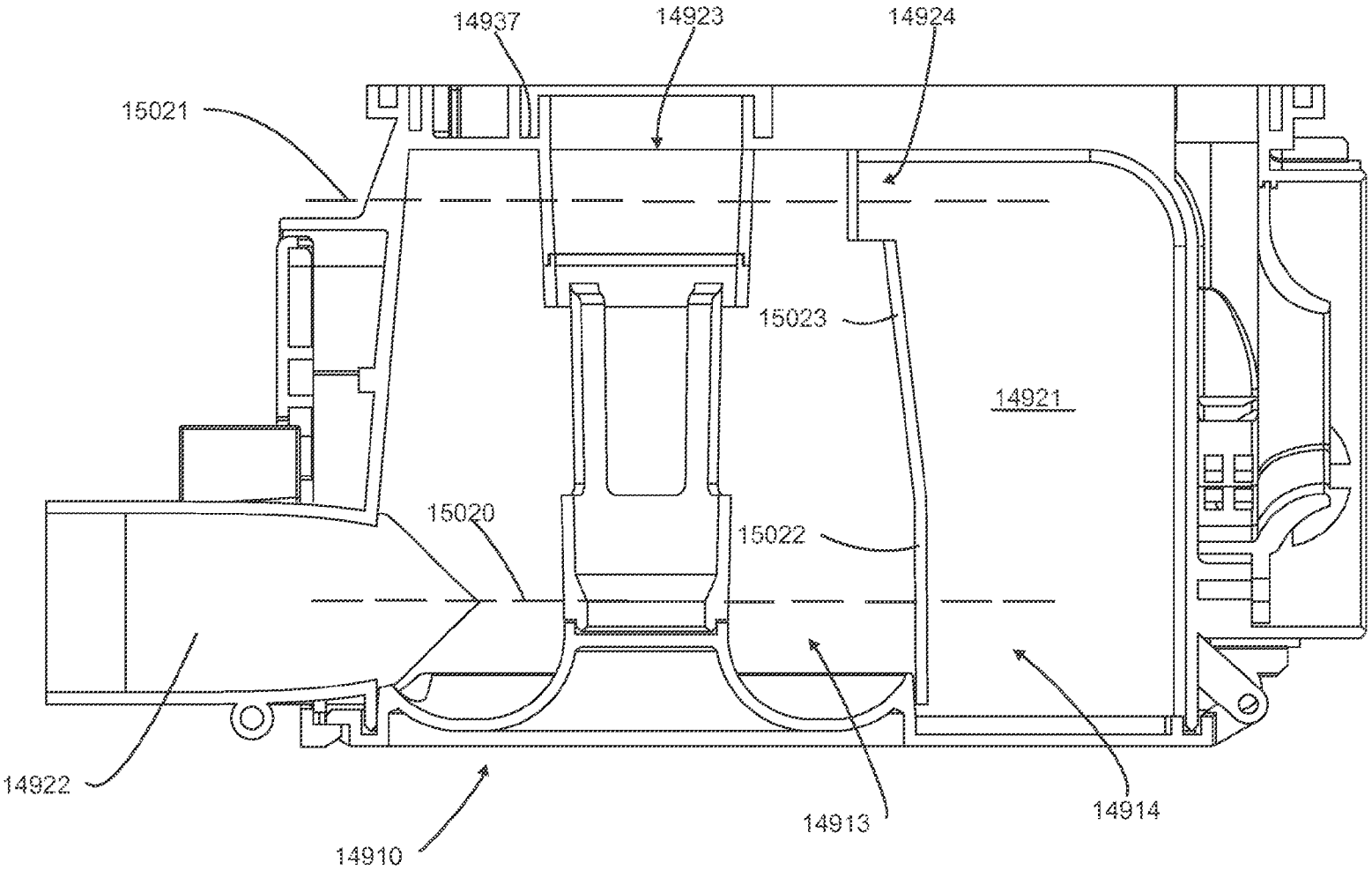
FIG. 32 is a cross sectional view of a portion of another embodiment of a surface cleaning apparatus.

Referring to FIG. 32, a sectional view of an alternate embodiment cyclone bin assembly 14910 portion of the core cleaning unit 15000 that may be used by itself or with any other feature disclosed herein is exemplified. The cyclone bin assembly 14910 is similar to cyclone bin assembly 10910, and like elements are represented using analogous reference numbers indexed by 4000. The cyclone bin assembly 14910 is illustrated in isolation with the outer shell, filter cartridge member and the suction motor removed. In this embodiment the cyclone chamber 14913 is tapered such that the cross-sectional area taken in a plane 15020 that passes through the air inlet 14922 (toward the bottom of the cyclone chamber 14913) is larger than the cross-sectional area taken in a plane 15021 that passes through the dirt outlet 14924, and is larger than the cross-section area of the upper end wall 14937 of the cyclone chamber 14913 (which includes the air outlet 14923). In this configuration, the cyclone chamber sidewall 14921 includes a vertical portion 15022 and a generally inwardly-tapering frusto-conical portion 15023 positioned above the vertical portion. In this embodiment the volume of the cyclone chamber 14913 decreases toward the top to the cyclone chamber, which may help improve cyclone efficiency and/or may help dis-entrained dirt exit via the dirt outlet.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A hand carriable surface cleaning apparatus having a front end, a rear end and comprising:

(a) a dirty fluid inlet;

(b) a cyclone bin assembly comprising a cyclone chamber downstream of the dirty fluid inlet, the cyclone chamber comprising a lower end, an upper end, a cyclone axis, an air inlet and an air outlet comprising a vortex finder at the upper end;

(c) a pre-motor filter comprising at least one porous physical filter media having an upstream side through which air enters the pre-motor filter and a downstream side through which air exits the pre-motor filter wherein at least a portion of the upstream side is positioned above the upper end of the cyclone chamber, (d) a conduit that extends along the cyclone axis and comprises an extension of the vortex finder, the conduit extending through the at least one porous physical filter media and in communication with the upstream side of the pre-motor filter;

(e) a suction motor positioned downstream of the pre-motor filter and rearward of the cyclone chamber wherein;

(f) an air flow path extending from the pre-motor filter to the suction motor; and, (g) a clean air outlet downstream of the suction motor.

2. The hand carriable surface cleaning apparatus of claim 1 wherein upstream side is spaced further from the cyclone chamber than the downstream side.

3. The hand carriable surface cleaning apparatus of claim 2 further comprising a upstream header on the upstream side of the pre-motor filter and the upstream header is openable.

4. The hand carriable surface cleaning apparatus of claim 3 wherein at least a portion of the upstream header is transparent.

5. The hand carriable surface cleaning apparatus of claim 1 further comprising a downstream header on the downstream side of the pre-motor filter and the air flow path extends downstream from the downstream header.

6. The hand carriable surface cleaning apparatus of claim 1 wherein the suction motor has a suction motor inlet that is positioned between the lower and upper ends of the cyclone bin assembly.

7. The hand carriable surface cleaning apparatus of claim 6 wherein the suction motor has a suction motor axis that is generally perpendicular to the cyclone axis.

8. The hand carriable surface cleaning apparatus of claim 1 wherein the suction motor has a suction motor axis that is generally perpendicular to the cyclone axis.

9. The hand carriable surface cleaning apparatus of claim 1 wherein the air inlet is provided at the upper end and a dirt outlet is provided at the tower end and a dirt collection chamber is positioned below the cyclone chamber.

10. The hand carriable surface cleaning apparatus of claim 1 wherein the air flow path has a portion that is exterior to and extends part way along an exterior wall of the cyclone chamber to a suction motor inlet.

11. The hand carriable surface cleaning apparatus of claim 1 further comprising a dirt collection chamber positioned exterior to the cyclone chamber, the air flow path has a portion that extends part way along an exterior wall of the dirt collection chamber to a section motor inlet.

12. The hand carriable surface cleaning apparatus of claim 1 further comprising a handle, a suction motor housing and a pre-motor filter housing positioned above the cyclone chamber, the handle extending between the suction motor housing and the pre-motor filter housing.

13. The hand carriable surface cleaning apparatus of claim 12 wherein the pre-motor filter housing is openable.

14. The hand carriable surface cleaning apparatus of claim 12 wherein the suction motor has a suction motor axis that is generally perpendicular to the cyclone axis.

15. The hand carriable surface cleaning apparatus of claim 12 wherein the handle has a suction motor housing end that is spaced rearward of the cyclone bin assembly and below the pre-motor filter housing and a pre-motor filter end that is spaced above and forward of the suction motor end of the handle.

16. The hand carriable surface cleaning apparatus of claim 12 further comprising an opening having a perimeter and the perimeter comprises portions of the handle, the pre-motor filter housing and the suction motor housing.

17. The hand carriable surface cleaning apparatus of claim 1 further comprising a handle, wherein a portion of the handle is placed rearward of a center of gravity of the hand carriable surface cleaning apparatus.

18. The hand carriable surface cleaning apparatus of claim 1 further comprising a bleed valve having an inlet end in the air flow path.

19. The hand carriable surface cleaning apparatus of claim 18 wherein the bleed valve has an axis that is generally parallel to an axis of the suction motor.

20. The hand carriable surface cleaning apparatus of claim 1 wherein the pre-motor filter surrounds the conduit.

21. The hand carriable surface cleaning apparatus of claim 1 wherein a suction motor inlet is vertically positioned between the upper and lower ends of the cyclone chamber.

* * * * *